United States Patent [19]

Balban et al.

[11] Patent Number: 4,984,773

[45] Date of Patent: Jan. 15, 1991

[54] METHOD OF AND APPARATUS FOR COMPOSING A PRESS IMPOSITION

[75] Inventors: Morton S. Balban, Skokie, Ill.; Ming-Shong Lan; Rodney M. Panos, both of Thousand Oaks, Calif.

[73] Assignee: Rockwell International Corporation, Pittsburgh, Pa.

[21] Appl. No.: 105,159

[22] Filed: Oct. 6, 1987

[51] Int. Cl.[5] ..... B41F 13/58

[52] U.S. Cl. ..... 270/5; 270/1.1; 270/10; 270/18; 101/181; 364/471; 364/513

[58] Field of Search ..... 270/1.1, 4, 5, 6, 7, 270/10, 11, 18, 19, 20.1; 101/181; 364/513, 471

[56] References Cited

U.S. PATENT DOCUMENTS

| | | | |
|---|---|---|---|
| 3,942,782 | 3/1976 | Hermach | 270/6 |
| 4,108,067 | 8/1978 | Werner | 101/224 |
| 4,177,730 | 12/1979 | Schriber et al. | 270/21 |
| 4,346,446 | 8/1982 | Erbstein et al. | 364/551 |
| 4,495,582 | 1/1985 | Dessert et al. | 364/468 |
| 4,532,596 | 7/1985 | Pugsley | 364/469 |
| 4,591,983 | 5/1986 | Bennett et al. | 364/403 |
| 4,671,501 | 6/1987 | Fujishiro | 270/21.1 |

FOREIGN PATENT DOCUMENTS

| | | | |
|---|---|---|---|
| 2022883A | 12/1979 | United Kingdom | 270/5 |

OTHER PUBLICATIONS

"Artificial Intellegence: Protection Mechanisms on the New Frontier (What Are And How To Protect Expert Systems?)", by R. Lewis Gable and Richard A. Cederoth, *Computer Law Reporter*, Jul. 1988, pp. 714–737.

*Understanding Expert Systems*, Indianapolis, Ind., Howard W. Sams & Company, by Louis E. Frenzel, Jr., 1987.

The Press Lineup Advisor: An Expert System for Printing Press Configuration, Software Engineering Symposium, Rockwell International, Oct. 6, 1986, by Morton S. Balban, Ming-Shong Lan and Rodney M. Panos.

"A Knowledge-Based Approach to Printing Press Configuration", *Proc. of the 3rd Conf. on AI Applications* (IEEE), Feb., 1987, by M. S. Lan, R. M. Panos and M. S. Balban.

"AI/ES Aids in Newspaper Manufacturing", by Morton S. Balban, *Manufacturing Applications of Artificial Intelligence: The User and Supply Perspective*, (Society of Manufacturing Engineers), Mar., 1987.

"The Press Lineup Adviser: An Expert System for Printing Press Configuration", by Morton S. Balban, (List continued on next page.)

*Primary Examiner*—Edward K. Look
*Assistant Examiner*—Therese M. Newholm
*Attorney, Agent, or Firm*—R. Lewis Gable

[57] ABSTRACT

An apparatus and a method are disclosed for composing an imposition in terms of an arrangement of printing plates on selected of the image positions on selected units of a printing press to print a given edition, by first assigning each section of this edition to one of the press areas. Thereafter, each printing unit is examined to determine an utilization value thereof in terms of the placement of the printing plates on the image positions and the relative number of image positions to which printing plates are assigned with respect to the total number of image positions. Thereafter, a list of the image positions for each of the sections and its area, is constructed by examining one printing unit at a time in an order according to the placement of that printing unit in the array and examining its utilization value to determine whether or not to include a particular image position of that printing unit in the list. As a result, a list of the image positions is constructed in a sequence corresponding to numerical order of the pages in the section under consideration. Finally, that list of the image positions and the corresponding section and page numbers is displayed in a suitable fashion to inform a user of how to place the printing plates in the desired arrangement onto the printing units of the press to print this given edition.

44 Claims, 43 Drawing Sheets

OTHER PUBLICATIONS

Ming-Shong Lan, and Rodney M. Panos, *Machine Intelligence Newsletter,* Nov., 1986.

*Pressman's Manual* 234, Goss Versatile Angle Bars, dated Feb. 1981, Rockwell International.

*Goss Folder Operation Manual* 299-*OM, Regent* 2:1 *Folder,* Mar., 1984, Rockwell International.

"Positioning Plates on a Double Width Press", *Instruction Bulletin,* Jul. 1985, Rockwell International.

278-*OM Operation Manual, Goss* 160-*Page Imperial* 3:2 *Folder,* Jul., 1981, Revised Feb., 1986, Rockwell International.

"Artificial Intelligence: Expert System Model of the Design Process", *Design News,* 3/3/86, pp. 149-155, by Faith Kinoglu and Dr. Don Riley.

"Model Design in the Prospector Consultant System for Mineral Exploration", *Expert Systems in the Micro-Electronic Age,* pp. 153-167, by Richard Duda, John Gaschnig and Peter Hart.

"Dendral and Meta-Dendral: Their Applications Dimension", *Artificial Intelligence II,* 1978, pp. 5-24, by Bruce G. Buchanan and Edward A. Feigenbaum.

"R1: A Rule-Based Configurer of Computer Systems", *Artificial Intelligence,* 19, 1982, pp. 39-88, by John McDermott.

"Software Tools Speed Expert System Development", *High Technology,* Mar. 1985, by Paul Kinnucan.

"Classification Problem Solving", *Proc. National Conference on Artificial Intelligence,* 1986, pp. 49-55, by William J. Clancy.

"Section III, Preparing to Run", 280-*OM Operation Manual, Goss Metroliner, Printing Units with Injector Ink System,* Mar. 1981 (revised Jan., 1983).

"Artificial Intelligence—Parts 1, 2, and 3", *Manufacturing Systems,* Jan., Feb., and Mar. 1986, by Mary Emrich.

"The World of AI Software", *Electronic Business,* Feb. 1, 1986, pp. 72-81, by Mary Jo Foley.

"Artificial Intelligence: Understanding the Basic Concepts", *Design News,* 3-3-86, pp. 89-97, by Dr. Henry Eric Firdman.

"Systems Architecture: Why Bother with Expert Systems?", *Digital Design,* Jul. 1986, pp. 47-49, by Richard E. Morley and William A. Taylor.

"AI Shapes Up for Mainstream Use", *Mini-Micro Systems,* Aug. 1986, pp. 57-67, by Wendy Rauch-Hindin.

"Systems Architecture: Expert Systems Leverage Designer's Knowledge", *Digital Design,* Aug., 1986, pp. 39-43, by Joseph Aseo.

"Artificial Intelligence, Part IV", *Manufacturing Systems,* Jun. 1985, by Mary Emrich.

"Programming Gets Object Oriented", *Digital Design,* Sep., 1986, by Brita Meng.

"Smalltalk Isn't Meaningless Chatter", *Computer Design,* Jan. 15, 1987, by Juanita J. Ewing and Rebecca Wirfs-Brock.

*Rule-Based Expert System: The MYCIN Experiments,* Addison-Wesley, 1983, by B. G. Buchanan, et al.

*System Aids in Constructing Consultation Programs,* Ann Arbor, Mich.: UMI Research Press, by van Melle, 1981.

*S.I. Reference Manual,* Teknowledge, Inc., Palo Alto, Calif., Jun. 1985.

460

496

VII

Attributes of object class Imposition

Main Side Back Section, Main Side Front Section, Add Unit, Evolution Technique,
Off Side Back Section, Off Side Front Section, Color Printability of Main Side Back,
First Unit for Lg Sections, First Unit for Sml Sections, Color Printability of Off Side Back,
Number of Front Units Needed, List of Units for Sml Sections, Direction of Angle Bar for Large Black,
List of Avail. Back Units for Lg, List of Units for Lg Sections, Direction of Angle Bar for Large Color,
Number of Back Units for Lg, No Fly Sheets for Lg Sections, Direction of Angle Bar for Small Black,
No Fly Sheets for Sml Sections, Small Fly Sheet Assigned, Direction of Angle Bar for Small Color,
Large Fly Sheet Assigned, Process Color Unit Needed, First Unit for Large Sections,
Lineup for Mn Side Back Section, Lineup for Mn Side Front Section, First Neighbor Pages for 12 Mainside,
Lineup for Off Side Back Section, Lineup for Off Side Front Section, First Neighbor Pages for 12 Offside,
Location of Small Third Section, Generation Mechanism, First Color Printability Check for Large,
Large Color Imposition Technique, List of Color Pages for Mainside Back, List of Color Pages for Mainside Front,
List of Color Pages for Offside Front, List of Color Pages for Offside Back, Mainside Back Section has Color,
Mainside Front has Color, Message Number, List of Color Pages for Small Third section,
Mainside Front has Color on 3rd or Second to Last Page, Mainside Front Color Pages not on Correct Unit,
Number of Bar for Large Black, Number of Bar for Large Color, Number of Bar Quarter Unit,
Number of Bar Half Unit, Offside Front has Color, Offside Back has Color,
Number of Nonprocess Color Front Units for Large, Number of Process Color Units for Large,
Offside Front has Color on 3rd or Second to Last Page, Offside Front Color Pages not on Correct Unit,
Possible Color Pages for Mainside Front on 12, Possible Color Pages for Mainside Front on 6,
Possible Color Pages for Mainside Front on 7, Possible Color Pages for Offside Front,
Possible Color Pages for Offside Front on 12, Possible Color Pages for Offside Front on 6,
Possible Color Pages for Offside Front on 7, Printability for Large Sections Based on Lineup,
Printability of Color Mainside Front Based on Lineup, Printability of Color Offside Front Based on Lineup,
Printability Based on Color for Small, Remaining Pages After Lineup Color, Second Neighbor Pages for 12 Mainside,
Second Neighbor Pages for 12 Offside, Small Color Imposition Technique, Small Fly Sheet Case,
Small Half Unit, Small Half Unit Assigned, Step to Take,
Small Third Section has Color, Three Quarters Unit Assigned, Turning Page for Mainside Front,
Turning Page for Offside Front, Turning Page Minus 2 for Mainside Front, Turning Page Minus 2 for Offside Front,
Turning Page Plus 1 for Mainside Front, Turning Page Plus 1 for Offside Front,
Turning Page Plus 3 for Mainside Front, Turning Page Plus 3 for Offside Front,
Unit 12 has Correct Color Page for Mainside, Unit 12 has Correct Color Page for Offside,
Unit 6 has Correct Color Page for Mainside, Unit 6 has Correct Color Page for Offside,

FIG. 4E'''

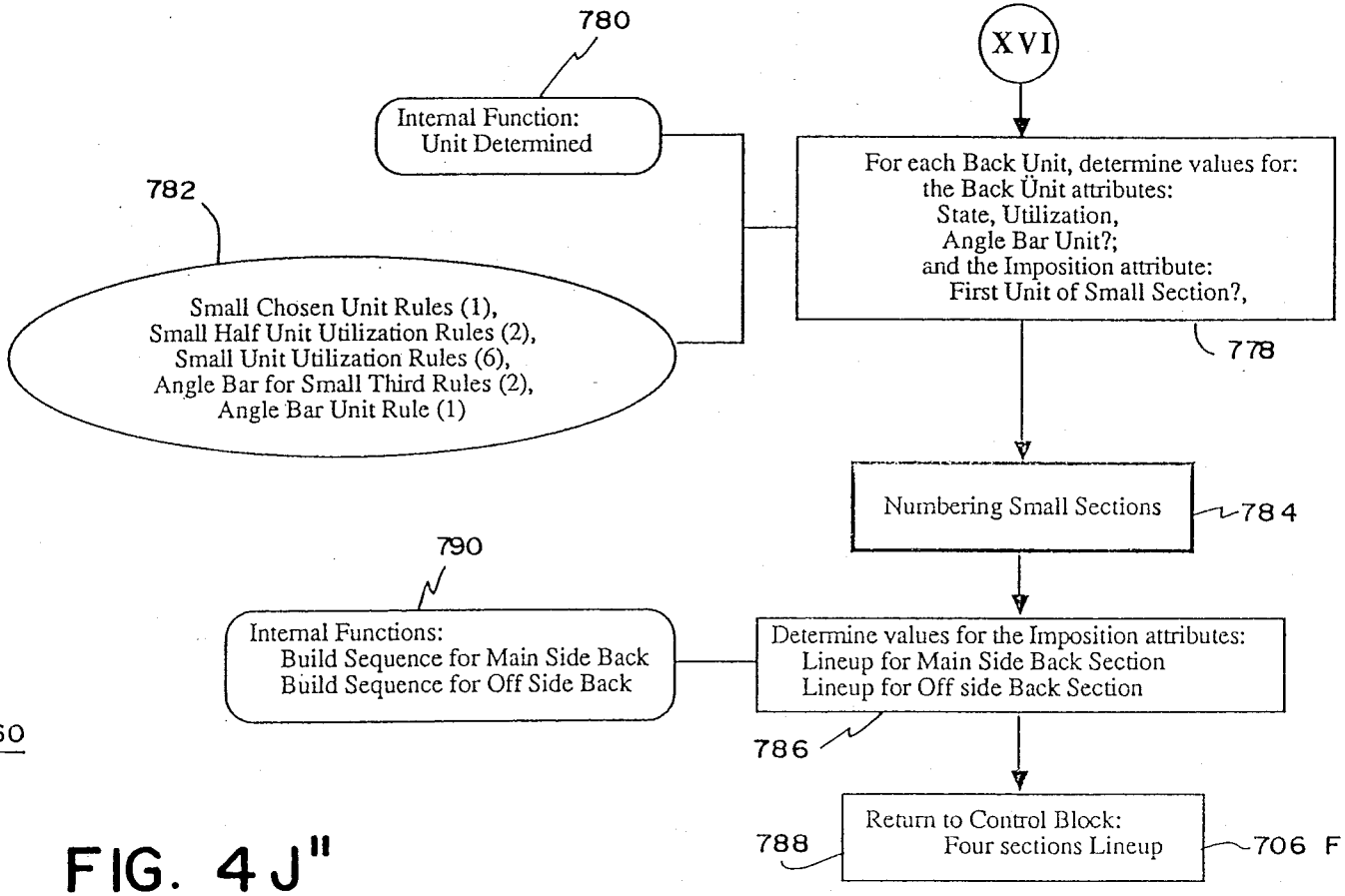
FIG. 4J"

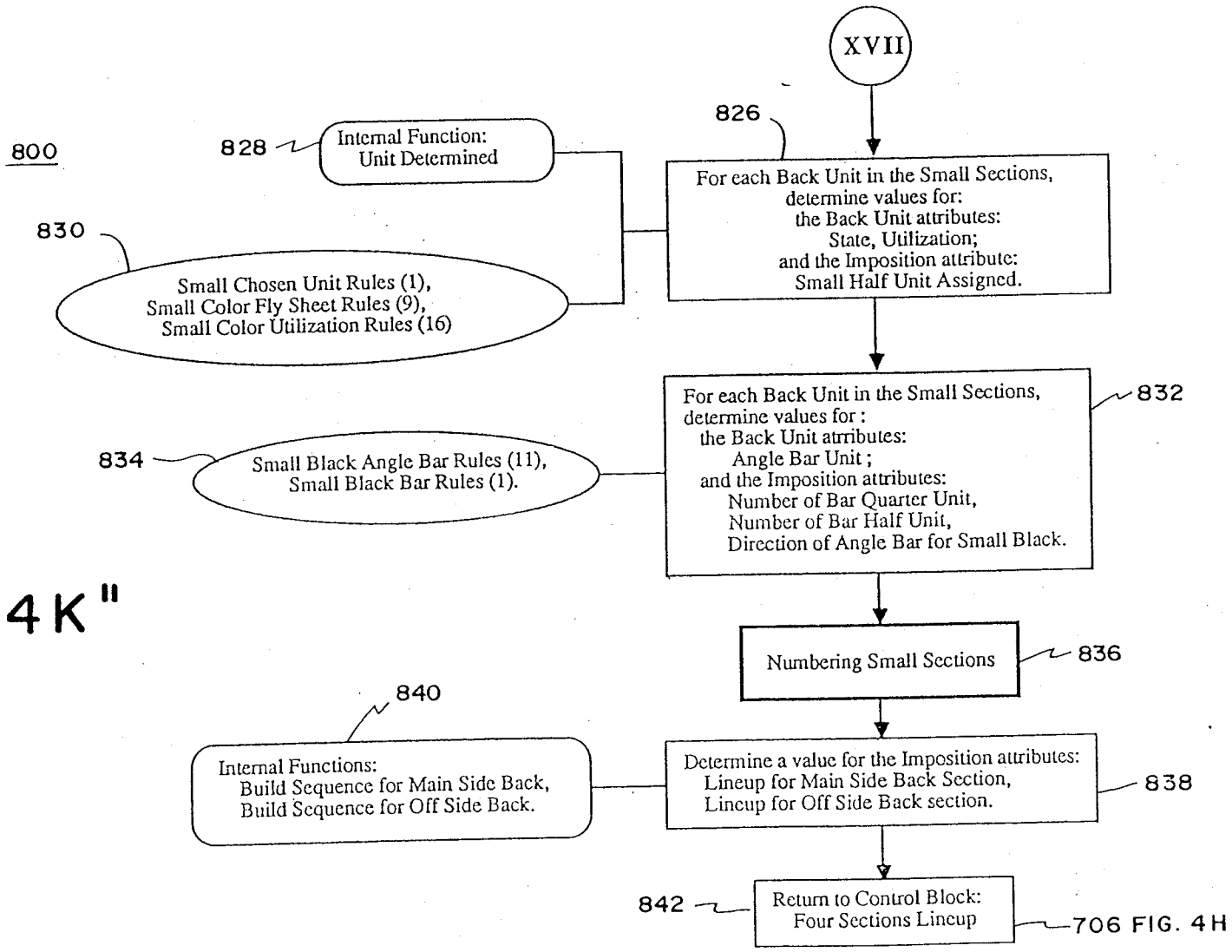
FIG. 4K"

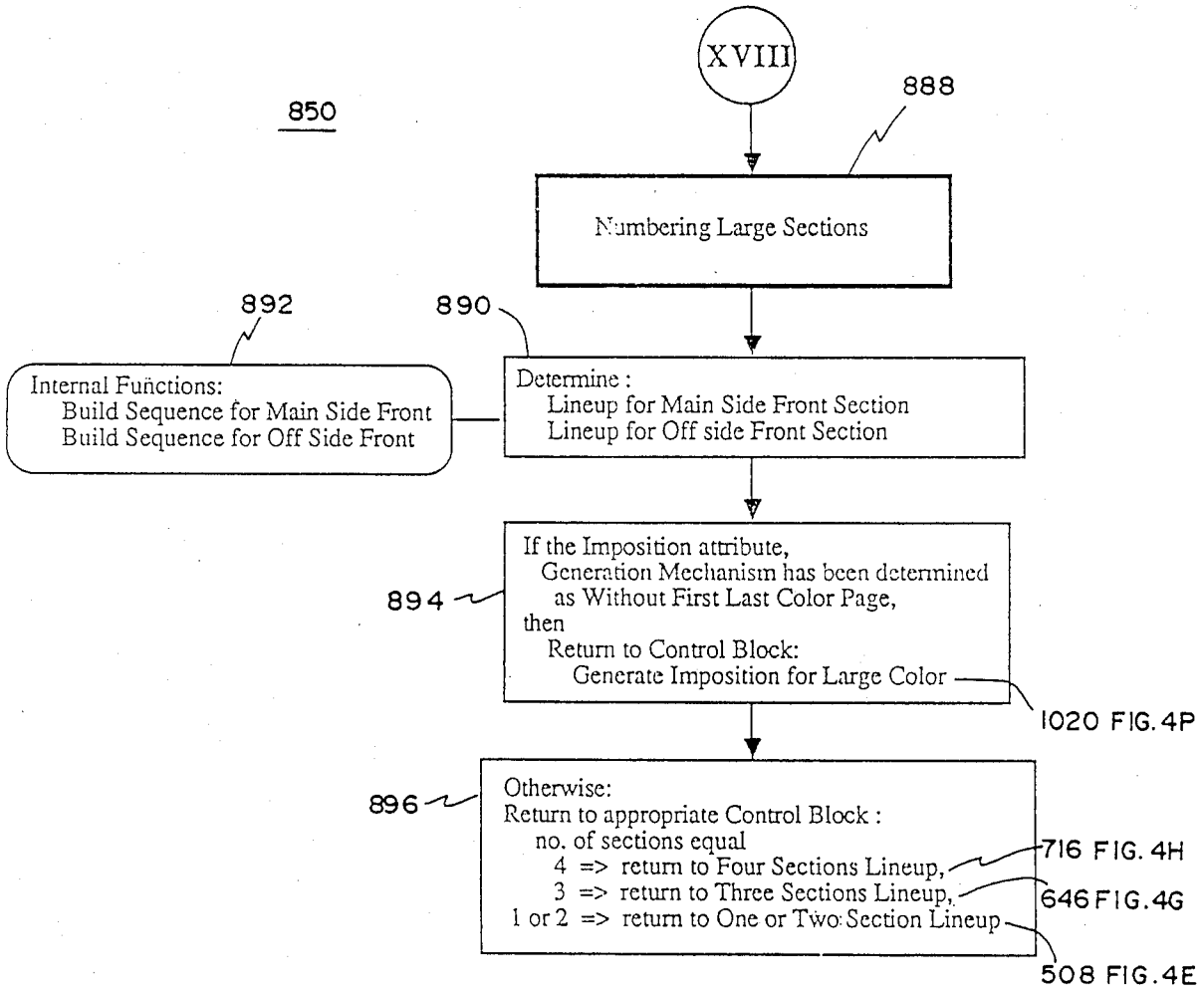
FIG. 4L"

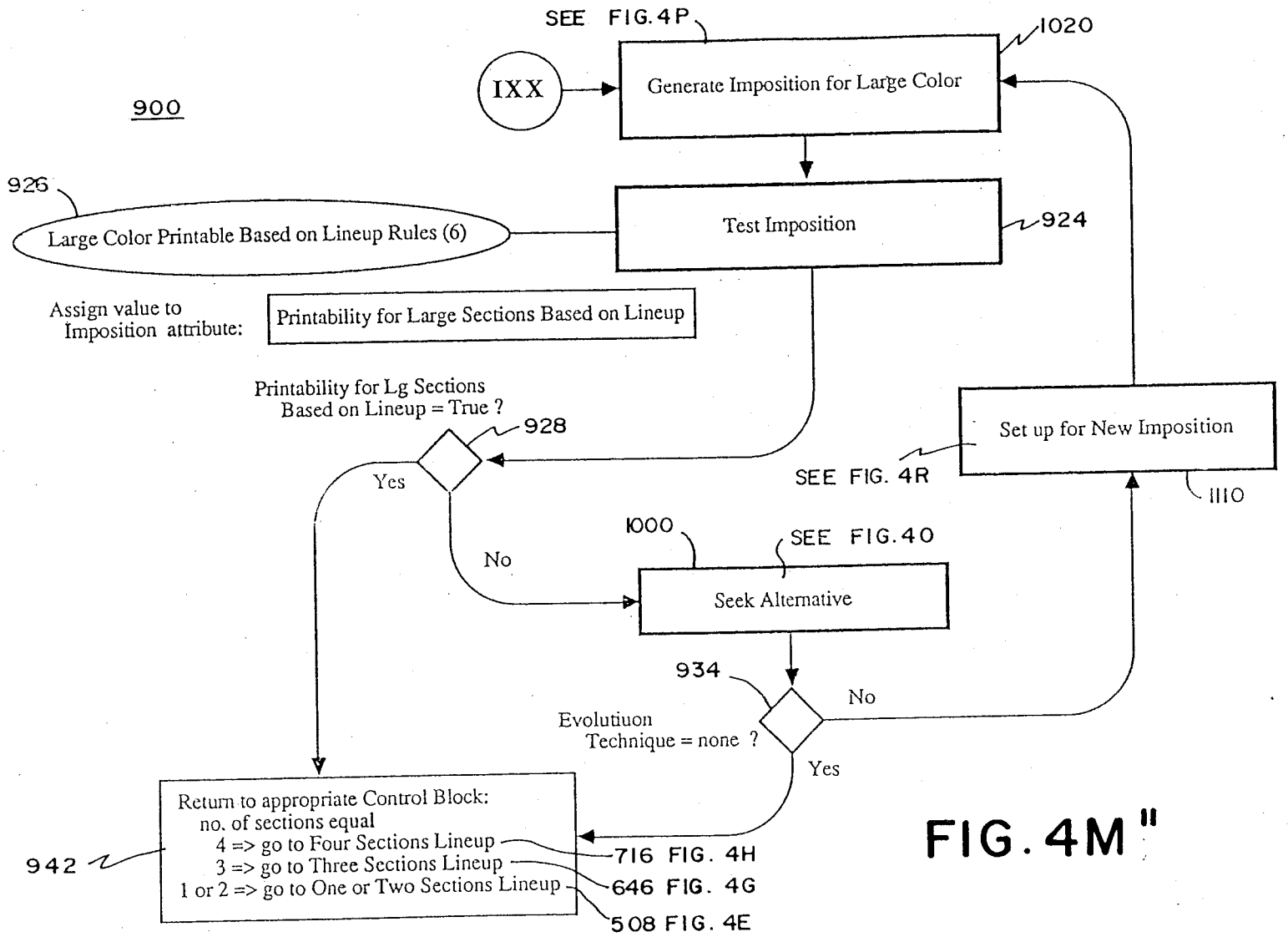
FIG. 4M"

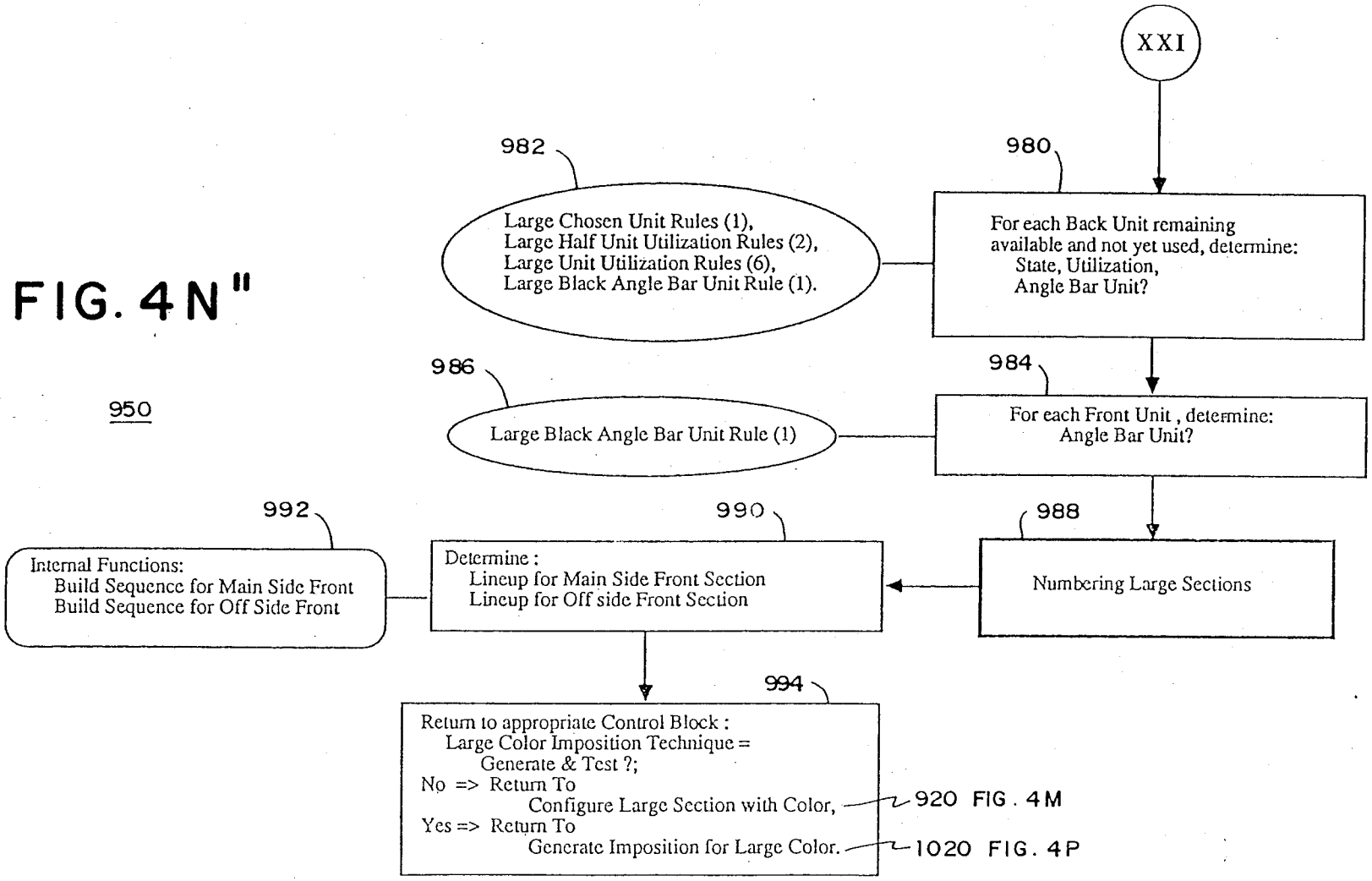
FIG. 4N"
950

934 FIG.4M

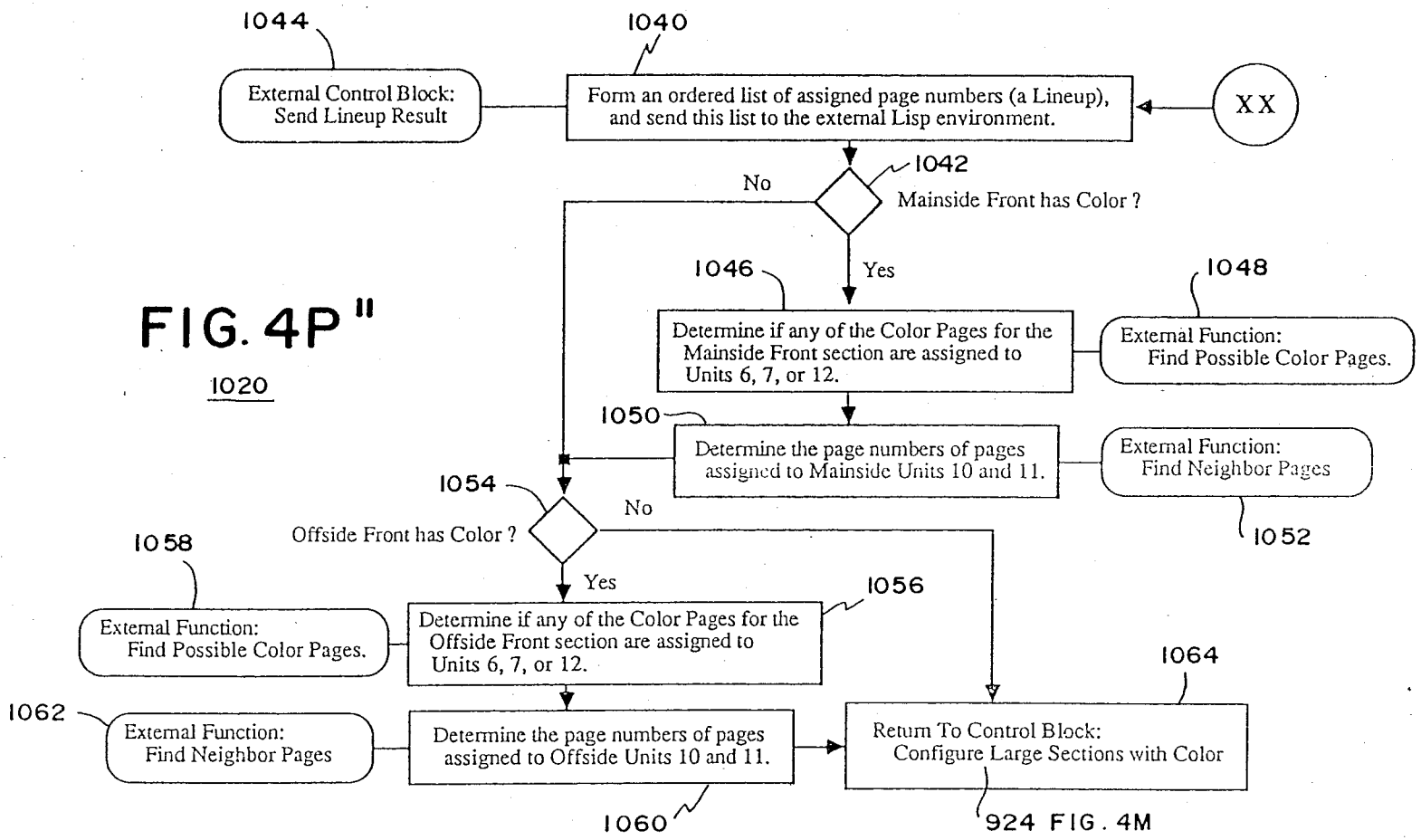
FIG. 4P"
1020

RCA I-COLOR P.I III BLUE
TWA I-COLOR P.18 III BLUE
DIGITAL 3-COLOR P.I IV
SEARS 3-COLOR P.28 IV
UNITED I-COLOR P.I VI BLUE
GM 3-COLOR P.I IX

METHOD OF AND APPARATUS FOR COMPOSING A PRESS IMPOSITION

FIELD OF THE INVENTION

This invention relates to a method of and apparatus for devising a press imposition and, in particular, for determining the proper position of each page's image or printing plate on a press unit for a particular edition or press run of a publication such as a newspaper.

DESCRIPTION OF THE PRIOR ART

Printing is a complex process, requiring the correct selection, setting and interaction of various materials and processes and the consideration of a host of physical and operational constraints. Modern printing equipment can produce publications such as newspapers at rates exceeding 70,000 copies per hour. Such printing equipment is capable of printing the pages, sectioning the pages and folding them automatically into completed editions, such as newspapers.

This invention concerns the method of and apparatus for devising or composing a "lineup" or an "imposition" of a printing press for a particular press run or edition of a publication. An imposition is that proper arrangement of the image or printing plates onto the many possible positions of the printing units of the press. As shown in FIG. 1 of the drawings, the imposition is the proper placement of each printing plate 13 onto the possible positions of a printing press 10 so as to produce a particular edition or press run with the required number of sectior's for the entire edition and the pages in each section arranged in a desired sequence of the sections. Briefly, the printing press 10 includes a plurality of printing units 12 arranged with respect to a folder assembly 14. In considering the illustrative press 10 of FIG. 1, the printing units 12*a, b* and *c* are said to be in front of the former assembly 22, whereas the printing units 12*d* and *e* are behind. Thus, the units 12*a, b* and *c* are known as front units, and units 12*d* and *e* as back units. Each printing unit 12 has a supply or roll 16 of paper, which is fed as a web 18 to its unit 12, whereby printed images from the image or printing plates 13 are transferred to the back and front of each web 18. After being so printed, each web 18 is directed to the folder assembly 22, as may be comprised of a plurality of formers 14, each of which acts to slit a web 18 into a two-page width of the press run, before it is folded and assembled into the appropriate number of sections, each section containing the selected number of pages.

At least once and often several times a day, a newspaper publisher must prepare its press for a new press run. Such preparation requires the composing of a new imposition. In the prior art, this task has been performed by an expert, someone with a considerable amount of experience regarding the press, its operation, and the relevant policies of a particular newspaper publisher. In particular, such an expert must be thoroughly familiar with the functioning of a particular press and of the various rules and relationships between the printing units 12 of the press 10 to be used to print and to assemble a particular press run. The necessary experience of such an expert often requires years to obtain. Therefore, relatively few people have the required background.

Not only must such an expert be familiar with the press 10, but also must be aware of the content and the distribution of the newspaper in order to design a particular imposition. A particular imposition will depend on several factors, for instance, editorial content, several different editions, advertisement requirements, and multiple production sites. These factors often require new or modified line-ups to accommodate changes. Furthermore, the time provided to compose such impositions is often short, since changes as dictated by advertising, editorial or fast breaking news stories may occur close to press time.

The composing of the imposition is highly dependent on two sets of constraints, hard and soft, as will place bounds on the number of possible impositions or line-ups that can possibly satisfy the specifications of a particular press run. Hard constraints arise from the configuration of the press 10 that is available to print a particular press run, and these constraints cannot be violated. Hard constraints involve the number of press units 12 available, and their type and relative location within the press 10. As shown in the press example of FIG. 1, the printing units 12*b* and 12*e* are capable of only printing black and white, whereas the printing units 12*d* and 12*a* are color half-deck units and are capable of printing a limited number of colors, e.g. three. On the other hand, unit 12*e* is a full color deck and is capable of printing four different colors.

Further, the printing units 12 may illustratively be a double-width, black and white press having four image positions disposed along their length. As shown in FIG. 1, each printing unit 12 has a pair of cylinders, each receiving a pair of printing plates 13. Thus each image position has a quartet of printing plates 13 and each unit 12 illustratively has a total of 16 printing plates 13. In a straight mode of operation, two identical printing plates 13 are disposed opposite each other on each cylinder of the unit 12, whereby each unit 12 has eight different pairs of plates 13. In a collect mode of operation, two different printing plates 13 are disposed on each cylinder, and each unit 12 has 16 different plates 13. By using 16 different printing plates 13 on each unit 12, the collect mode is capable of operating the press 10 to produce twice the number of different page types and thus is suitable for printing a large or "jumbo" press run as would have a relatively large number of sections and pages in each section. By contrast, the straight mode of operating the press 10 is particularly adapted for printing relatively smaller editions. In the straight mode, the press 10 prints so that twice the number of finished products are printed in the same period of time. Two identical printing plates 13 are used in the straight mode on each cylinder to print two identical pages per revolution of the cylinder, each page being separated and directed to be included within it's own product.

FIG. 2A illustrates an approach often used for slitting selected webs 18 into two halfs and rerouting one of the resulting web halfs or portions 18' and 18'' by means of a set of angle bars 20. In particular, the full web 18 is cut by a slitter 21 and the resulting web portion 18' is repositioned by the angle bars 20 and superimposed upon the web portion 18'', before the pair of webs 18' and 18'' are fed together to the folder assembly 22. FIG. 2B shows the folder assembly 22 in more detail, as including a pair of top formers 14*a* and *b*, and a pair of bottom formers 14*c* and *d*. It is contemplated that other folding assemblies could be incorporated into this press, e.g. a folding assembly with 6 formers could accommodate a press run with 6 sections. In the example shown, the back units 12, i.e. those units 12 disposed behind the folder assembly 22, are assigned to print the relatively small sections of the press run, whereas the front units 12, i.e. those units disposed in front of the folder assembly 22, are used to print the relatively large sections. Typically, the bottom formers 14*c* and *d* process and fold a large number of webs 18 and form the larger sections; therefore, the webs 18 from the front units 12 are normally directed to the bottom formers 14*c* and *d*, whereas the webs 18 from the back units 12 as are typically dedicated to print the small sections, are directed to the upper formers 14*a* and *b*.

Typically, a double width web 18 is directed from the back units 12 to be split by a slitter 21*a*, before the resulting halves are fed respectively to the formers 14*a* and 14*b*. In a similar fashion a double width web 18 is directed to the folder assembly 22 to be cut by a slitter 21*b*, before the halves or portions 18' and 18" are respectively fed to the folders 14*c* and 14*d*.

Though this invention may be employed with many different types of printing presses other than that shown in FIG. 1, reference is made to the "280-OM OPERATION MANUAL, Goss Metroliner Printing Units with Injector Ink System", published March 1981 (revised January 1983) by the assignee of this invention, and to "278-OM OPERATION MANUAL, Goss 160-Page Imperial 3:2 Folder, published July 1981 (revised February 1986) by the assignee of this invention for a further description of the printing units 10; these publications are incorporated herein by reference.

In comprising a lineup or imposition, it may be found that there may not be a sufficient number of the front units 12 to print the large sections In that case, a slitter 21 may be employed to provide a split lead comprising the web portions 18' and 18" so that the lower web portion 18" may be directed to one of the lower formers 14*c* or 14*d*, thus providing a further sheet to a selected one of the large sections. The slitter 21 may be used to permit the back printing units 12 to supply its web portion 18" to those sections of the press run as would be normally printed by the front printing units 12. In other words, the slitter 21 provides a "split lead" whose lower web portion 18" may add an additional page to those sections normally printed by the front units.

The hard constraints contemplated in the composing of an imposition, arise from the nature of the printing press 10, itself. They include the type of printing units 12 available, the number of printing units 12 capable of printing color pages, the relative location of these color printing units 12 within the printing press 10 and the positions of the printing plates 13 on a particular color printing unit 12, the relative placement of the printing units 12 with respect to the folder assembly 22 (in front of or behind), the relative placement of the color and non-color printing units 12, the contemplated mode of operation (collect or straight), and the number and position of the sets of angle bars 20 and the slitters 21. The number of possibilities are extremely large. The hard restraints as related to the printing press 10 itself most often cannot be changed.

Factors involved in composing an imposition also relate to the nature of the edition to be printed. Such factors include the number of the sections in a particular press run, the number of the pages in each press run, the number and types of color pages in each section, the particular colors used on a page and a wide spectrum of the publishers' operational rules and conditions.

By contrast, the soft constraints arise from considerations of long-term productivity and may, under the right circumstances, be violated. The soft constraints typically involve issues such as maintaining balance between the two sides of the printing units 12, directing the webs 18 as will comprise the small sections of the press run to the formers 14 that are disposed in a relatively higher position, minimizing the number of press units 12 used, minimizing the number of the sets of angle bars 20 used and minimizing the number of split leads and the use of partial paper rolls 16.

The process of composing an imposition is extremely complex due to the large number of involved factors, as described above. For example, a typical printing press 10 may have twelve, double width printing units 12 capable of receiving ninety-six different printing plates 13 in the straight mode and 160 different plates 13 in the collect mode, the latter number being limited by the current state of the art folder assembly design capacity to 160 pages. A press run or edition for such a printing press 10 can easily have ninety-six pages. The number of possible positions for the printing plates 13 has a maximum number of variations equal to 96 factorial. The paper web 18 may have up to 8 or 16 different pages printed on it, depending upon whether the printing press 10 is operated in its straight or collect mode.

No general algorithm is available for composing an imposition. The number of possible variations of the factors, as described above, is simply too large and the variations thereof are too complex to fit any general algorithm. Further, look-up tables cannot be realistically devised for such a composing process. There is no unique solution to composing a line-up. There may be: (a) no possible imposition; (b) only one possible imposition, or (c) more than one possible imposition. At present, the process of composing an imposition is carried out by experienced pressmen, as noted above.

In considering the prior art, U.S. Pat. No. 3,942,782 of Hermach and assigned to the assignee of this invention, is noted. The Hermach patent '782 discloses a particular "imposition" of a printing press to facilitate the printing of a "jumbo" edition of a newspaper as will be typically configured to operate in its collect mode. In such a mode, each plate cylinder may illustratively carry 12 different plates, and 24 different pages are printed during each cycle of operation. Twelve of these pages will constitute a first product and the other 12 pages will constitute a second product, the first and second products being combined in the folder assembly to form a complete newspaper. Contemplating a printing press with 12 printing units, Hermach teaches that a first set of 6 webs are directed from a corresponding first set of 6 printing units as disposed upon a first side of the folder assembly, which comprises upper and lower formers. The first set of webs is led directly into the upper formers, which have a first orientation so that the webs of the first set are folded along their right-hand edge. A second set of webs as taken from a corresponding second set of 6 press units as disposed upon an opposite side of the folder assembly, is directed to the lower formers that are inclined downwardly in an orientation opposite to that of the upper formers, whereby the second set of webs is folded by their formers along their left-hand edge, whereby when the folded sections from the first and second sets of webs are disposed in a stack, substantially equal numbers of the sections are folded on opposite sides. The resulting stacks are easier to handle and may be transported with greater speed It is apparent that the Hermach patent '782 relates to a single imposition of his printing press and does not disclose any apparatus or method for composing a selected one of a great number of possible imposition as would be capable of guiding a pressmen to layout a particular press unit for a given press run or edition.

SUMMARY OF THE INVENTION

It is an object of this invention to provide a new and improved apparatus and method of composing an imposition for a printing press for a particular edition.

It is another object of this invention to provide a new and improved apparatus and method of composing an imposition for a printing press considering a large number of factors, including the number of sections in an edition to be printed, the number of pages in each section, the presence and position of color pages within each section, the number and relative placement of the printing units within the press, the availability of the printing units to print this edition and the presence and relative position of printing units capable of printing plural colors.

It is a still further object of this invention to provide a new and improved apparatus and method of composing an imposition for an edition using the automated methods of a computer and in particular an expert system, as are capable of automatically and rapidly composing an imposition.

It is a still further object of this invention to provide a new and improved apparatus and method of composing an imposition utilizing an artificial intelligence shell for defining instances of the edition to be printed and of the press to print the edition, a body of rule sets defining the possible relationships between the edition and the press, and control blocks for variously directing the applications of the rule sets to the instances whereby an imposition is composed for this edition.

In accordance with these and other objects of the invention, there is provided an apparatus and a method of composing an imposition for printing upon a printing press a given edition comprised of a given number of sections. The printing press comprises a folder assembly and an array of printing units, at least one of the printing units being disposed in front of and at least one unit in back of the folder assembly. Each of the printing units has a plurality of image positions adapted to selectively receive printing plates to print a like plurality of images onto a web and feeding the web to the folder assembly, which receives, combines and folds a plurality of the collected webs into the given number of sections of the edition. The printing press has a plurality of areas in terms of the placement of the printing units. The apparatus and method of this invention composes an imposition in terms of the arrangement of the printing plates on selected of the image positions on selected units to print this edition, by first assigning each section of this edition to one of the press areas. Thereafter, each printing unit is examined to determine an utilization value thereof in terms of the placement of the printing plates on the image positions and the relative number of image positions to which printing plates are assigned with respect to the total number of image positions. Thereafter, a list of the image positions for each of the sections and its area, is constructed by examining one printing unit at a time in an order according to the placement of that printing unit in the array and examining its utilization value to determine whether or not to include a particular image position of that printing unit in the list. As a result, a list of the image positions is constructed in a sequence corresponding to numerical order of the pages in the section under consideration. Finally, that list of image positions and the corresponding section and page numbers is displayed in a suitable fashion to inform a user of how to place the printing plates in the desired arrangement onto the printing units of the press to print this given edition.

In a further aspect of this invention, the step of constructing the list of image positions further includes the detecting the presence and location of a set of angle bars with respect to the array of printing units and, if present, including in that list the image position as transferred by the set of angle bars from another press area into this press area.

In a still further aspect of this invention, the apparatus and method is capable of composing an imposition for an edition wherein at least one section thereof has at least one color page and the printing press includes at least one unit capable of printing in plural colors. In particular, a generate-and-test method is used to determine the proper placement of the color pages, by first composing a current imposition of the edition based on the premise that this edition is without any color page. Next, the current imposition is compared with the array of printing units to determine if the color page is assigned or not assigned to be printed by a color printing unit to determine whether this edition may or may not be printed by this current imposition. If not printable, the generate-and-test method devises a change to the current imposition before returning to the imposition composing step to devise a new imposition to be tested.

In a particular aspect of the generate-and-test method, a first list of those pages to be printed in color and a second list of those pages that are presently assigned to a color unit are constructed. Thereafter, the first and second lists are compared to develop a third list of those color pages not presently assigned to a color unit and, based upon this third list, the change to be made to the current imposition is devised.

BRIEF DESCRIPTION OF THE DRAWINGS

These and other objects and advantages of the present invention will become apparent by referring to the following detailed description, and accompanying drawings wherein identical parts have the same reference numerals.

DESCRIPTION OF THE PREFERRED EMBODIMENT

Figure 3:
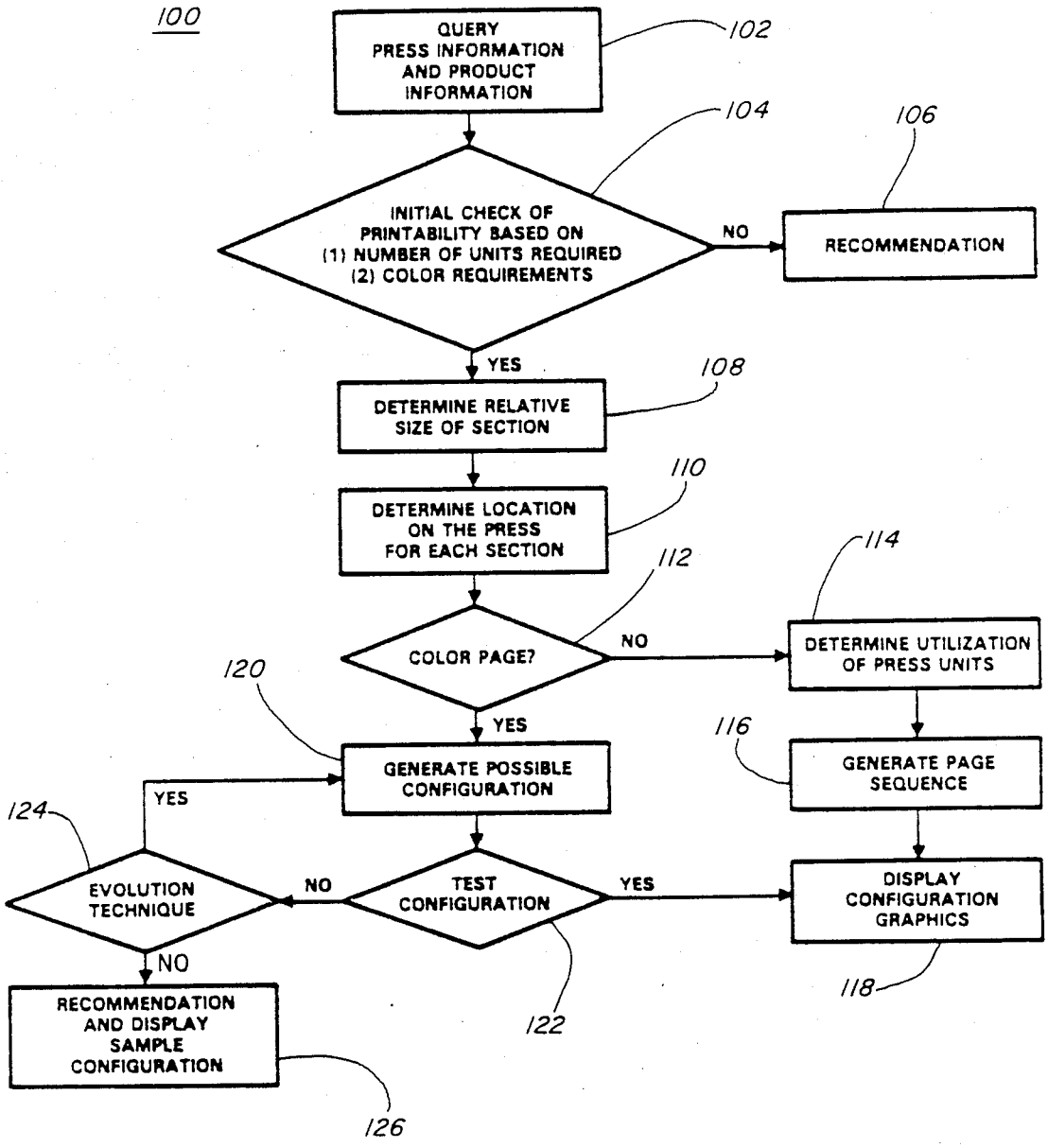
FIG. 3 is a high level flow diagram illustrating the method of composing an imposition of the printing press as shown in FIGS. 1, 2A and 2B in accordance with the method of this invention.

The method of composing an appropriate press configuration, i.e. an imposition, is one of selection of the available elements. However, determination of the "available elements" is a complex inter-relationship of the physical "hard constraints", as described above and the somewhat flexible, but "soft constraints". This process is one of sequential refinement. The process first considers the number and relative sizes of the sections of the press run to be printed and logically places in a coarse fashion the printing plates 13 at tentative locations on the printing units 12. Thereafter, the process considers the disposition of the individual pages within a particular section, and only then considers the disposition of the printing plates 13 to print the interior color pages. Such a process is illustrated in the high level flow diagram of FIG. 3. Initially, step 102 will conduct a consultation with the user, wherein a number of questions are posed to the user, e.g. a pressmen at a terminal or interface, or provided via an automatic import means. Questions concerning the edition or press run to be printed will be posed as to the number of sections, the number of pages in each section and the pages to be colored and the color(s) used. Answers to these questions will be inputted by the pressman or other means. In addition, information about the press 10 in terms of the number of printing units 12, the number of such units 12 in front of the folder assembly 22 and of those behind, identify those units 12 capable of printing in full color and those capable of printing a limited number of colors or using spot color processing, and the number, placement and orientation of the sets of angle bars 20 on the press 10 will be entered in step 102. Those units 12 disposed in front of the folder assembly 22 are known as front units 12, and those behind the folder assembly 22, as back units 12. The information is also entered to identify those printing units 12 that are available and those that have been taken out of service. Based upon the entered information, step 104 will make a preliminary check of whether there is a sufficient numbers of printing units 12 to print the required number of sections and of units 12 having appropriate color printing capabilities to print the color requirements of the given press run. If the printing press 10 in not capable of printing the press run, step 104 will make the determination that this press run is not printable and step 106 will inform in a suitable fashion, e.g. print out a message or display upon a CRT, that this press run is not printable.

Figure 1:
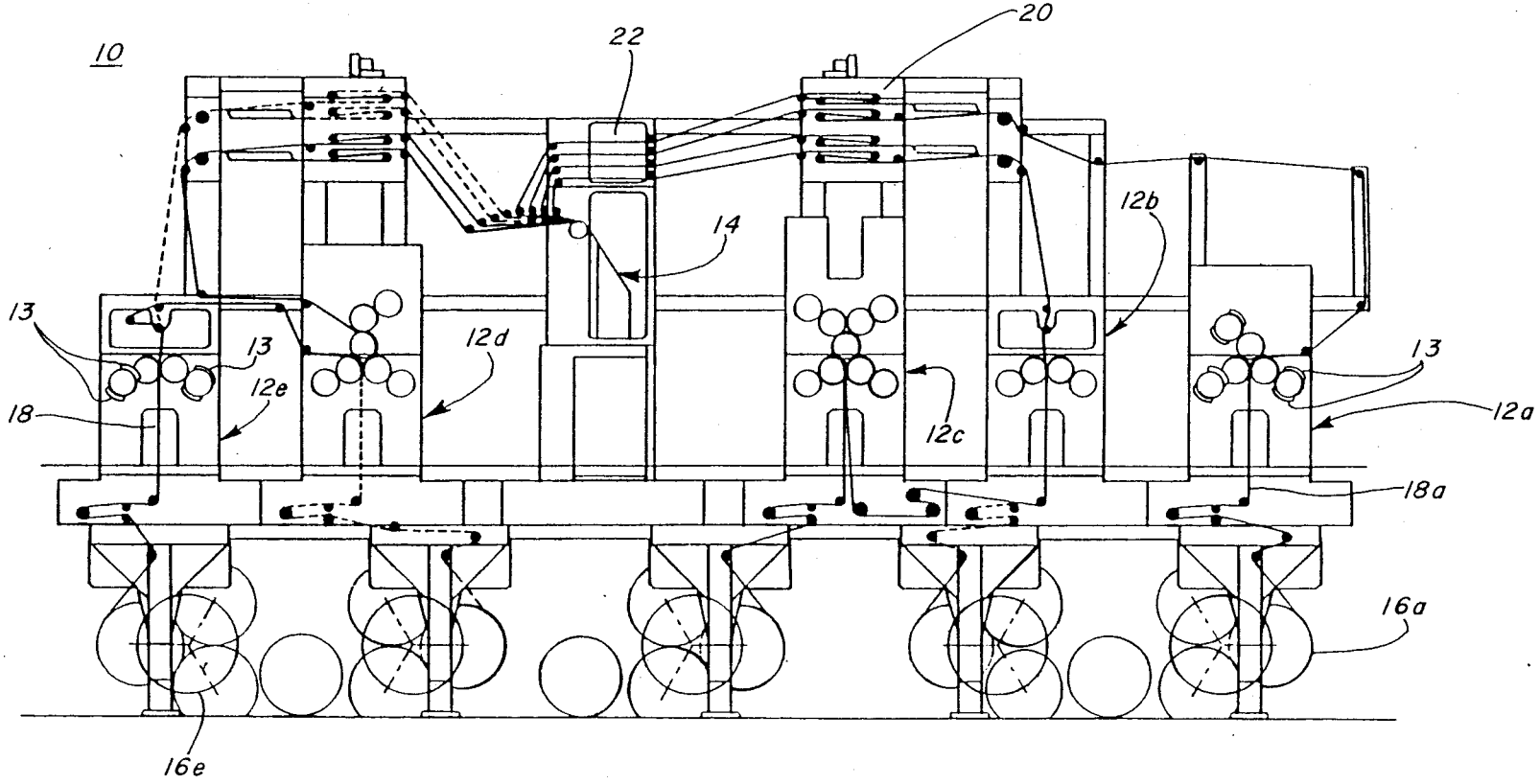
FIG. 1 PRIOR ART
FIG. 1 is an illustrative, side view of the front or main side of a printing press as is known in the prior art and which is shown and described to illustrate the method of and apparatus composing an imposition of its printing plates in accordance with the teachings of this invention.

However, if printable, the program moves to step 108, which determines the size of each section of the press run and, thereafter, step 110 will coarsely determine the location of where each section is to be printed, i.e. a particular section will be printed by a back or front printing unit 12. In the illustrative embodiment of the printing press 10 as shown in FIG. 1, each press unit 12 is a double-width press with the "main side" units 12 being visible in FIG. 1 and the "off side" units being disposed therebehind.

Dependent upon whether colored pages are needed and the relative placement of those color pages in a section, the method of this invention employs either a rule-base backward reasoning method or a generate-and-test method to compose an imposition for the given press run. Step 112 decides whether the edition to be printed is without any color pages or with color pages only on the front and back pages of a particular section and in that case moves to steps 114 and 116 as adopt a rule-based backward reasoning method composing the imposition for this press run.

As will be explained, the method and apparatus of this invention employs artificial intelligence techniques for dealing with the many complex factors and the inter-relationships thereof to compose a particular imposition. Using such techniques, a set of rules exist to check whether the press run is possible to compose and to determine how each printing unit 12 is to be utilized. This set of rules embodies heuristics and a reasoning process that leads to a substantially optimum imposition without requiring a more complex generate-and-test method. The rule-based method allows incremental knowledge growth through the addition and/or deletion of rules. In particular, step 114 determines which printing units 12 are to be used for each section, and thereafter step 116 determines the page sequence of each section and then the possible positions of the printing plates 13 on each cylinder of a printing unit 12. Next, step 118 displays or prints out a message similar to that shown in FIG. 5, as will detail the placement of the printing plates 13 on the cylinders of the units 12, as well as the disposition and orientation of the sets of angle bars 20.

By contrast, the composing of an imposition for a press run with interior color pages is not straight forward. Where a section has interior color pages as determined in step 112, a generate-and-test method is used in conjunction with the rule-based backward reasoning method. In particular, step 120 generates a possible lineup by assuming the edition does not have any color pages or has color pages only on the front and back pages of the section under consideration. It is noted that step 120 does not generate a series of possible impositions until an acceptable one is found. Step 122 tests the generated imposition as to whether the color pages are assigned to positions corresponding to those of the color printing units 12, e.g. press units **12*d*, 12*a* and 12*c* as illustratively shown in FIG. 1. If not as determined by step 122, step 124 instead of randomly generating another imposition, will initiate an evolution technique to compose a new imposition with selected changes from the present imposition as are designed to provide a printable imposition. The new imposition is again tested in step 122 and, if not acceptable, will continue to loop through 124 and 120 a given number of times or until it is determined that there is no available evolution technique that can modify the present imposition to print the given requirements of this press run. In that case, step 126 will output or display a message informing the pressmen that an imposition cannot be generated for the presently inputted press run and suggesting possible changes to the present press run so that an acceptable lineup can be composed. On the other hand, if step 122 determines that a proposed new imposition is acceptable, the program again moves to step 118 to generate a message, i.e., to print or display a message indicating the relative placement of the printing plates 13 onto the various positions of the cylinders of each of the printing units 12**.

Figure 5:
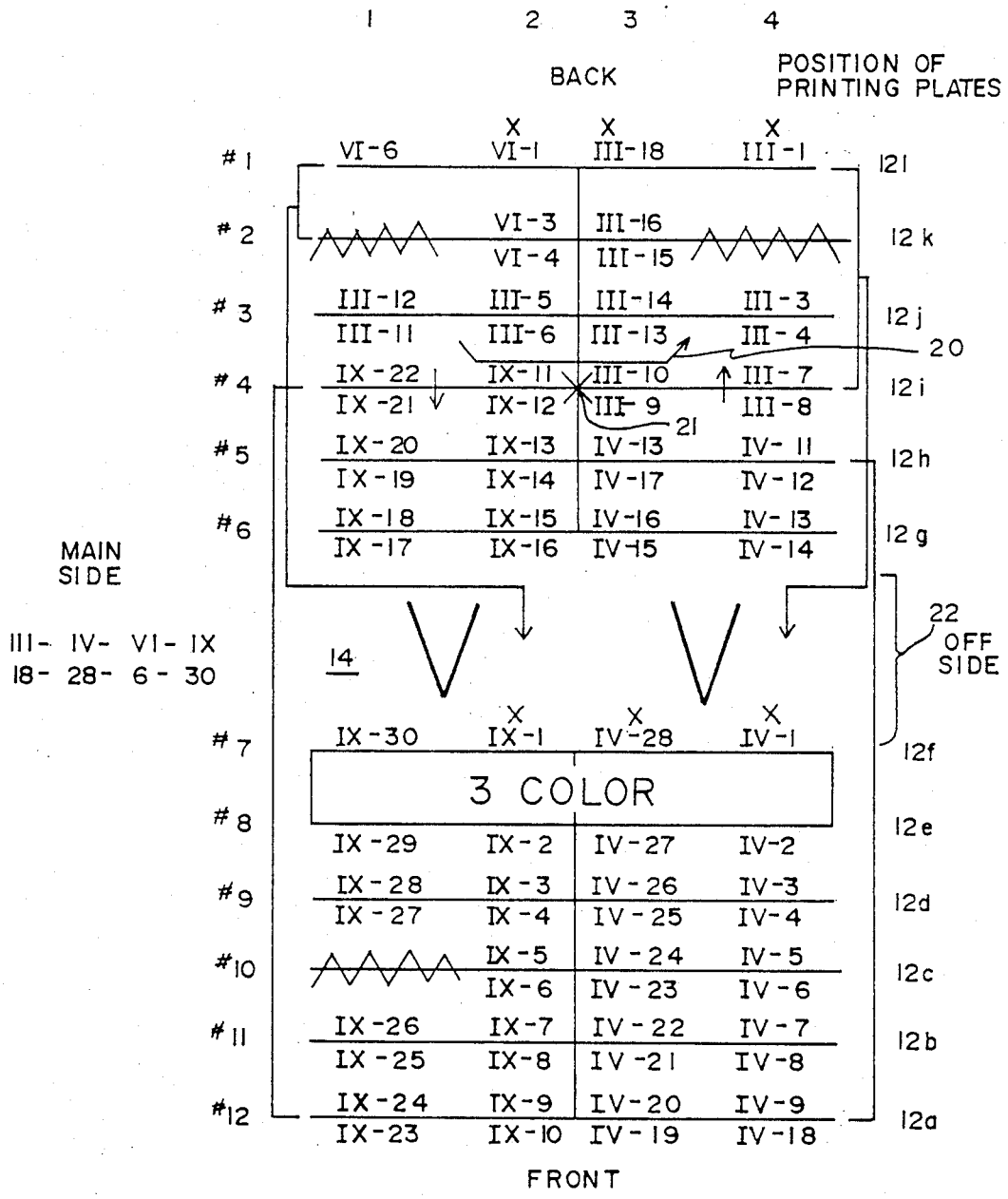
FIG. 5 is a display provided by this invention, of an imposition of the printing plates onto selected image positions of selected printing units of the press shown in FIG. 1.

FIG. 5 illustrates such a message showing how a press run in the illustrative form of a four-section press run, e.g. newspaper, containing several interior color pages. Each horizontal line represents one press unit 12. The Roman numerals indicate the numbers of the sections of the inputted press run, while the Arabic numerals show the page numbers of each section. In the illustrative imposition provided by the message of FIG. 5, a press run including a section III having 18 pages, a section IV having 28 pages, a section VI having 6 pages and a section IX having 30 pages are printed upon a press 10 having 12 printing units 12*a* to 121 and being numbered 12-1, respectively. The ripples show portions of the press units 12 not used. The large "X" on a unit line indicate color page location. Arrows across the center of a unit line show where a set of the angles bars 20 is used. A large "X" in the middle of a line unit indicates that a split lead is used there. The lighter weight lines, with or without arrows, show whether an upper or lower former 14 of the folder assembly 22 is used for the web of a particular printing unit 12.

A further description of the imposition provided by the message of FIG. 5 will be given to clarify the nature of the press 10 and how a press run in the illustrative form of a multi-sectioned newspaper may be printed thereon. Illustratively, the press 10 is divided into a number of areas. For example, the printing units 12*a*–12*f* having corresponding numbers 12-7 are disposed on the front side of the press, i.e. in front of the folding assembly 22 and are known as front units. The printing units 12*g*–12*l* and having corresponding numbers 6-1, are disposed behind the folder assembly 22 and are known as back units. The left hand side of the press 10 as shown in FIG. 5 is known as the main side, i.e. that side of the press 10 as is disposed towards the operator's console, whereas the right hand side is noted as the off side. In a straight mode of operation as illustrated in FIG. 5, each printing unit 12 is a double width press capable of receiving eight pairs of printing plates 13, each pair having identical printing plates 13 as would be capable of printing 8 different page types and a total of 16 pages. As shown in FIG. 5, there are eight different printing plates 13, and the press 10 is operated in it's straight mode. If operating in a collect mode, there would be 16 different printing plates 13.

Figure 2A:
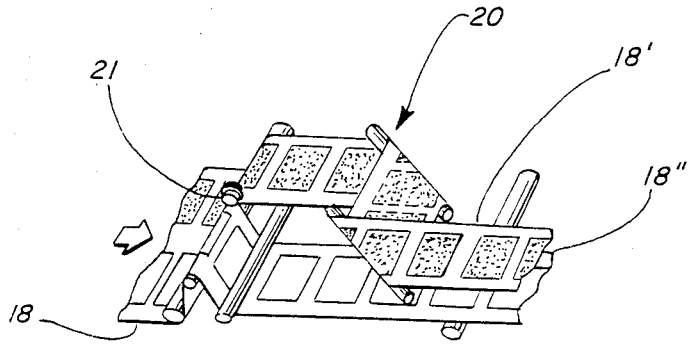
FIGS. 2A and 2B illustrate various parts of the printing press shown in FIG. 1.

As illustratively shown, the twelfth printing unit 12*a* is capable of printing two web portions from a single large web of paper. Each web portion has four images printed thereon and is folded down it's center. For example, one web portion would bear pages 1 and 2 of section VI and pages 5 and 6 of section VI, with these web portions to be folded on each other by the former 14. Further, each of the printing plates 13 is assigned a numbered position along the axis of its printing unit 12 from its main side to its off side, i.e. plate positions 1 to 4. Since the printing plates 13 as disposed at positions 1 and 2 or 3 and 4 may be used to print a web portion, that part of the printing unit 12 may be considered as a half unit, whereas a printing unit 12 with all 4 printing positions assigned is considered as a whole unit. The set of angle bars 20 is used as shown in FIG. 5 to redirect the web portion as printed by the main side of the tenth printing unit 12*c* over to the off side of the printing press 10, whereby the two web portions are directed as shown in FIG. 2A to the folding assembly 22.

Figure 2B:
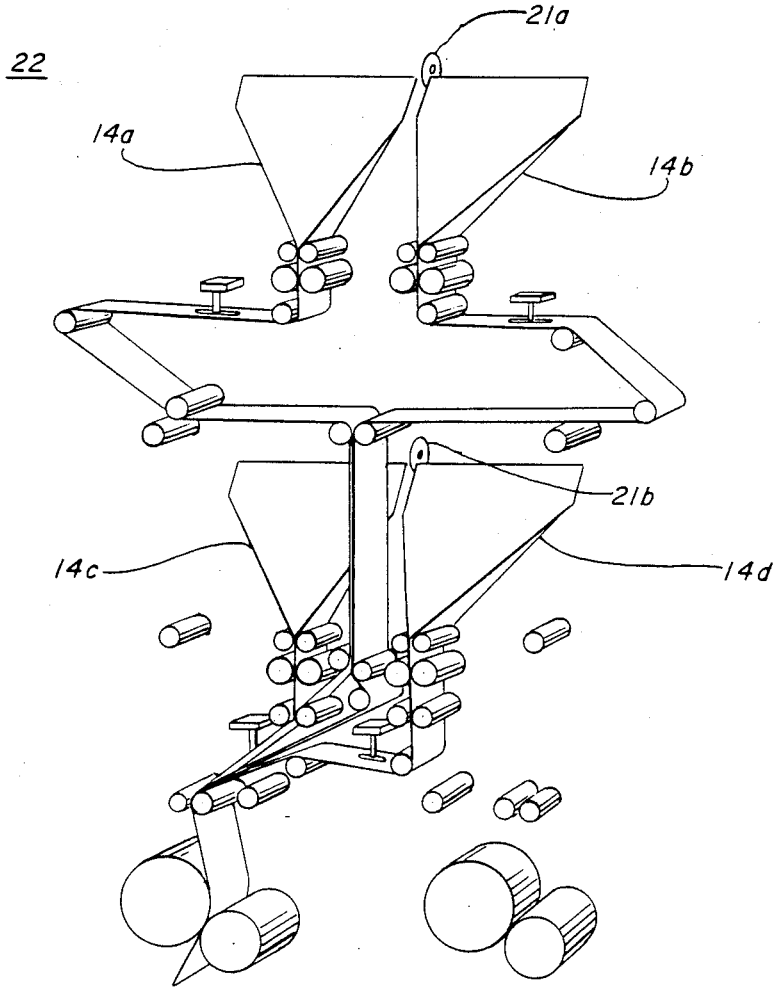

The slitter 21 is used with the ninth press unit 12*d* to achieve a split leads, whereby the web 18 from the 9th unit 12*i* is split with the web half or portion from the main side sent to the upper or "balloon" folder 14*a* and the half or web portion from the off side being sent to a lower folder 14*d*, as shown in FIG. 2B.

As shown in FIG. 5, ripples are associated with the second unit 12*k* to indicate that printing plates 13 are not used at the first and fourth positions of the printing unit 12*k*, and with the tenth printing unit 12*c* to indicate that printing plates 13 are not disposed at the first position of the printing unit 12*c*. As will be described below utilization is an attribute or descriptive term used to characterize the degree of use of each of the printing units 12. For example, the units 12*a*, 12*b*, 12*d*–12*j* and 12*l* are fully utilized and it's attribute utilization may be assigned the value "full"; on the other hand, the printing unit 12*k* is half used and it's attribute utilization may have the value "center", whereas the printing unit 12*c* may be characterized by the value "off ¾ 's". In similar fashion, it can be seen that the printing units 12 may be also characterized by the values "main half" where printing plates 13 are disposed at positions 1 and 2, "off half" with plates 13 at positions 3 and 4 and "main ¾'s" with plates 13 at positions 1, 2 and 3. As will be explained below, the values of the attribute utilization are derived from examining the available printing units 12 and, in turn, these utilization values form the basis for generating the actual lineup.

The press 10 may be operated in a "double delivery" mode, whereby two products of the same edition or press run may be printed upon a single press 10 at the same time. Referring to FIG. 5, printing plates 13 could be disposed at the positions 1 and 2 on the main side of selected printing units 12, whereas identical printing plates 13 could be disposed on the off side positions 3 and 4 of the corresponding printing units 12. Thus, identical products are produced from each of the main and off sides of the press 10 and are directed to the folder assembly 22, which simultaneously forms and folds two distinct products at the same time. Typically, a press 10 is operated in it's "double delivery" mode to print a relatively small press run, i.e. one with one or two sections, on a single press 10, but at twice the normal product production rate.

In an illustrative embodiment of this invention, the method of this invention employs the S.I expert system shell as provided by Teknowledge, as employed in a 1109/INTERLISP-D environment as manufactured by Xerox. The S.1 shell is described in U.S. Pat. No. 4,658,370. In addition to a knowledge base as employed within the S.1 shell, several external functions were written in the LISP programming lanquage to graphically display the generated imposition, as well as to perform other functions not readily implemented in S.1. The S.1 shell is based on EMYCIN, as described in *System Aids in Constructing Consultation Programs*, by van Melle, W., Ann Arbor, Michigan UMI Research Press, 1981, and was designed to aid the development of expert systems. Examples of diagnosis problems or structured selection problems, are described in "Classification Problem Solving," *Proceedings of the National Conference On Artificial Intelligence*, by Clancey, W. J., 1984, pp. 49–55. S.1 provides a knowledge representation scheme, an explicit control scheme, a backward chaining inference engine, an explanation facility, a user interface, and an error handling scheme as described in S.1 Reference Manual, Teknowledge, Inc., Palo Alto, Calif., June 1985.

The S.1 shell provides a means to represent knowledge as will be used to compose the imposition. Knowledge representation in the S.1 shell takes the following principle forms, object-attribute-value triplets, sets of rules, and procedural control blocks as are illustrated in the detailed flow diagrams of FIG. 4 by the heavy lined blocks. In this illustrative embodiment, an input/output user interface is integral with the S.1 shell and permits a means to input, as in a consultation step, data defining the given press run and the press configuration available to print this press run. Declarative knowledge is easily expressed in the object-attribute-value form, while the reasoning process can be controlled explicitly through the control blocks and implicitly through the backward chaining inference engine. The inference engine accepts the inputted requirements as to the press run and manipulates the rules sets via the control blocks. The control blocks are an explicit procedural statement of how the method of composing the imposition is carried out. As shown in the flow diagram of FIGS. 4, the control blocks define the sequence and the action taken by the steps. The control blocks determine what input information is needed and how this information is to be acted upon by the rules, to ask other questions and to define those variable attributes about certain objects. The attributes are the characteristics of the main objects. Some are defined for certain objects during this imposition composing method, while others are fixed.

In other words, a broad problem-solving method can be carried out by the control blocks, while judgmental knowledge is embodied in the rule sets. The composing method is expressed in the control blocks, but is separate from the judgmental knowledge, which is expressed in the form of the sets of rules. A primary advantage in separating declarative from procedural knowledge is that such a knowledge-based system becomes more modular, maintainable and transparent.

In using the expert system as contemplated in an illustrative embodiment of this invention, symbolic object orientation is employed in its programming rather than the numerical/sequential approaches employed in conventional programming. Thus, it is significant to properly select and characterize a plurality of classes of objects as variously relate to the printing press 10 as is available to print a given edition or press run, to the press run itself and to the imposition to be composed. In an illustrative embodiment of this invention, 17 different classes of objects are defined. For the purpose of understanding the flow diagrams of FIGS. 4, the 17 classes are partitioned into the following groups: press, press, press run, product and imposition. A class type may be defined when two or more classes have common attributes. There are two class types, PRESS and LOCATION. For example, PRESS contains: BACK.UNIT, FRONT.UNIT, PREVIOUS.BACK.UNIT, and PREVIOUS.FRONT UNIT, while the class type LOCATION comprises: NEAR.LOCATION, NEAR.-CENTER.LOCATION, FAR.CENTER.LOCATION, and FAR.LOCATION. PRESS.RUN relates to a particular press run. The classes, SECTION, SECTION.PART, and BUFFER.SECTION, relate to details of parts of a press run. Complete definitions of the classes and their attributes will be given below as the detailed flow diagram of FIGS. 4 is explained.

Classes are used to represent symbolically objects. Then the control block creates an instance of a class to represent and to characterize the objects of that class. A top level control block defines the procedures and steps to define values of the variable attributes of a created instance as by carrying out a consultation, whereby data will be entered to provide the values of these attributes, e.g., the attributes defining the press run and the printing press 10. The control blocks will continue to operate on these objects to further define values, as the objects are compared with the sets of rules; the instances of a class as well as the values of the attributes of the instances are stored in a working memory of the S.1.

The control blocks of the method of this invention are described in detail in FIGS. 4. These control blocks specify when to create class instances, when and how to determine the values of the variable attributes of the objects of each class instance, when to display the results, and when to call other control blocks. The process of composing an imposition begins when the consultation begins, whereby the inputs of the requested information with regard to the printing press 10 and the given press run to be printed are provided. The consultation, as will become evident from the further description, involves asking the pressmen questions and for entry of data as will define some of the values of the object attributes of a class instance.

Figure 4A:
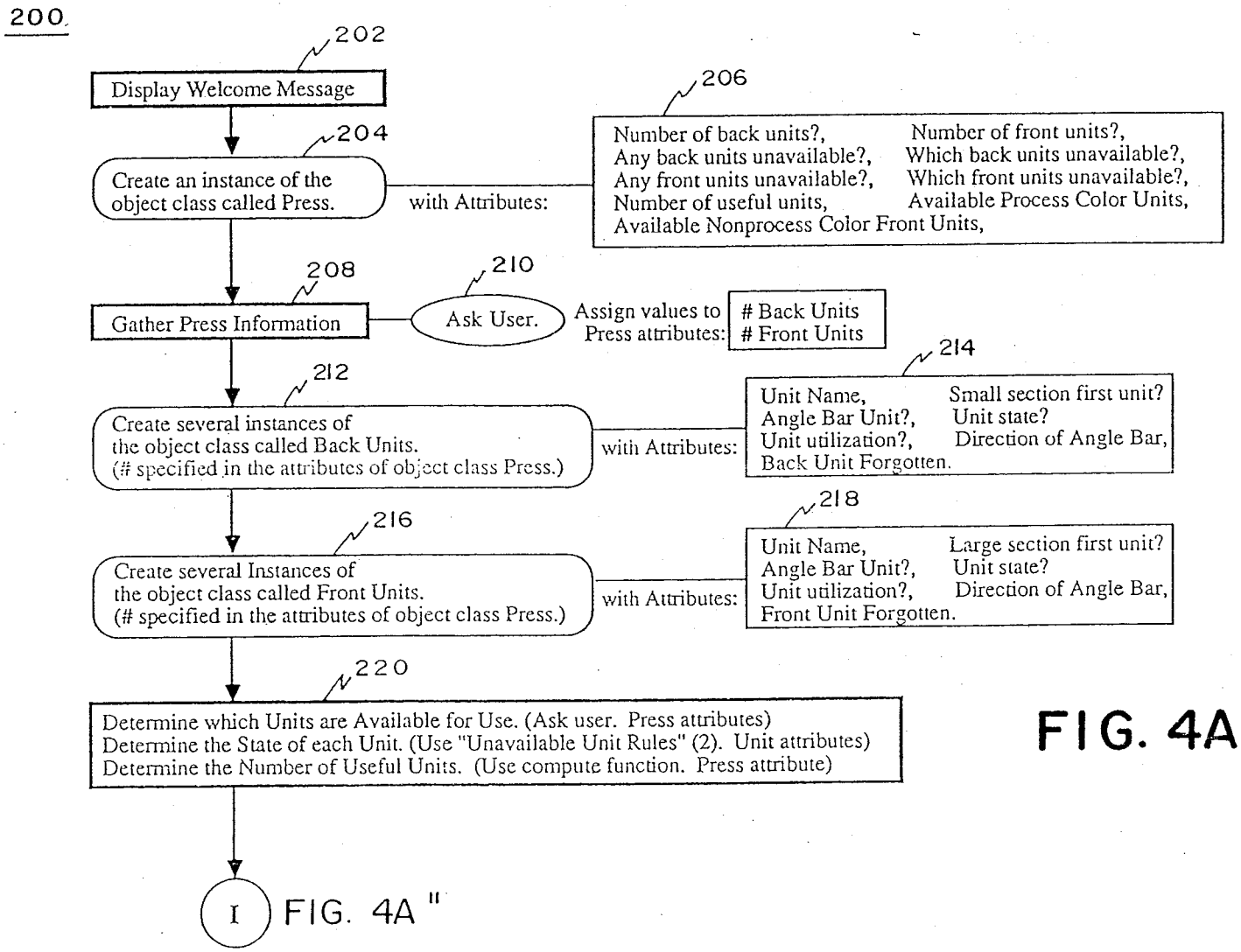
FIGS. 4A' and A" to 4R', 4R" and 4R'" illustrate a detailed flow diagram as implemented in an expert system shell to carry out the method of composing an imposition as generally shown in FIG. 3, it being understood that in the following a general reference to FIG. 4R, for example, may refer to any one of the FIGS. 4R', 4R" or 4R'"

As a consultation starts, the composing method of this invention moves to that top level control block named PRESS.LINEUP 200 as shown in FIG. 4A. The control block PRESS.LINEUP 200 contains fundamental procedures for the entire method. PRESS.-LINEUP 200 starts with the control block 202', which displays a welcome message upon the user interface and provides initial instructions to the pressmen. Step 204 creates an instance of the class PRESS defining its attributes The class PRESS relates to the characteristics of the printing press 10, as shown in FIG. 1. Observation of the expert system flow elements as shown in FIGS. 4 indicates a notation where heavy lined rectangles are used to designate controls blocks, items with rounded corners and formed of light lines designate an action taken and a rectangular shaped box of light line specify particular attributes or some action taken with regard to the attributes. The attributes of the instance of the object class PRESS is set out in block 206 and define the characteristics of the printing press 10, as shown illustratively in FIG. 1. The attributes of block 206 basically define the number of printing units 12 in front of and in back of the folder assembly 22, whether these units 12 are available to be used in the printing of this press run and whether these units 12 are available for non-process color, i.e. a single color, or for process color, i.e. the printing of three colors. Next, the PRESS.LINEUP 200 calls control block 208 to invoke the consultation step 210, as indicated by the oval shaped block, to query the user as to the number of front and back units 12. Typically, the user interface is used to enter values in the form of numbers as will now be stored in the working memory. Next, step 212 creates a plurality of the instances of the object class BACK.UNIT, each instance to define the attributes of the back units 12. As listed in block 214, these attributes describe the back printing units 12. For example, the attribute unit.name is assigned a unique numerical value identifying it. The attribute small.section.first is assigned the value, true or false, indicating whether or not the first page of a small section of the press run will be printed at this particular printing unit 12. angle.bar.unit is assigned a value, true or false, indicating whether or not this unit is assigned a set of angle bars 20 and direction.of.angle.bar is assigned a value indicating that the set of angle bars 20 directs its web 18 to the left or right, and unit.state is assigned a value, true or false, indicating whether this particular printing unit 12 is available or not. The attribute utilization describes how much of each press unit 12 is used in terms of whether it uses a full paper roll, ¾ roll or half roll; its value can be "unused", "full", "center", "main.half", "off.half", "main.three.quarters", "off.three.quarters", "full.for.3.color", "main.three.-quarters.for.3.color", "off.three.quarters.for.3, "mainside.up.offside.down", or "offside.up.mainside down". The attribute back.unit.forgotten refers to an attribute for a printing unit 12 as taken in a previous imposition, whose value has already been determined. This type of boolean attribute is marked as forgotten before new instances of the same object class are created. Next, step 216 creates a plurality of instances of the object class FRONT.UNIT for each of the front press units 12, the numbers of which were entered in step 210. Next, a control block FIND.AVAILABILITY 220 assigns the values entered in step 210 to the attributes units.available and invokes the rules set [unavailable.unit.rules(2)] to act on the unit attributes to determine which of the front or back printing units 12 are available for the next press run, i.e. whether each unit 12 is available or not, and performs the compute function PRESS.ATTRIBUTE to determine the available number of units 12 within the printing press 10.

An Appendix in the form of a computer listing entitled, "MSL PRESS LINEUP", is enclosed herewith and is incorporated herein by reference. This listing corresponds to the flow diagram of FIGS. 4 and sets out in order a detailed description of each of the control blocks, the object classes, the attributes, the rules, and the functions, as noted above. Each of the control blocks, object classes, attributes, rules and functions are grouped together and are listed in alphabetical order within its section of the computer listing. Where the same name is given to a rule set, each distinct rule will be assigned its own number.

Next, step 222 creates an instance of the object class PRESS.RUN, whose attributes are set out in step 224. The object class PRESS.RUN defines the configuration of the press run or edition, e.g. a newspaper, in terms of the number of its sections, the number of pages in each section, the number of color pages in each section, the actual colors used and which pages are color. As evident from the listed attributes in step 224, the object class PRESS.RUN provides a set of characteristics describing in detail the edition, e.g. the newspaper to be printed, as well as the various characteristics of the printing press 10 as would relate to particular parts or sections of the edition. For example, the value of the attribute number.of.sections has a value in terms of a number, and run.type refers to whether the printing press 10 is run in its collect or straight mode. The attributes, maximum.pages, second.maximum.pages, and third.maximum.pages. identify those sections with the largest, next to largest and third to largest number of pages and are assigned values in the form of a number identifying a particular section. In similar fashion, attributes are provided to identify the smallest and largest sections, identify those sections requiring the use of the half units 12 and those that would require a full unit 12. Attributes are provided to identify those large and small sections of the press run that would require the use of a set of angle bars 20, as well as the direction in which the set of angle bars 20 is oriented. The attribute product.has.tabloid identifies as true or false whether this press run has a tabloid section. Further, attributes identify the number of full printing units 12 that are necessary for each of the large, mid-size and small sections of the press run. The attribute double.delivery indicates true or false of whether the printing press 10 is operating in its double.delivery mode. Finally, attributes, printability.based.on.pages and printability.on.units.required are assigned values of true or false indicating whether this press run can be printed with the existing printing press 10 based upon the number of printing units 12 and pages of the given press run.

Next, the control block 226 queries the user in a consultation 228 prompting the pressmen to enter values with regard to the attributes, run.type and number.of.sections. Next, step 230 tests for whether this press run has one or two section and, if yes, block 232 inquires in consultation 234 for the pressmen to assign a value true or false to the attribute double.delivery. Finally, step 236 goes to the control block CREATE.SECTIONS 240.

Figure 4B:
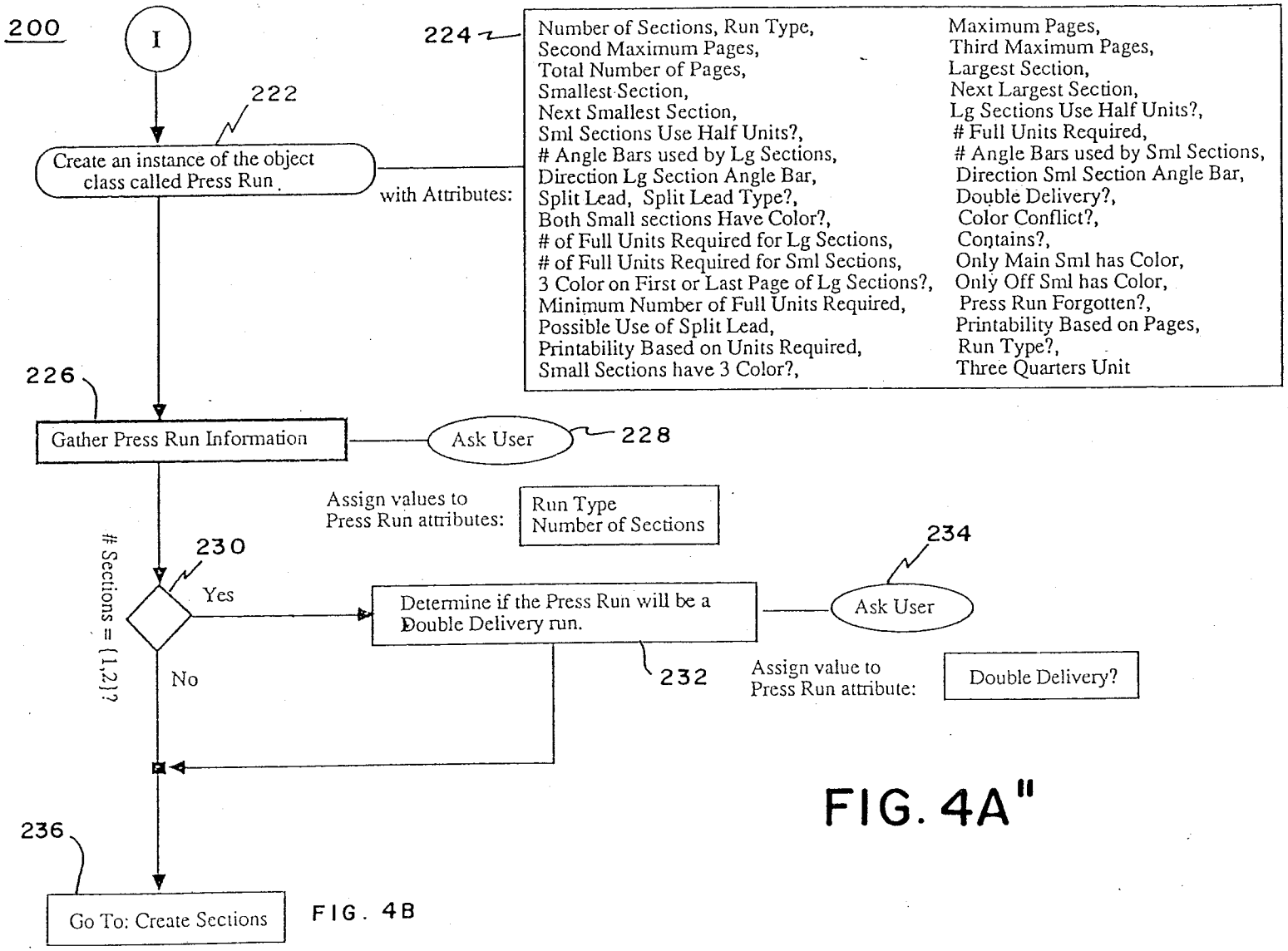
Figure 4B:
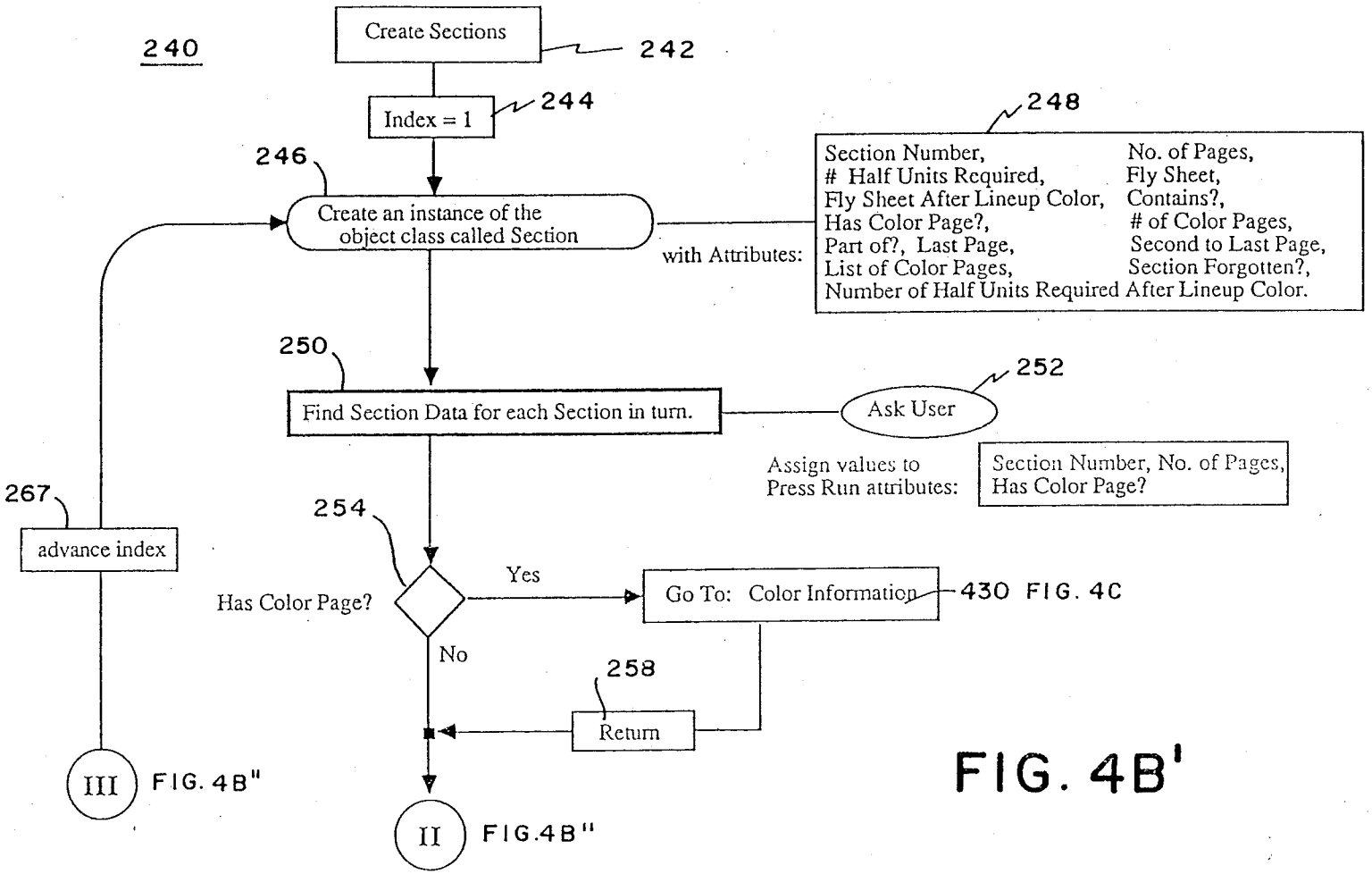
Figure 4B:
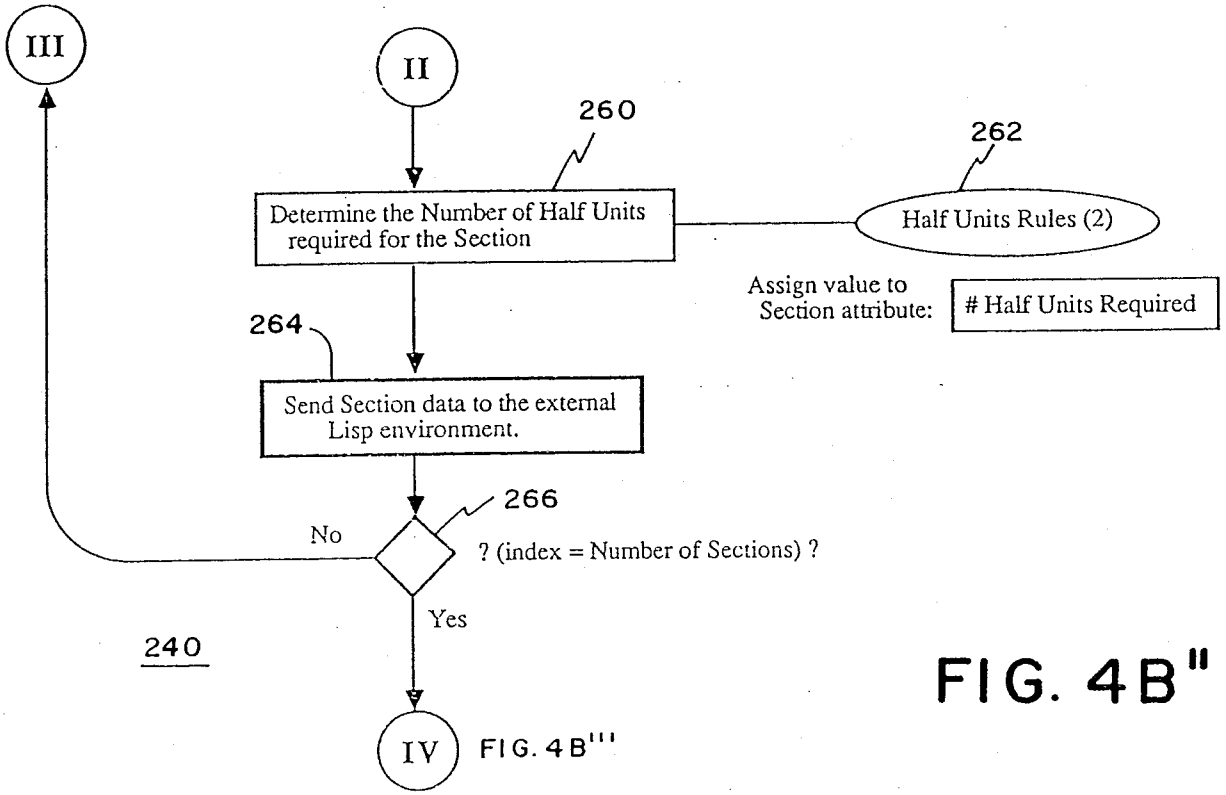
Figure 4B:
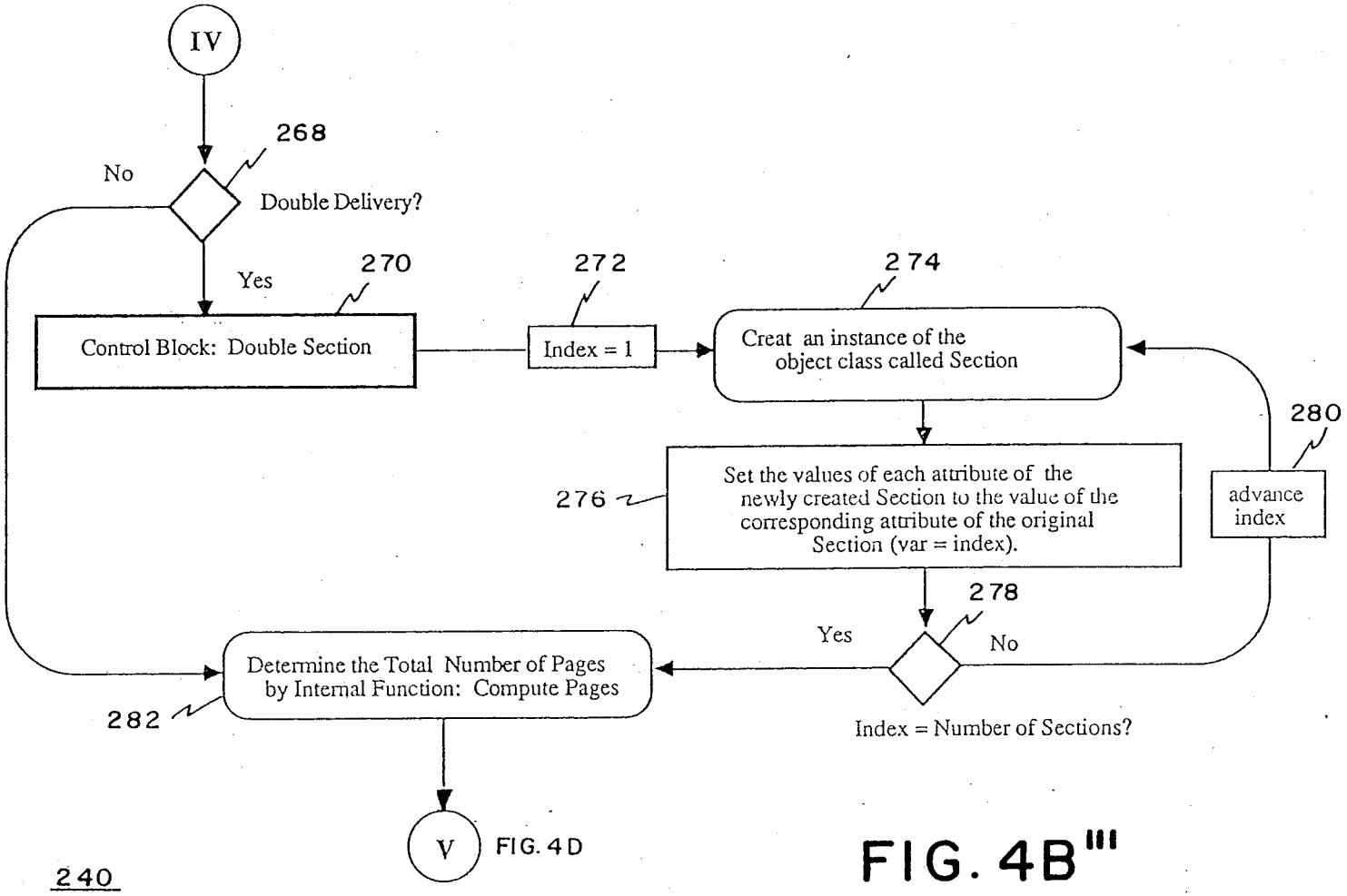

The control block CREATE.SECTIONS 240 is shown in FIG. 4B and serves to create an instance of the object class SECTION for each section of this press run. Initially, an index is set by step 244 to 1, and step 246 creates an instance of the object class SECTION for the first section of the press run to define in block 248 the SECTION attributes. Each section of the press run is characterized by its attributes, number.of.pages.per.section having a numerical value corresponding to the number of pages in that section, has.color.pages having a true or false value to identify if there are any color pages in this section; section.input.order indicates the order in which data is entered in a consultation and thereby determines the placement of the sections, i.e. the first entered section of the small or large sections is disposed to off side, the next entered section to the main side; section.number having a numerical value particularly identifying this section; section.type identifies the type of section; and section.location identifies which of the four press areas (front main side, back main side, front off side or back off side) that a unit 12 is assigned. Next, control block 250 queries the pressmen in a consultation 252 to assign values to the attributes, number.of.pages for the number of pages in the section, section.number indicating the section's number and has.color.page? to specify whether this section has a color page. Next, step 254 queries based upon the information input in consultation 252, whether this section has a color page and, if not, the control block 240 proceeds with step 260.

Figures 4B, 4C:
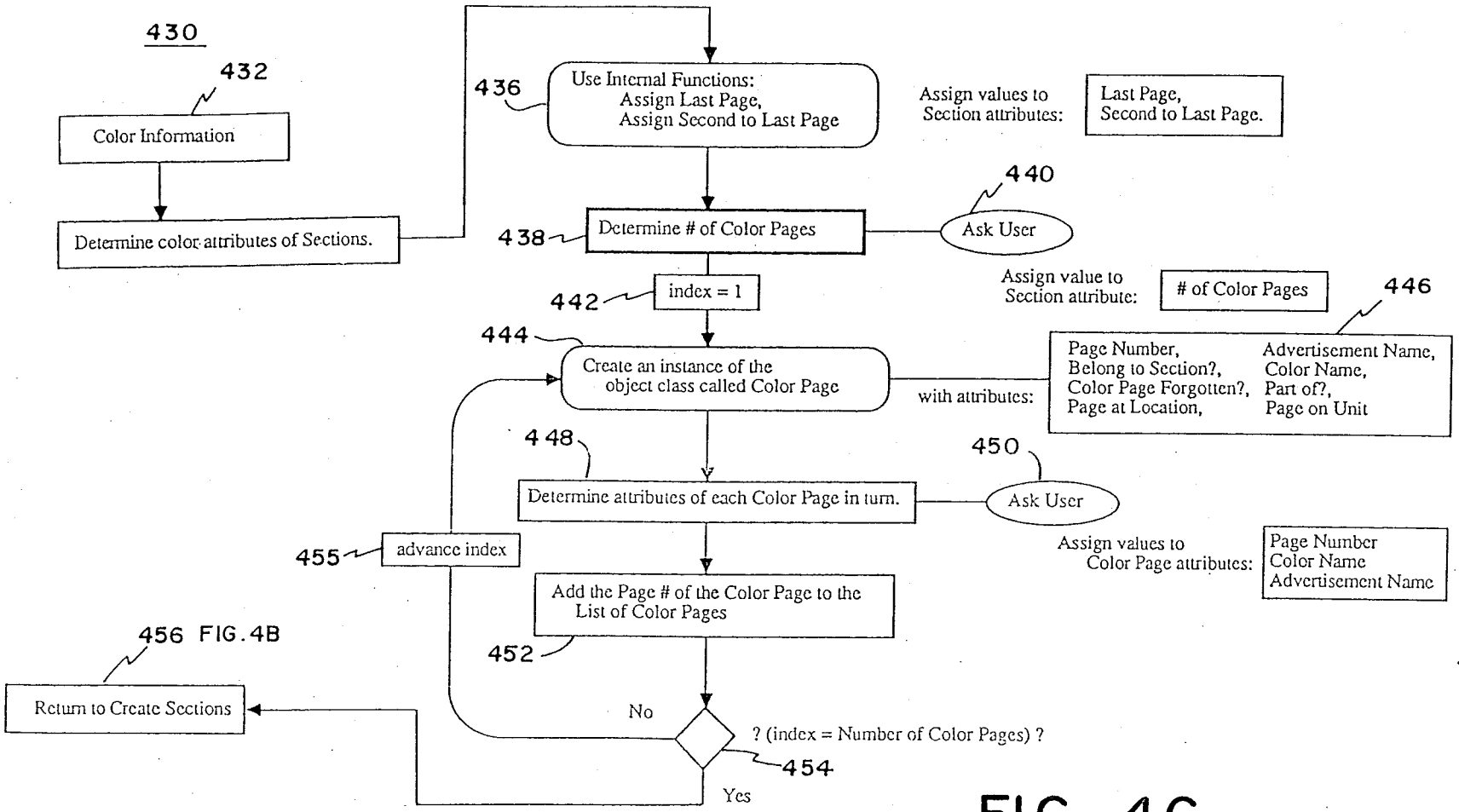

If this particular section has a color page as determined in step 254, the program invokes the control block COLOR.INFORMATION 430, as shown in FIG. 4C. The control block 430 makes a list of the pages within a section that are easy to color and assigns those easy pages, i.e. the third to last and next to last page of a section, with numbers. To that end, step 434 creates the color SECTION attributes, and step 436 effects internal functions to assign numerical values to the attribute last.page indicative of the last page number in the section and to the attribute second.to.last.page indicative of the third to last page number in the section. Then control block 438 prompts the pressmen in a consultation 440 to assign a value to the attribute number.of.color.pages according to the number of color pages in this section. Then, step 442 sets an index to 1, before step 444 creates an instance of the object class COLOR.PAGE, which identifies certain attributes of each color page, i.e., the page number, the section to which it belongs, the color it bears, etc. Then, step 448 prompts the user in consultation 450 to enter the numerical value indicative of the number of the color pages to the attribute page.number, a numerical value indicative of the color to the attribute color.name and a numerical value identifying the name of the advertiser to the attribute advertisement.name. Next, step 452 adds the number of this page to a file (as stored in the working memory) to form a list of color pages in this particular section. Finally, step 454 queries whether this index equals the number of color pages in the section under consideration and, if not, step 455 increments by 1 the index and returns to step 444. Steps 444, 448, 452, 454 and 455 are repeated until an instance of the object class COLOR.PAGE for each of the color pages in this section has been created.

Thereafter, control returns to the control block CREATE.SECTIONS, as shown in FIG. 4B. Control returns through step 258 to step 260, which determines the number of half-units required for this section by calling the rules set [half.units.rules] in step 262, whereby a numerical value is assigned to the attribute number.half.units.required indicative of the number of half printing units 12 that are required to print this particular section. These rules determine the number of pages in each section and divides that number by four to obtain a whole number and a fraction. The number of half units 12 required equals that number plus an additional unit for any fraction. Next, control block 264 transmits the data indicative of this section to the Lisp program so that it may be operated upon externally of the S.1 shell. Next, step 266 determines whether the current index is equal to the number of sections in this press run and, if less, step 267 increments the index before returning to step 246, whereby a further instance of the object class SECTION for the next section of the press run may be created. The control block 240 will loop through steps 246, 250, 254, 260, 264, 266 and 267 until an instance is created for each of the sections.

Thereafter, the program moves to step 268, which determines whether this section requires a double delivery. If the press 10 is operating in its double delivery mode as described above, each of the printing presses 12 bear duplicate sets of identical plates on its main and off sides for providing two identical products of this press run. If so, the control block 270 will proceed to set up two sets of identical instances of the object class SECTION. Initially, the step 272 sets the index to 1 before step 274 creates an instance of the object class SECTION, with a corresponding set of attributes as shown in block 248. Thereafter, step 276 sets the values of these attributes according to those of the corresponding, identical section of the same printing unit 12. Then step 278 determines whether the index equals the number of sections to be printed and, if not, step 280 increments by one the index before returning to step 274. In this fashion, the program control block 240 loops through steps 274, 276, 278 and 280 until a second set of instances for the object class SECTION is created identical to the first set thereof.

When the second set of instances has been created as determined by step 278, the control block moves to step 282, which determines through an internal function the total number of pages in each section. Thereafter, control block 284 determines in step 286 preliminarily whether this particular printing press 10 is capable of printing this particular press run in accordance with the rules set [printable.rules(2)]. There are various Printable Rules as are particularly adapted to test various types of press runs. The Printable Rules basically compare the size of the particular press run under scrutiny to the capacity of the given printing press 10 and, if the printing press 10 is of insufficient capacity, there is given an indication that this print run cannot be printed. For example, the [printable.rules(2)] examines the previously determined value of the total number of pages for this particular run and compares that with the known capacity of all of the available printing units 12, i.e. the number of full units 12 available. In a particular example, rule printable.001 states that IF the total number of pages of the product is less than or equal to the maximum number of pages which could be printed by using all of the available printing units 12, THEN the product is printable based upon the total number of pages. The [printable.rules(2)] assigns a value indicative of true or false to the attribute printability, as indicates whether this press run can be printed or not. Step 288 tests the attribute printability and, if false, causes a message to be displayed upon the user interface that "the maximum page requirement is exceeded" and thereafter aborts this consultation.

Figure 4D:
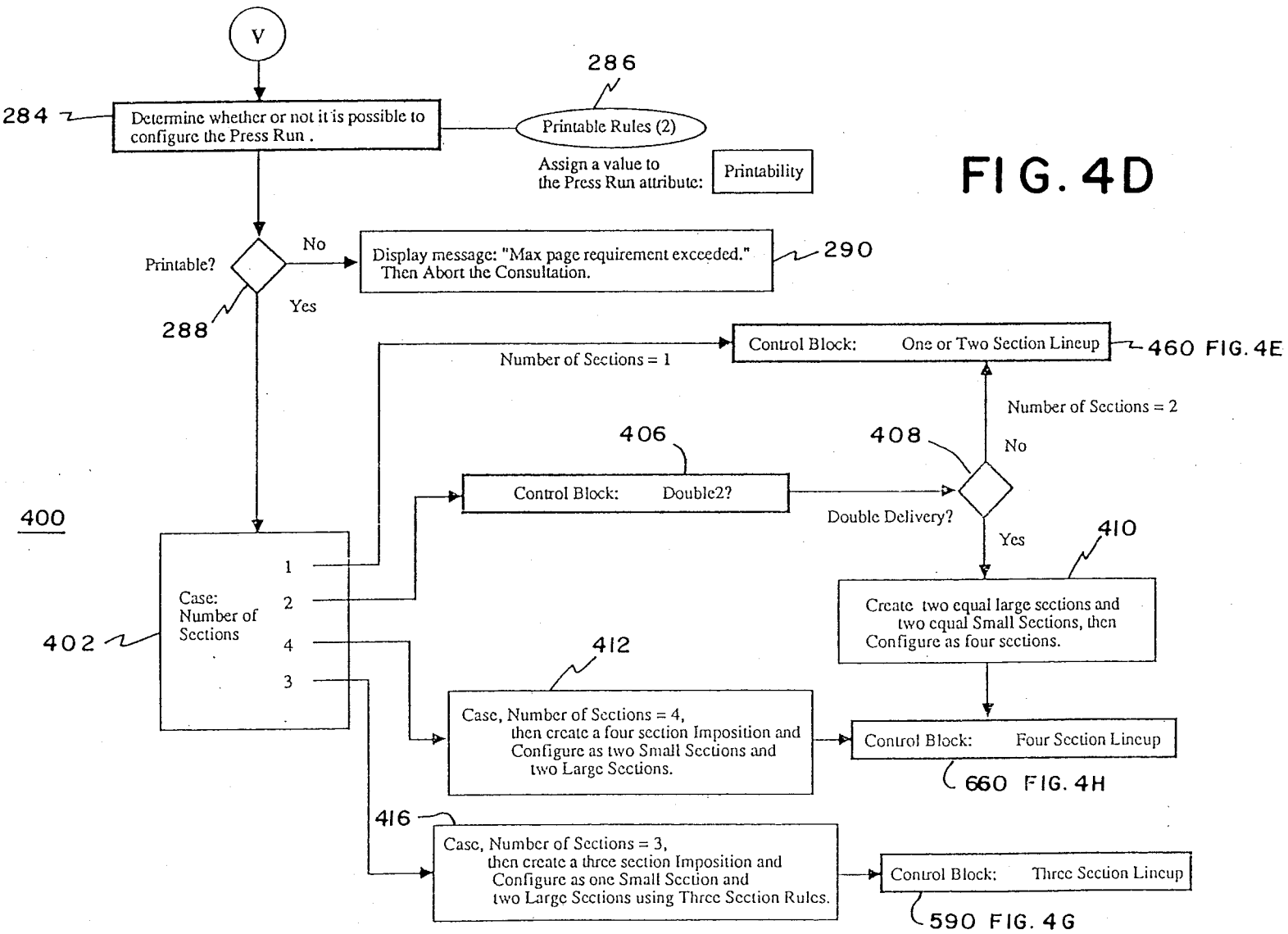

If printable, the control block 240 proceeds to the control block NUMBER.OF.SECTIONS 400, as shown in FIG. 4D. Based upon the number sections in this press run as defined by the assigned value of the PRESS.RUN attribute number.of.section, the control block NUMBER.OF.SECTIONS 402 selects a corresponding control block to determine the lineup of this press run. Control block ONE.OR.TWO.SECTION.LINEUP 460 is selected if the number of sections equals to one, and control block DOUBLE 406 is selected if there are two sections. If there are four sections as determined by control block 402, step 412 creates a four section imposition and configures two as small sections and the remaining two as large sections, before invoking the control block FOUR.SECTION.LINEUP 660. If there are three sections, the program moves to step 416, which creates a three section imposition and configures one as a small section and the remaining two as large sections using the rules set [three.section.rules], before going to the control block THREE.SECTION.LINEUP 590. If there are two sections, the control block 406 effects a determination of whether the printing press 10 is to be operated in its double delivery mode and, if true, step 410 creates this press run with four sections, two being equal large sections and two being equal small sections, before moving to the control block FOUR.SECTION.LINEUP 660. If the printing press 10 is not operating in a double delivery mode as decided in step 408, the program moves to the control block ONE.OR.TWO.SECTION.LINEUP 460.

Figure 4E:
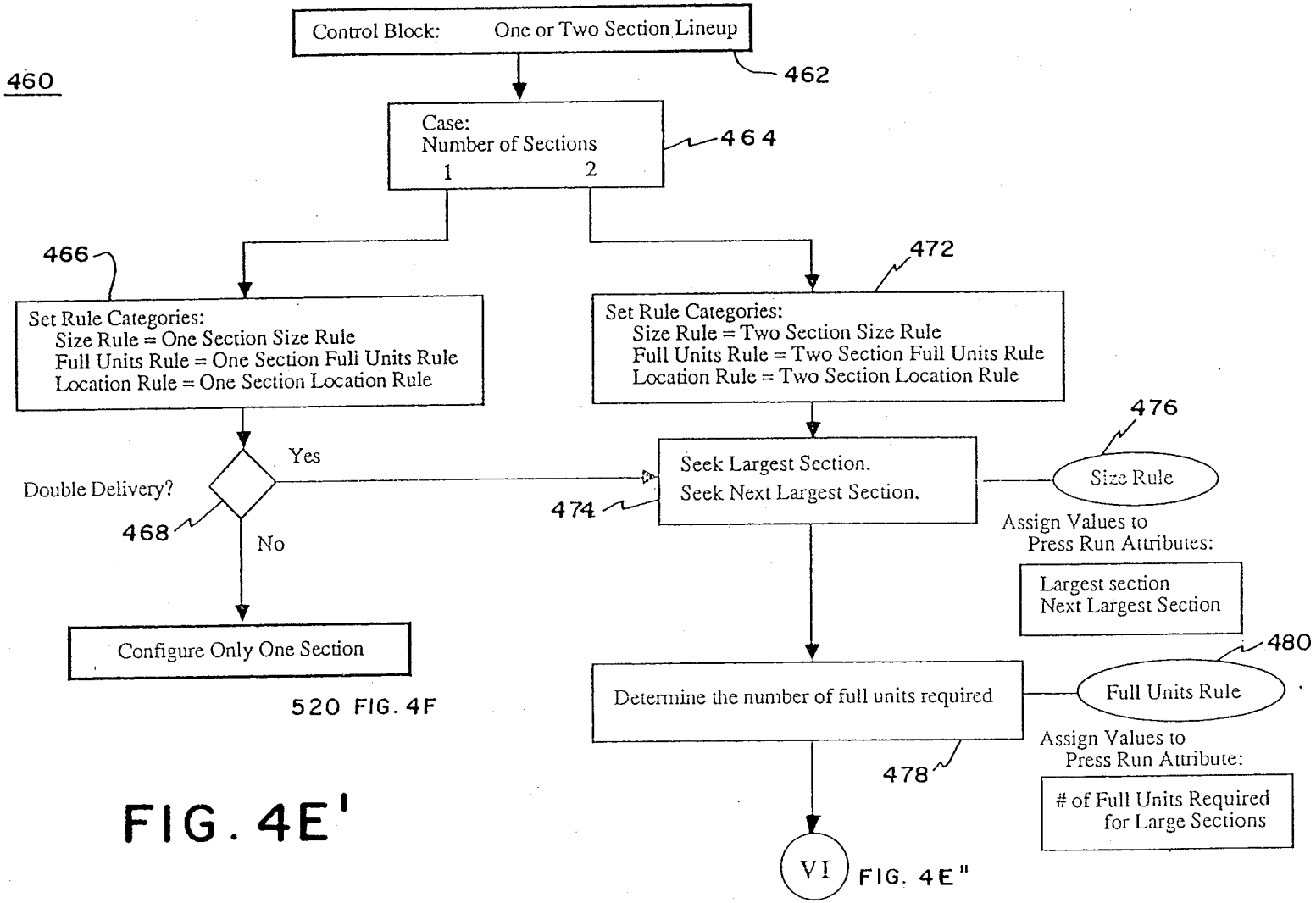
Figure 4E:
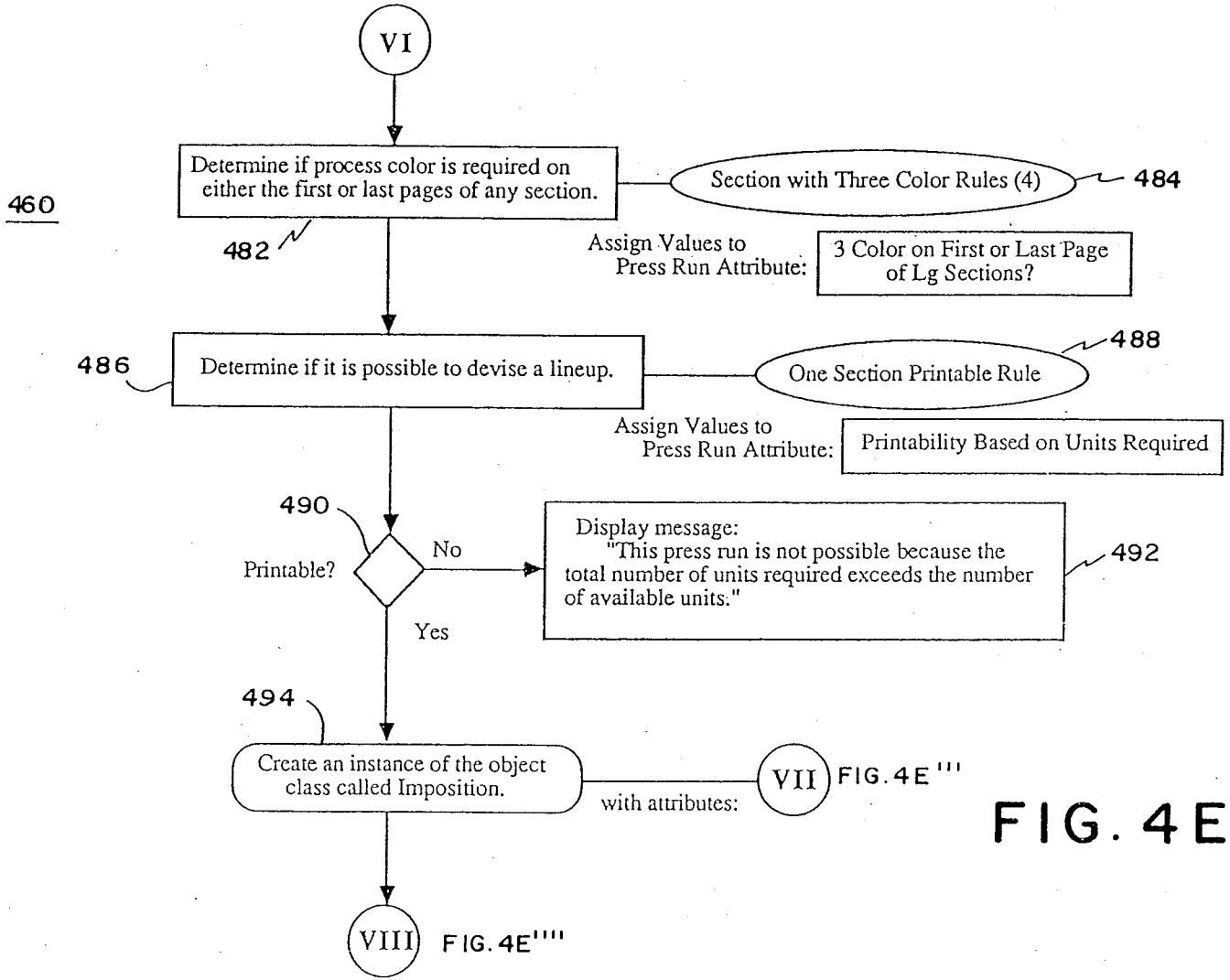
Figure 4E:
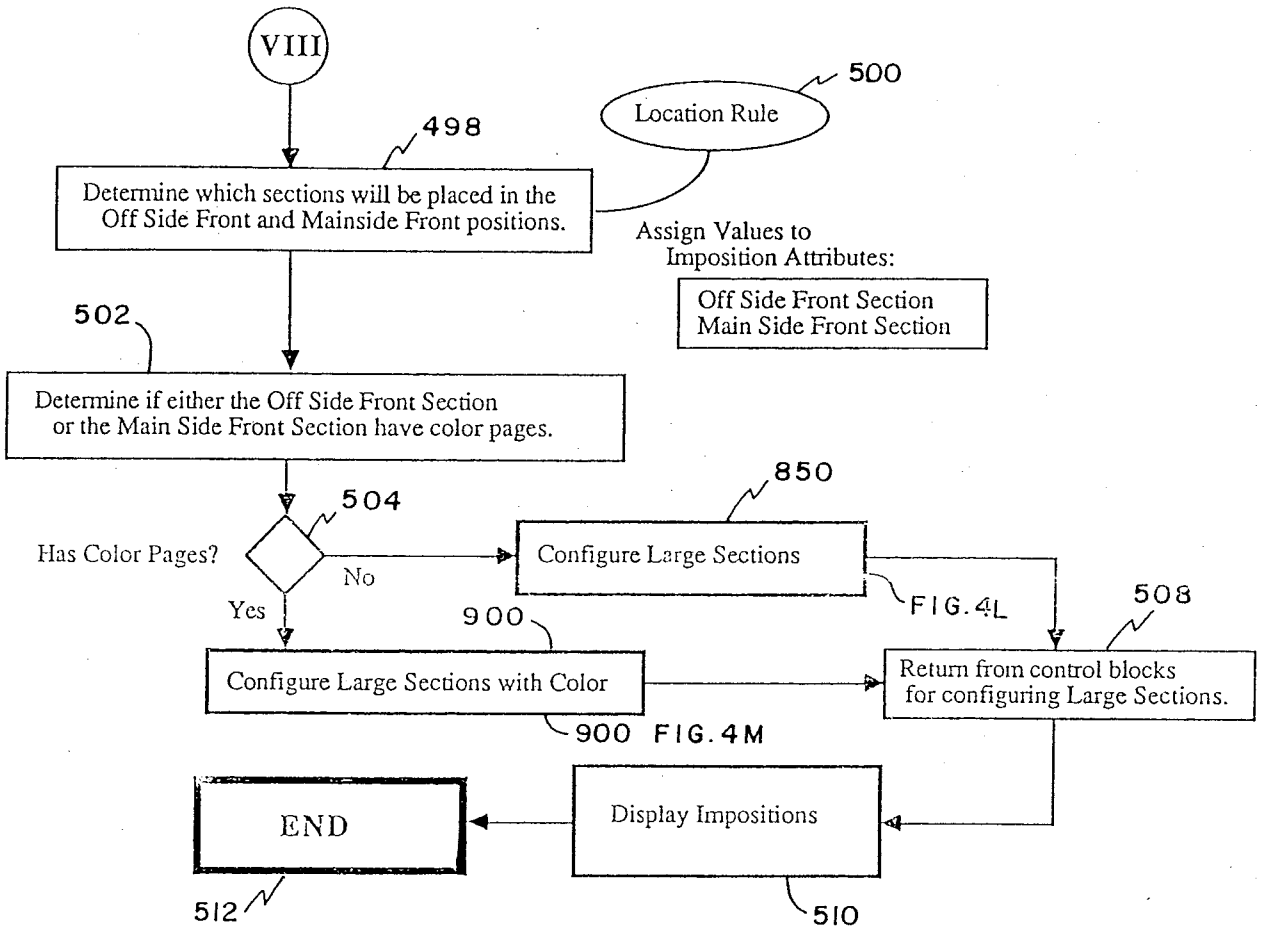
Figure 4F:
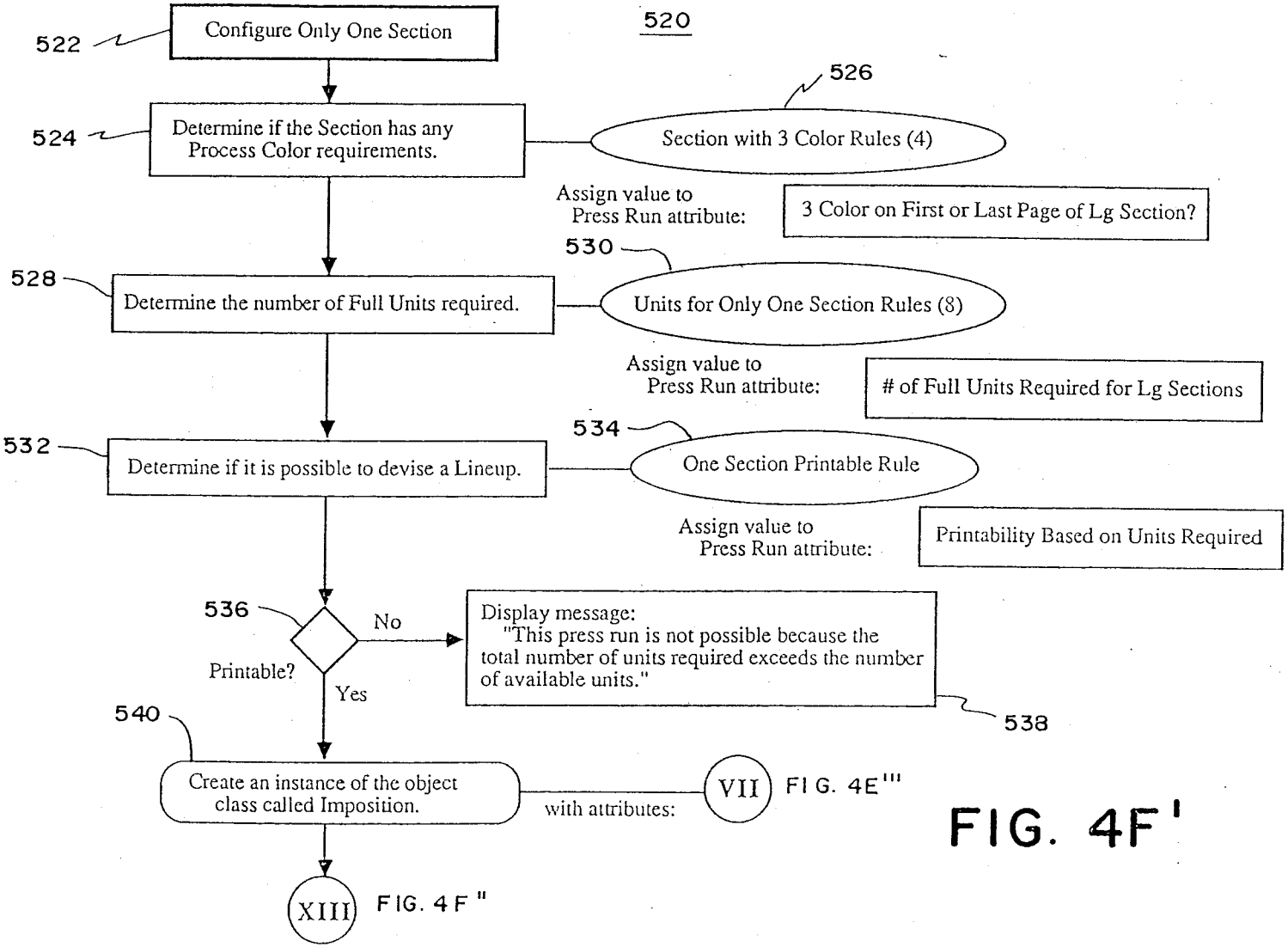
Figure 4F:
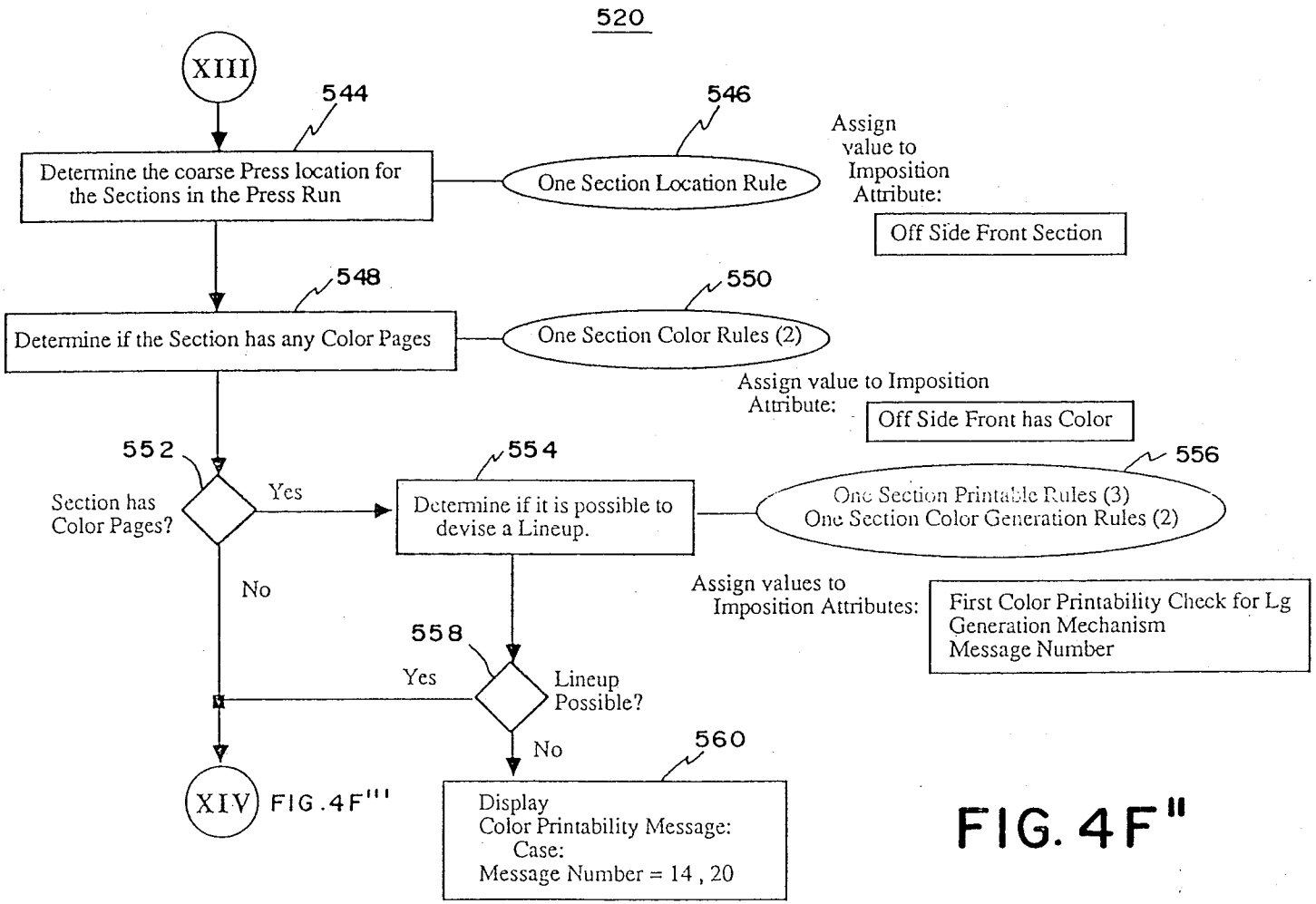
Figure 4F:
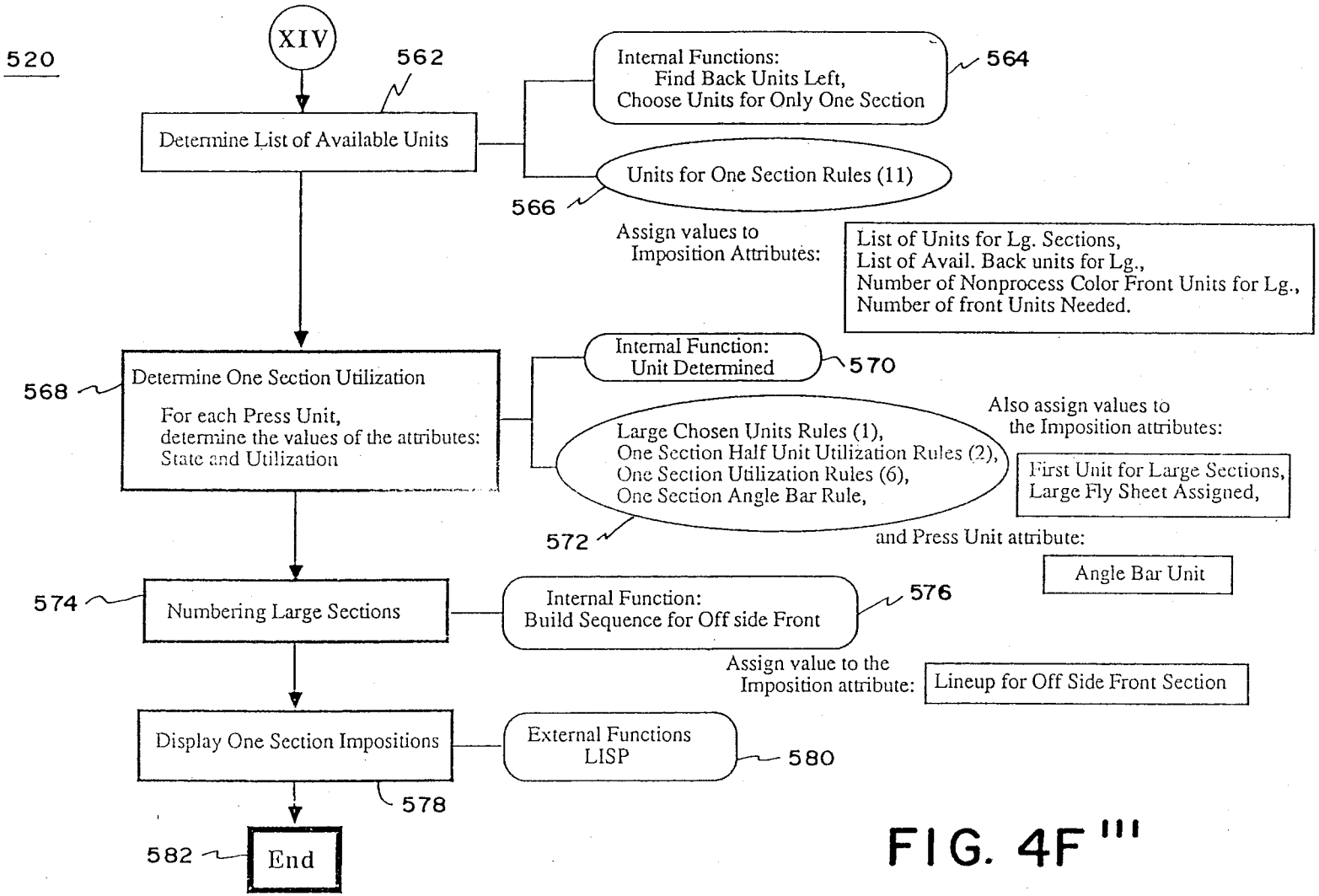
Figure 4G:
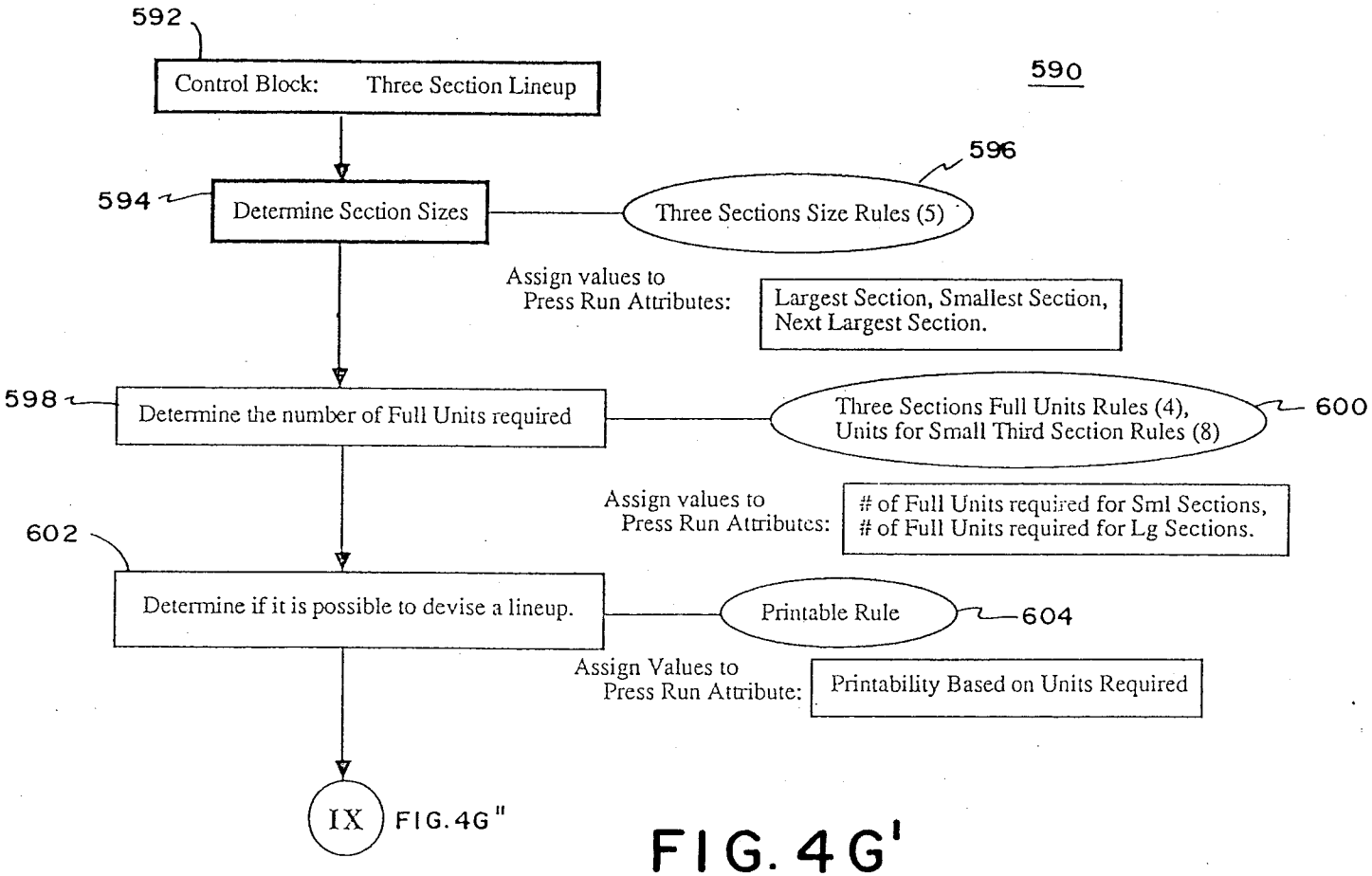
Figure 4G:
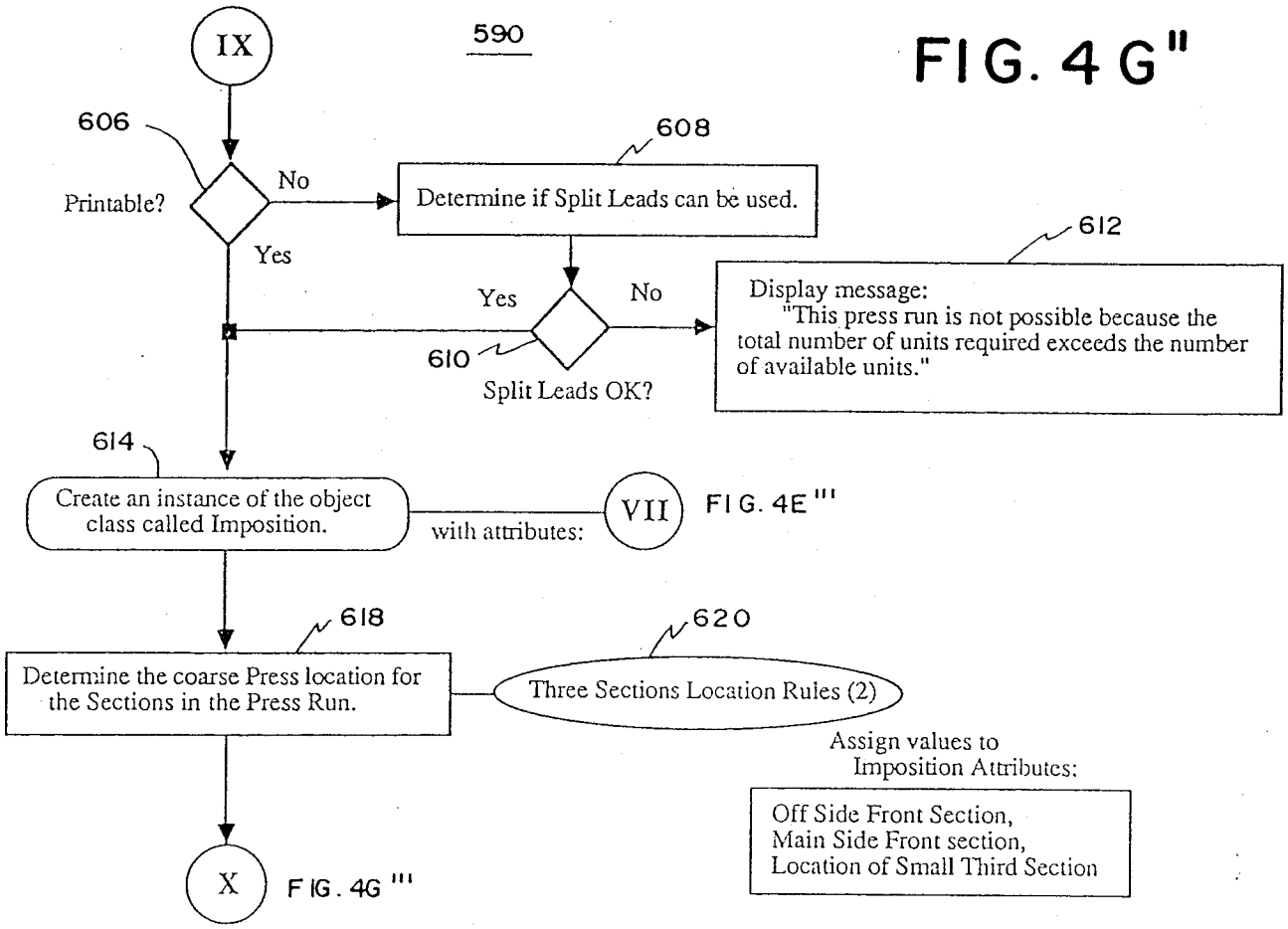
Figure 4G:
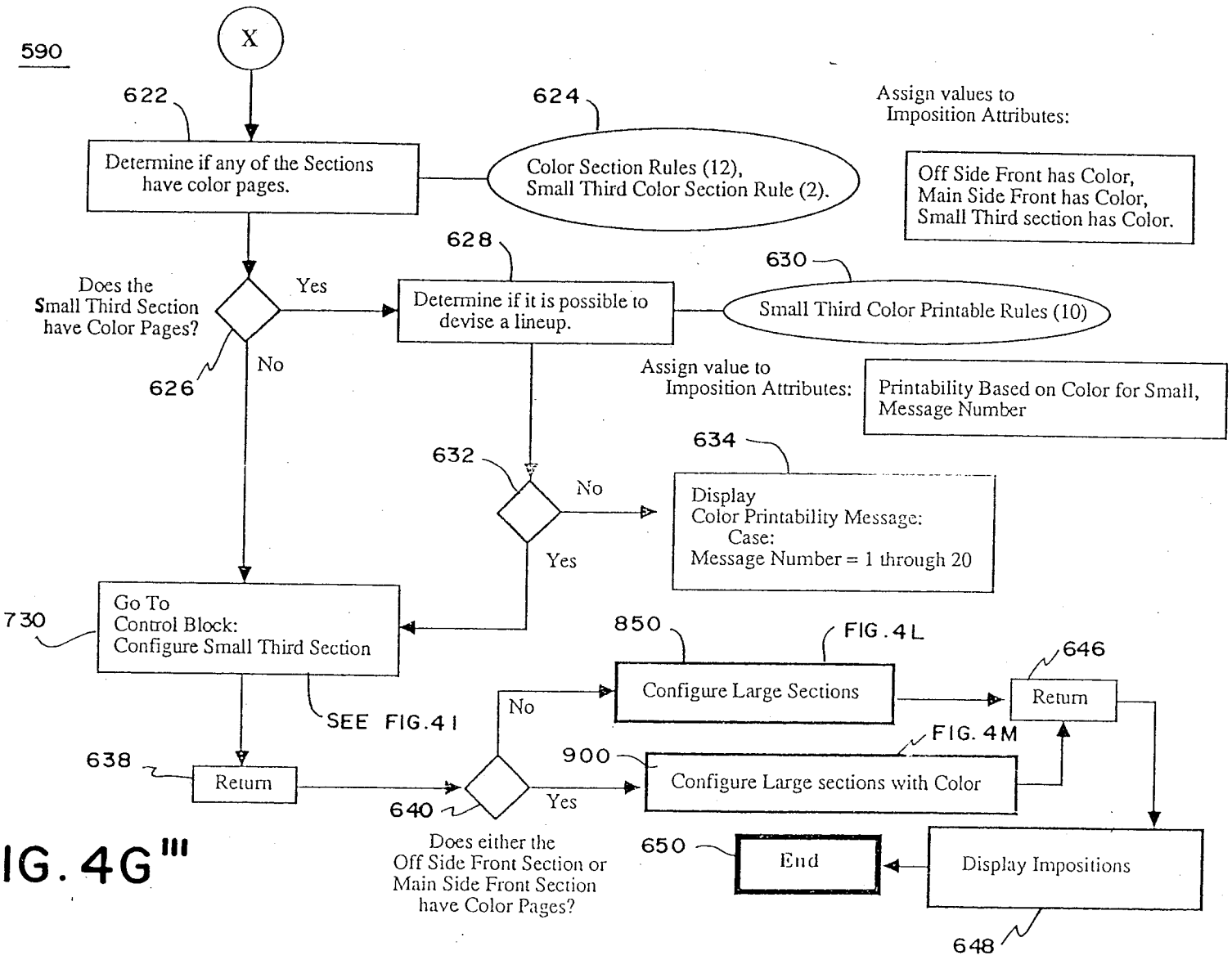
Figure 4H:
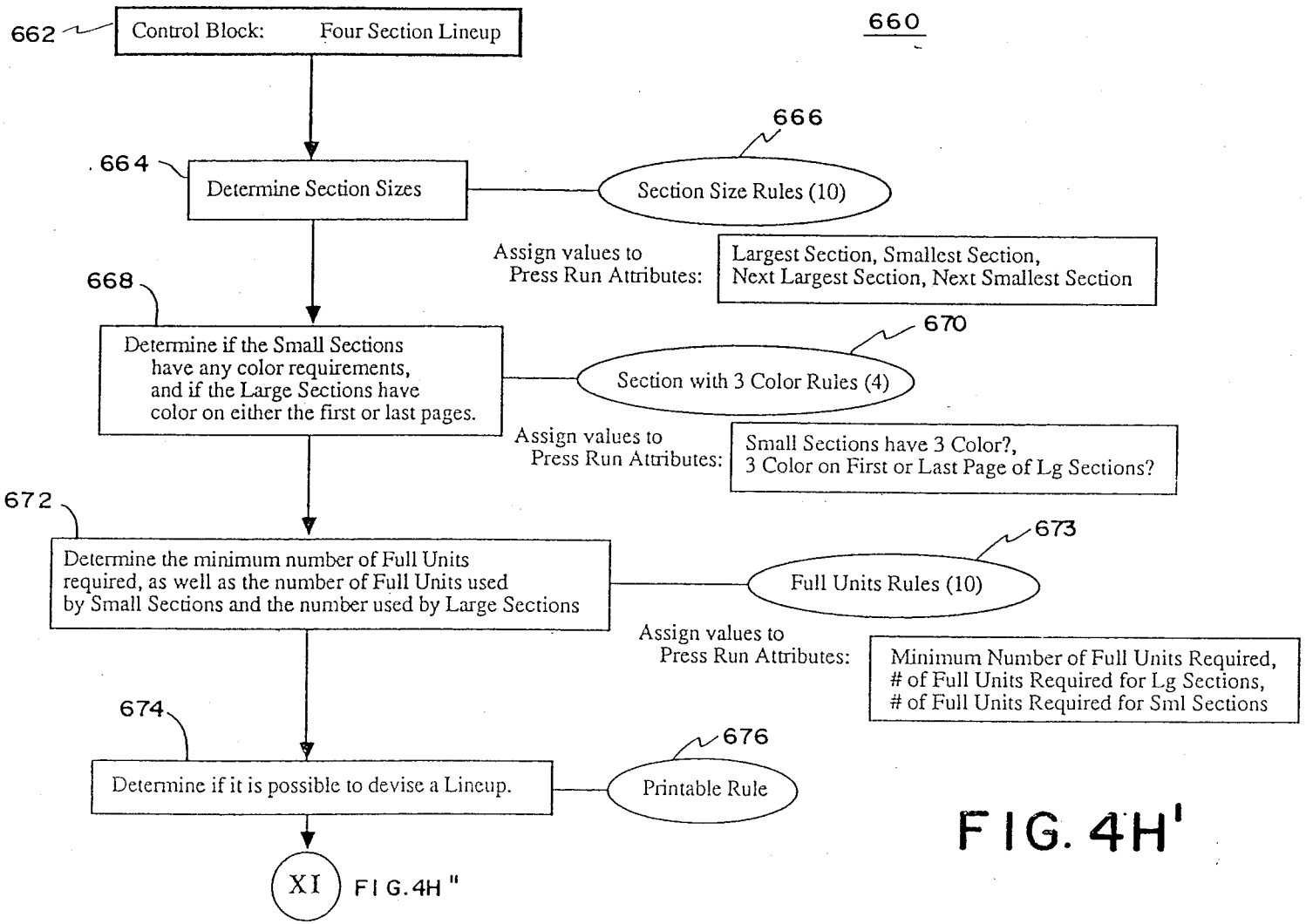
Figure 4H:
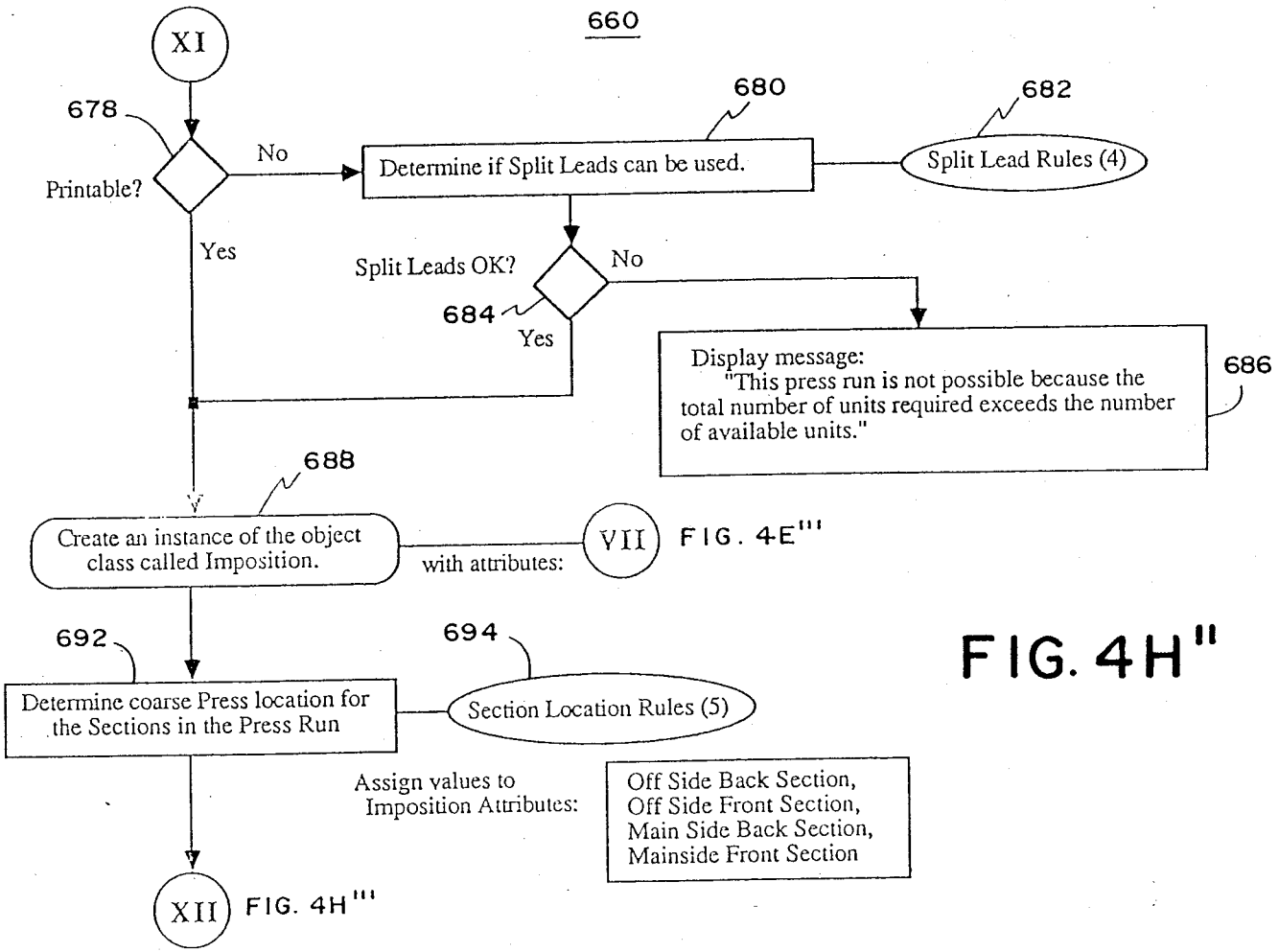
Figure 4H:
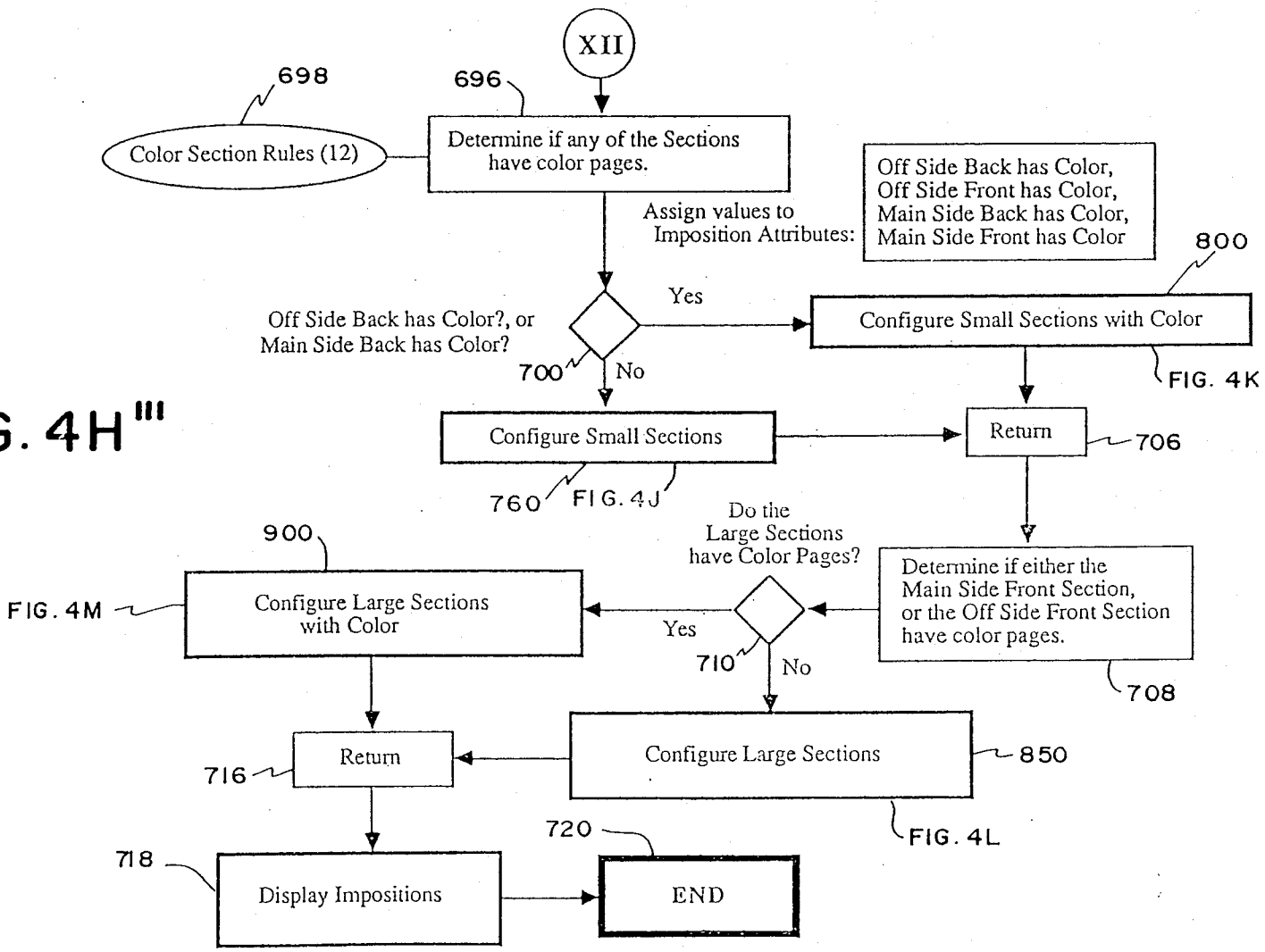

Each of the control blocks, FOUR.SECTION.LINEUP 660, as shown in FIG. 4H, THREE.SECTION.LINEUP 590, as shown in FIG. 4G, and ONE.OR.TWO.SECTION.LINEUP 460 as shown in FIG. 4E, determine on a coarse level the press location that is used for each section of the press run and then tests this provisional line-up to determine if its printable in accordance with the Printable Rules. If not printable, a suitable message is displayed upon the user interface and this consultation is aborted. If printable, then the program continues with considerations of color. These control blocks 460, 540 and 660 make their initial determination of the coarse press locations based solely on the number of sections in the press run and the number of pages in each section, while ignoring considerations of which sections and which pages within a section are to be printed with color. It will be appreciated that the corresponding sets of rules in these control blocks 460, 590 and 660 are similar, but yet are particularly adapted for testing a press run with a particular number of sections.

In order to illustrate the Section Lineup control blocks, particular reference will be given to the control block FOUR.SECTION.LINEUP 660, as shown in FIG. 4H. After entering through control block 662, step 664 determines the relative sizes of each of the four sections in this press run using the rules set [four.sections.size.rules(10)] in step 666. Basically, these rules examine the number of pages in each section and determines its relative size with respect to the other sections, and assigns a numerical value identifying a section to each of the PRESS.RUN attributes: largest.section, smallest.section, next.largest.section and next.smallest.section. Next step 668 examines the two smallest sections to determine whether each has any colored pages and to determine whether the first or last page of either of the two large sections is a color page with process color in accordance with the [3.color.rules] of step 670. As indicated in FIG. 4H, step 670 assigns values in terms of false or true to the PRESS.RUN attributes: small.sections.have.3.color? and 3.color.on.first.or.last.page.of.large.sections?. Next, step 672 determines the minimum number of full printing units 12 as well as the number of full units 12 as actually used to print the two smallest sections, and also the minimum and actually used numbers of full units 12 to print the two largest sections by using the rules set [full.units.rules] as set out in step 673. These rules look at the number of pages required for each of the sections and, based upon this decision making, assign numerical values indicative of the numbers of required units 12 to the PRESS.RUN attributes: minimum.number.of.full.units.required, number.of.full.units. required.for.large.sections, and number.of.full.units.required.for.small.sections. In particular, these rules first determine the number of pages in each section and, noting as shown in FIG. 5 that each full printing unit 12 is capable of printing 8 pages, divides effectively the total number of pages by 8 to determine a whole number or a whole number and a fraction. If there is a fraction, the rules indicate that a further full unit 12 is required. Next, based upon the number of full units 12 required, step 674 determines whether it is possible to devise a lineup for the present press run by using the rules set [printable.rule] as noted in rule 676. Basically, the [printable.rule] set compares the determined number of required full units 12 to print the sections of this press run with respect to the capacity of the printing press 10 in terms of the available number of full printing units 12. Next, step 678 questions the output of the [printable.rule] set of step 676 to determine whether this press run is printable and, if not, step 680 determines whether a split lead can be used to solve the problem by utilizing the rules set [split.lead.rules(4)] as set out in step 682. These rules determine that there is not a sufficient number of half front units 12 to print the large sections and, if so, determines if there are any half back units 12 that are assigned to the small sections, but not actually used, as would be available to print the large sections. Thus one of the back units 12*i* to 12*e* may employ a split lead and be shared to print a large section and a small section. If there are available back half units 12, they may be used to print the large sections by the use of a slitter 21 to form split leads and the rules of step 682 would assign a true value to the PRESS RUN attribute split.leads.o.k.?. Step 684 questions the value of the PRESS RUN attribute split.leads.ok? and, if false indicating that the use of a split lead would not make this lineup printable, step 686 displays a message upon the user interface that this press run is not printable because the total number of printing units 12 required exceeds the number of available units 12.

If possibly printable as determined in step 684, step 688 creates an instance of the object class IMPOSITION having a host of attributes as listed in step 496 (see FIG. 4E'''). The many attributes listed in step 496 (see FIG. 4E''') define the location of each printing plate 13 on the cylinders of the double width printing unit 12, noting that as many as four quartets of printing plates 13 may be aligned along the axis from the main to the off-side of a particular unit 12, each quartet disposed at its image position. These attributes also identify the color pages and where on the cylinders of the press units 12 they are to be printed, as well as the number, placement and orientation (off side to main side or main side to off side) of the sets of angle bars 20. Next, step 692 makes a coarse determination of the press area for each section of this press run utilizing the rules set [section location rules(5)] of step 294. Basically, the largest sections of a press run are assigned to the press units in front of the folder assembly 22, i.e., the front units 12, Whereas the small sections are assigned to printing units 12 behind the folder assembly 22, i.e., the back units 12, whereby the feeding of the webs 18 to the folder assembly 22 is simplified. Step 694 uses the [section.location.rules(5)] to determine the values in terms of which section of the press run is to be printed in which area of the press 10, for the PRESS.RUN attributes: main.side front.section, off.side.back.section, off.side front.section and main.side.back.section. As apparent from their names, these attributes specify the four areas of the press 10.

The remaining steps of the control block 660 function to identify which sections of the press run and which of their pages are to be processed with color. Step 696 examines the IMPOSITION attributes to determine which sections have color pages using the rules set [color.section.rules(12)] of step 698. These rules search the PRESS.RUN attributes and identify those sections with color pages and assigns values in terms of true or false to the IMPOSITION attributes: off.side.back.has.color, off.side.front.has.color, main.side.back.has color, and main.side.front.has.color, to provide an indication that these areas of the press 10 are to print (or not) sections of the press run with color pages. Next, realizing that the small sections have been assigned to the back units 12, step 700 queries whether the off side back area of the press 10 or the main side, back of the press 10 has been assigned to print color pages and, if yes, the control block 660 moves to the control block CONFIGURE.SMALL.SECTIONS.WITH.COLOR 800; if not, the control block 660 invokes the control block CONFIGURE.SMALL.SECTION 760. Step 700 examines the values of those IMPOSITION attributes determined in step 696 to determine the placement of color sections as would require special consideration in the control block 800.

After the control blocks 800 and 760 have been completed, return is made to step 706 and, thereafter, step 708 examines the values of the IMPOSITION attributes as assigned in step 696 to determine whether those press locations to which the large sections are assigned, namely the main side front and the off side front, have been assigned colored pages to print and, if so as determined in step 710, the control block 660 invokes the control block CONFIGURE.LARGE.SECTIONS.WITH.COLOR 900; if not, the program goes to the control block CONFIGURE.LARGE.SECTIONS 850. The details of the control blocks 800, 760, 900 and 850 will be explained later with respect to FIGS. 4K, J, M and K, respectively. After either of the control blocks 950 or 900 has been completed, a return is made to step 716 at which point the imposition has been defined and, in particular, the values of the IMPOSITION attributes as listed in step 690 have been assigned and are substantively displayed in step 718 upon the user interface in a form resembling the message as shown in FIG. 5. Thereafter in step 720, the consultation is terminated. Thus, it is seen that the control blocks 800 or 760, 900 or 850 are used to determine (a) what printing units will be used to print the large or small sections, (b) the unit utilization in terms what portion of the cylinder of each printing unit 12 is used (i.e., full, main three-quarters, off three-quarters, main half, off half or center), (c) on which printing units 12 and in what directions (i.e., main side to off side or off side to main side) are the sets of angle bars 20 placed.

Figure 4I:
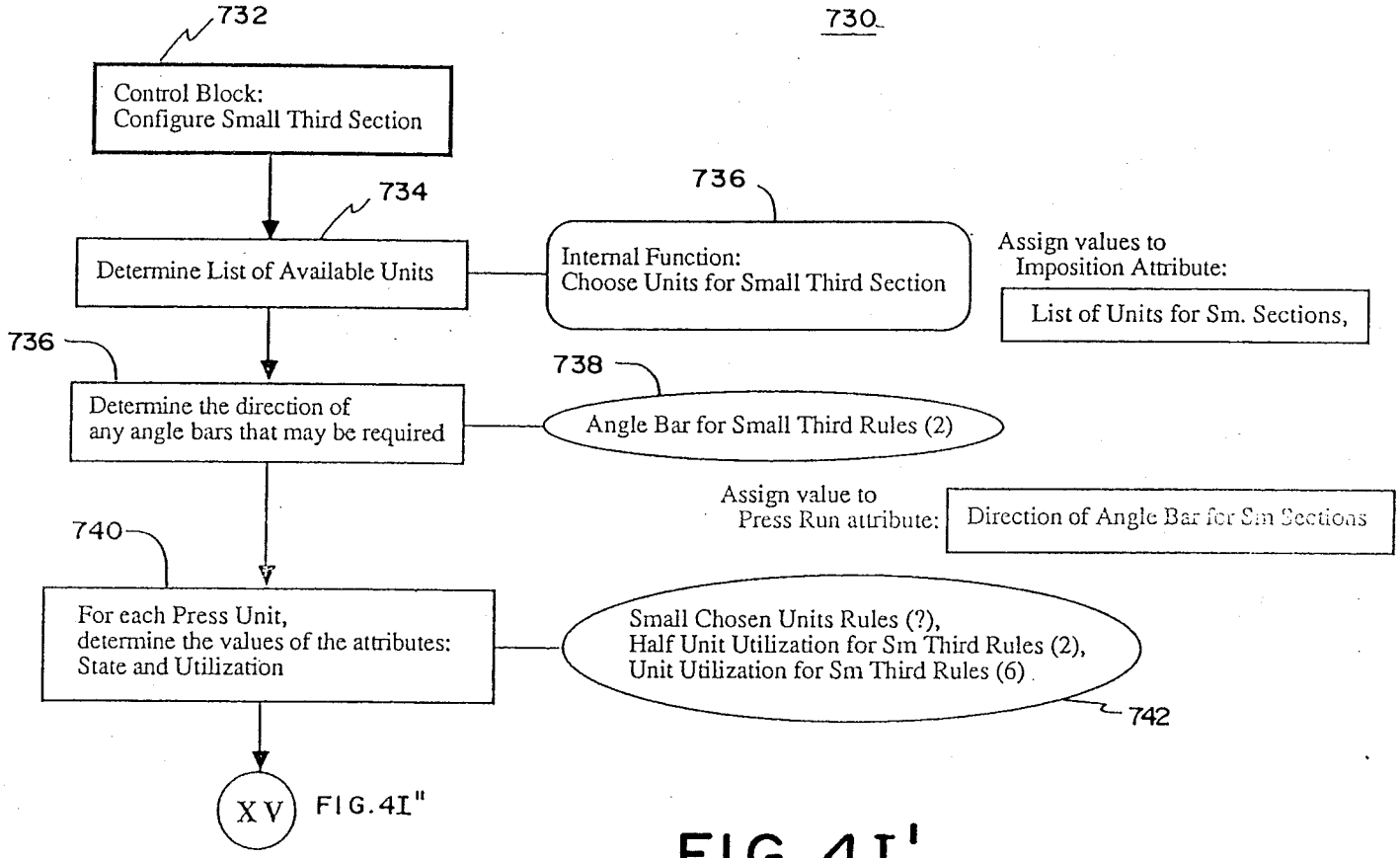
Figure 4G:
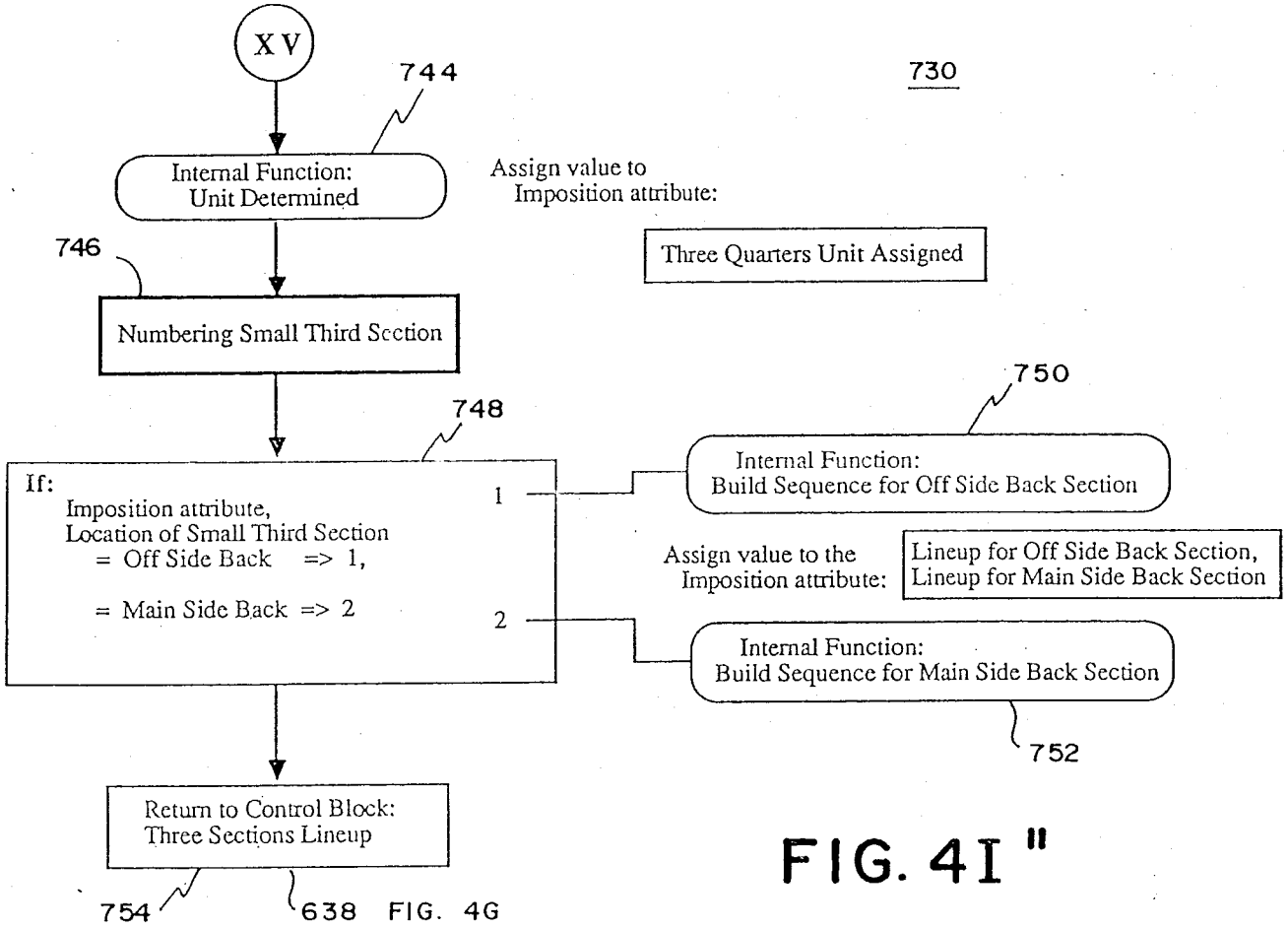
Figure 4J:
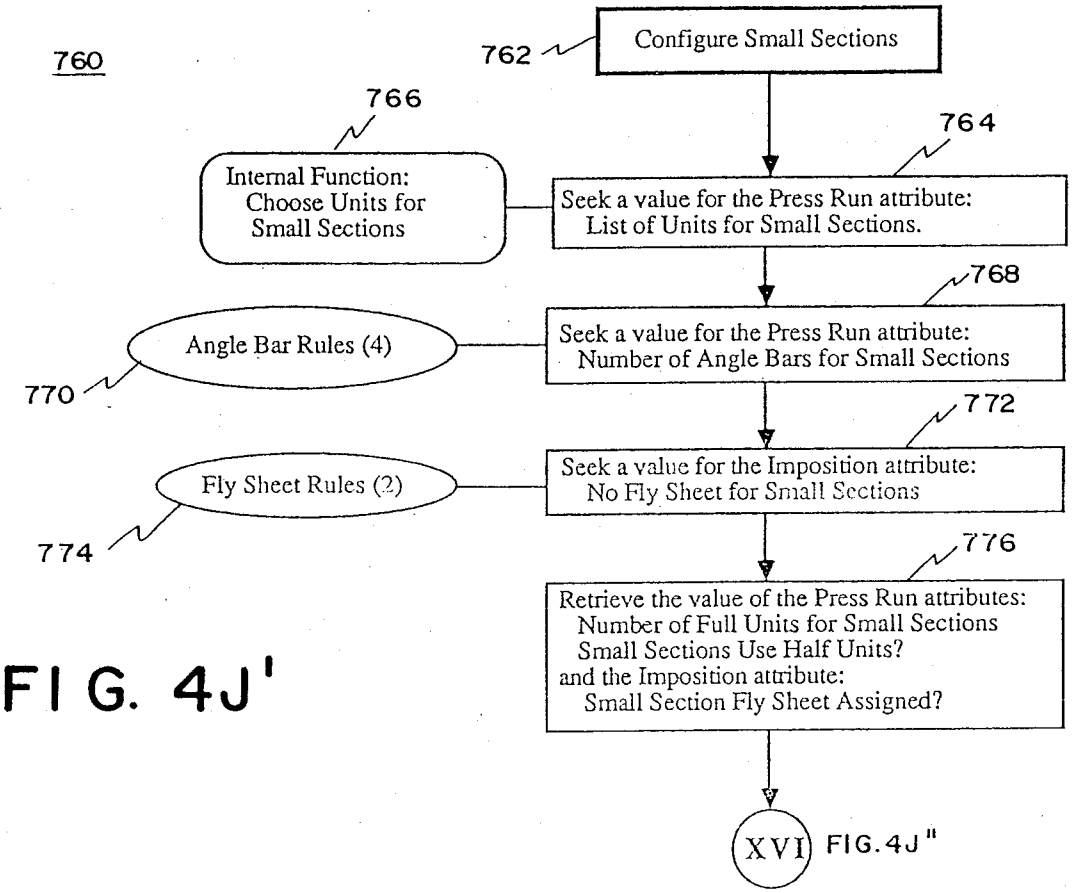
Figure 4K:
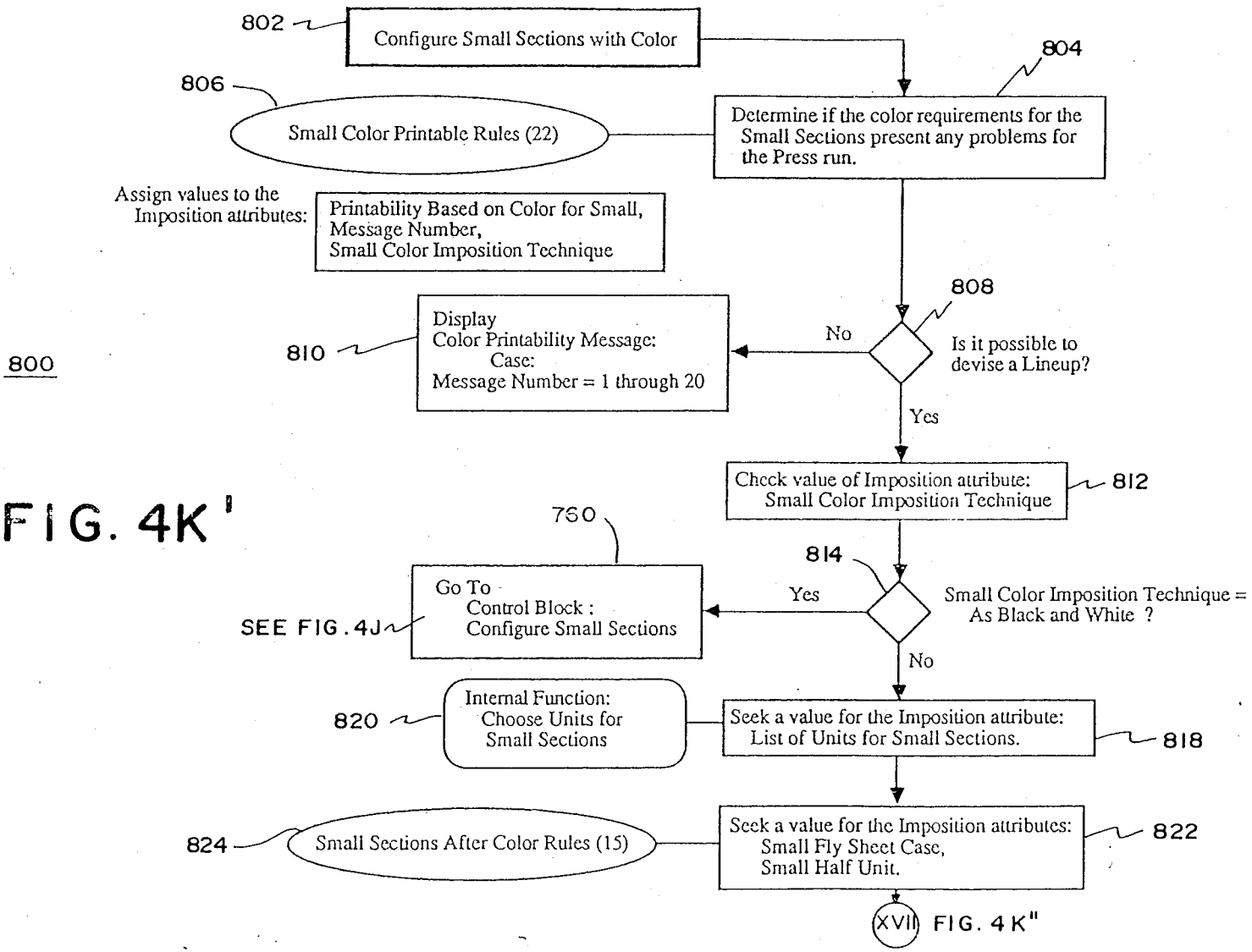
Figure 4L:
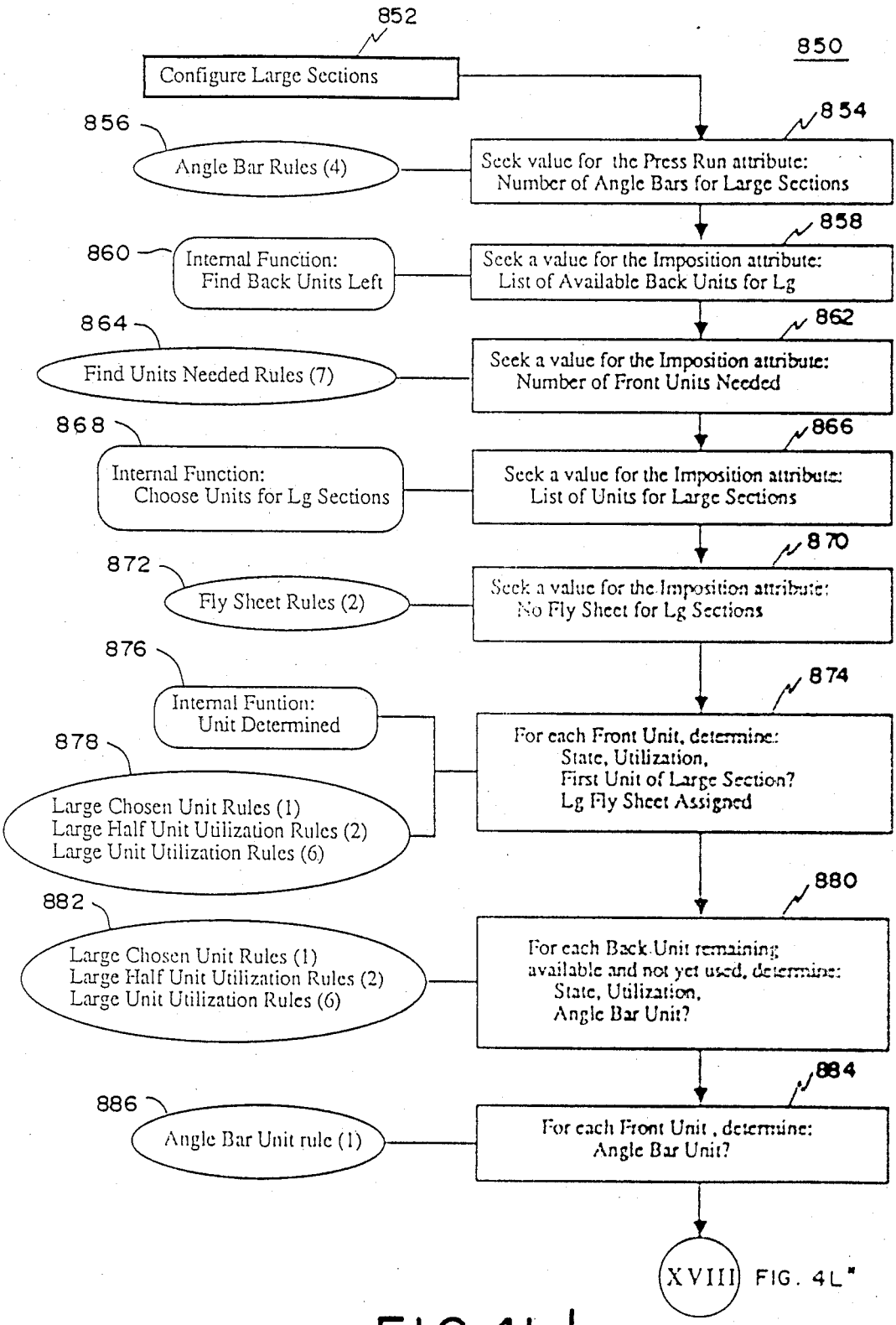
Figure 4M:
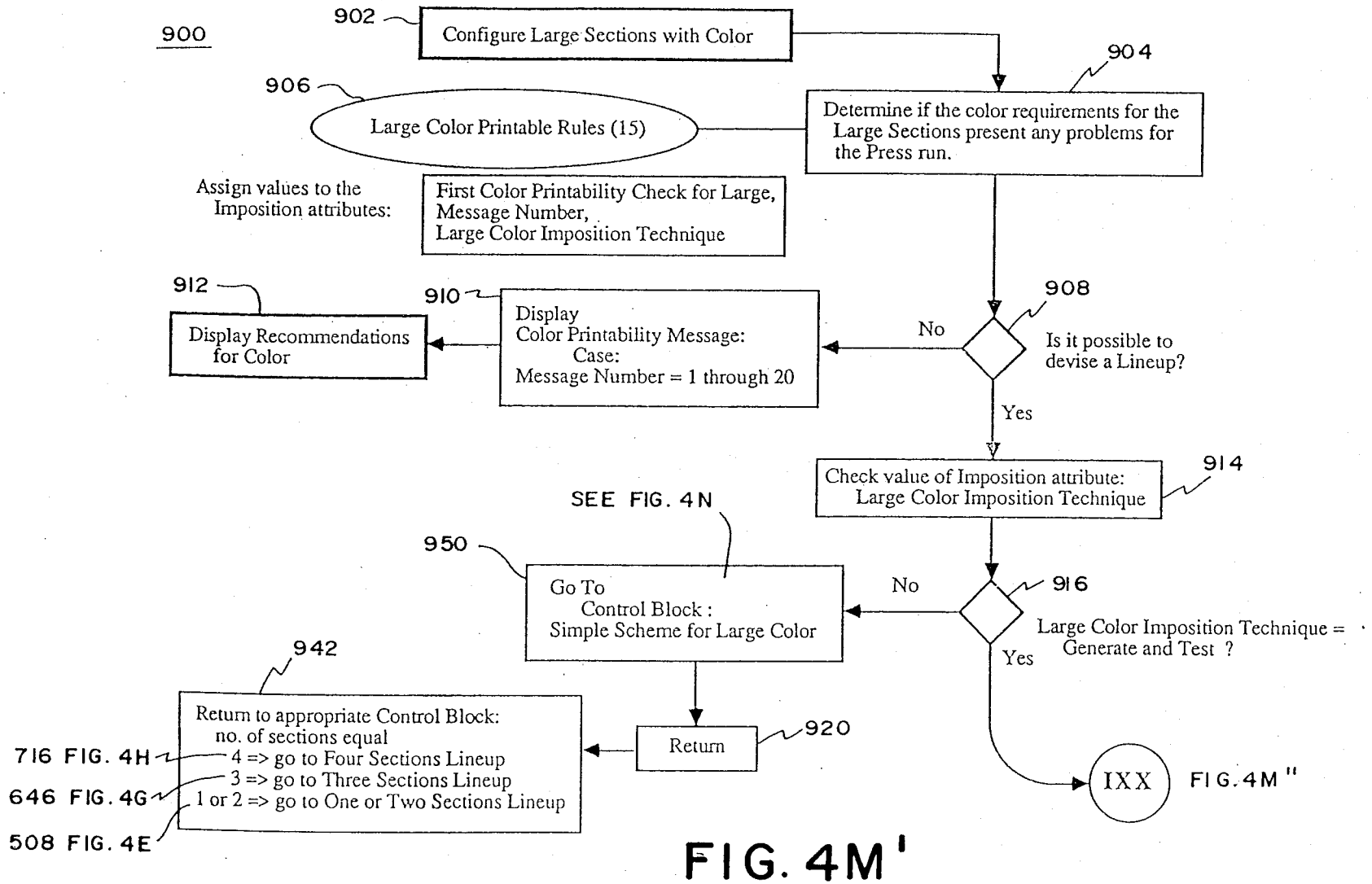
Figure 4N:
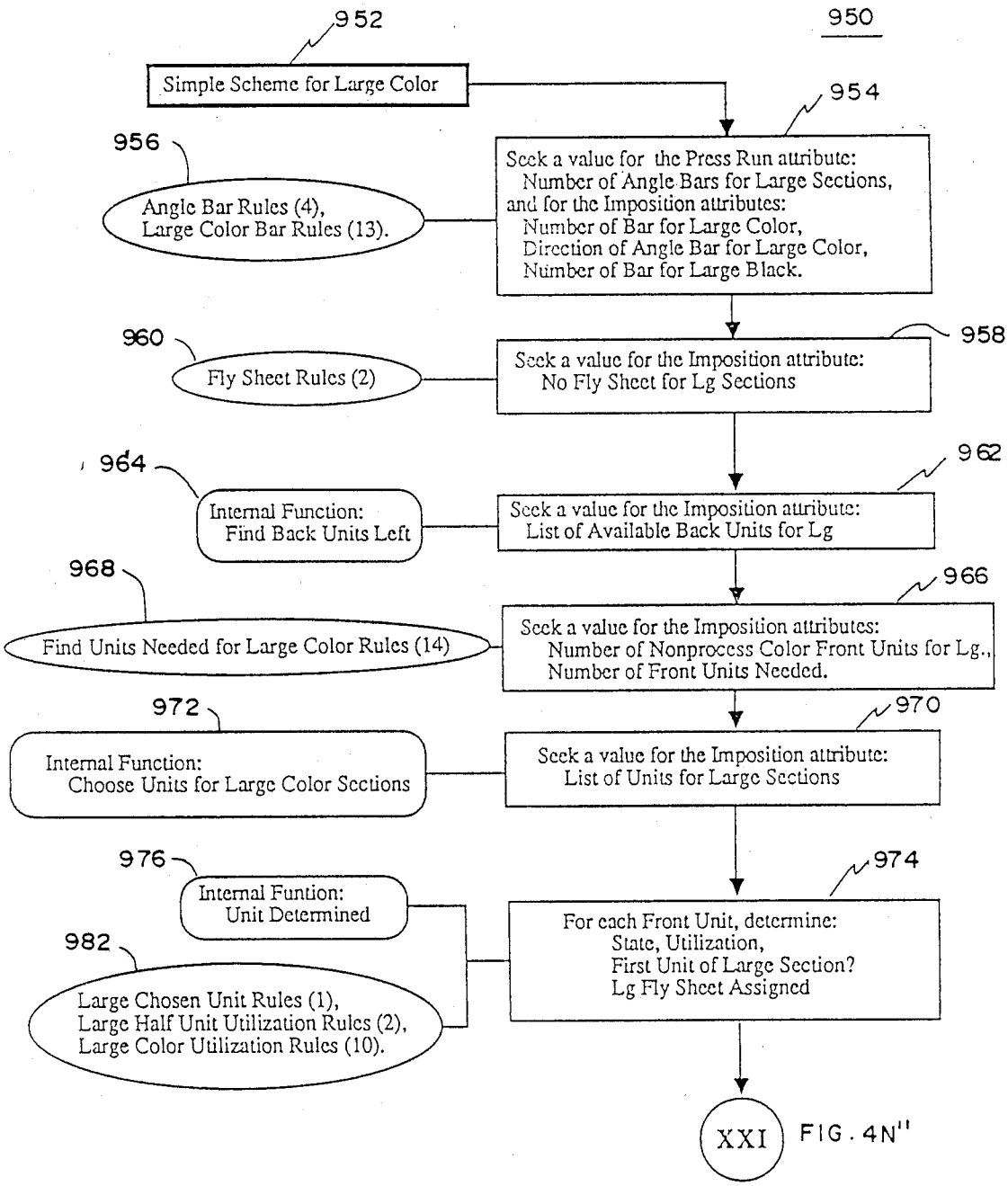

In a manner similar to that described above with respect to the control block FOUR.SECTION.LINEUP 660 in FIG. 4H, each of the control blocks, THREE.SECTION.LINEUP 590 and ONE.OR.TWO.SECTION.LINEUP 460, also invokes the control blocks, CONFIGURE.LARGE.SECTIONS 850, as shown in FIG. 4E, and CONFIGURE.LARGE.SECTION.WITH.COLOR 900, as shown in FIG. 4M. It is understood that after each of these control blocks 850 and 900 has been run, that a return is made respectively to the return steps 646 and 508 and the remaining steps of these control blocks are executed. The control block THREE.SECTION.LINEUP 590 in addition calls a control block CONFIGURE.SMALL.THIRD.SECTION 730, as shown in FIG. 4I. In contrast, the control block CONFIGURE.ONLY.ONE.SECTION 520, as shown in FIG. 4F, does not require any of the control blocks 850, 900, 730, 760 or 800, but rather carries out a sequence of steps similar thereto to complete its imposition. As illustrative of the various steps and rules sets as carried out in the various control blocks 730, 760, 800, 850 and 900, the control block CONFIGURE.LARGE.SECTIONS.WITH.COLOR 900 will be described with regard to FIG. 4M. The control block 900 continues the process of determining for each of the large sections having color pages, the placement of the printing plates 13 on each of the four axial positions of each cylinder of the printing units 12, i.e. near location, near center location, far center location and far location. After entering the control block 900 through step 902, step 904 examines the two large sections to determine whether the placement of the color pages in either of the sections would present a problem in composing the desired imposition. In particular, if any section places color on its first page, last page, third page or third from last page, it is relatively easy to compose an imposition for such a section, and a rule-based backward reasoning method may be employed to compose such an imposition. However, if there are color pages at positions within a section other than those noted above, a generate-and-test method is needed to compose the lineup of the printing plates 13 on the printing units 12 Step 904 employs the rules set [large.color.printable.rules(15)] of step 906. For example, rule large.color.printable.002 states that IF both sections which are placed in the main side and off side of the printing press 10 have color pages AND one of the color pages on the main side front section is the third page or the third to last page of this section AND one of the color pages of the off side front section is also the third page or the third to last page of this section, THEN it is not possible to print these two large sections. If so, this rule would assign a numerical value to the IMPOSITION attribute message.number as would indicate a particular message to be called to be displayed upon the user terminal providing an explanation of why an imposition could not be composed for this press run. In another case, rule large.color.printable.009 states that IF the section which is placed in the main side front area of the printing press 10 has color pages and the section which is placed on the off side front area does not have color pages AND all the color pages of the main side front section are the first page, the third page, the third to last page, or the last page of this section, THEN these two sections are printable AND a "simple scheme" as would involve a rule-base backward reasoning method is used to compose an imposition for these large sections with color pages. If these sections could be composed with a "simple scheme", the rules of step 906 assigns a "simple scheme" value to the IMPOSITION attribute large.color.imposition.technique. If the imposition may not be composed with a "simple scheme", a "generate.and.test" value is assigned to this IMPOSITION attribute. Next, step 908 tests the attributes as assigned by the rules of step 906 to determine whether it is possible to compose an imposition and, if not, step 910 looks up that value assigned to the imposition attribute message.number, and generates a corresponding selected one of a plurality of messages to be displayed in step 910 upon the user interface to inform the pressmen as to why this press run cannot be printed. Next, step 916 tests the IMPOSITION attribute large.color.imposition.technique and, if a simple scheme may be used, the control block SIMPLE.SCHEME.FOR.LARGE.COLOR 950 is invoked, as is shown in FIG. 4N. After the control block 950 is run, a return is made through step 920 to step 942.

On the other hand, if these large sections with interior color pages require a generate-and-test method to determine the placement of the color pages within the large sections as determined in step 916, the control block 900 proceeds to a control block GENERATE.IMPOSITION.FOR.LARGE.COLOR 1020 as will be explained with regard to FIG. 4P. The control block GENERATE.IMPOSITION,FOR.LARGE.COLOR 1020 is invoked to compose a hypothetical line-up for a particular press run having the two large sections with interior color pages. After the hypothetical lineup is composed, a control block TEST.IMPOSITION 924 checks whether or not this hypothetical lineup matches the half color decks and full color decks as are available in the given printing press 10 with the color pages to be printed, using the rules set [large.color.printable.based.on.lineup.rules(6)] as set out in step 926. These rules derive a true or false value for the boolean IMPOSITION attribute printability.for.large.sections.based.on lineup. Next, step 928 tests the imposition attribute printability.for.large.sections.base.on.lineup and, if false indicating that the hypothetical lineup may not be printed, the control block 900 invokes the control block SEEK.ALTERNATIVE 1000, as will be explained in more detail with respect to FIG. 40. Briefly, the control block 1000 determines whether any evolution technique can be used to modify the current hypothetical lineup to derive a printable lineup and, if yes as decided by step 934, the control block 900 moves to the control block SET.UP.FOR.NEW.IMPOSITION 1110, as will be more fully described with respect to FIG. 4R. The control block 1110 sets up new instances of the object classes, BACK.UNIT and FRONT.UNIT, to be used for generating a new hypothetical lineup and the previous set of instances of BACK.UNIT and FRONT.UNIT are marked "forgotten". Further, the control block 1110 transfers from the past instances a good deal of information in the form of attribute values to the new instances of BACK.UNIT and FRONT.UNIT.

On the other hand if step 928 determines that the hypothetical lineup is printable based upon the rules of step 926, it is now known that the large sections are printable and the control block 900 effects a return through setup 942. After step 934 has determined from the value of the IMPOSITION attribute evolution technique that there is no available evolution.technique available or that a given number, e.g. 3, of prior hypothetical lineups have been generated and found to be unacceptable by the control block TEST.IMPOSITION 924, the program moves to step 942 to effect a return to the calling control block.

After a new hypothetical lineup has been constructed in the control block SET.UP.FOR.NEW.IMPOSITION 1110, this control block 900 returns to the control block GENERATE.IMPOSITION.FOR.LARGE.COLOR 1020 and continues to loop through steps 1020, 924, 928, 1000, 934 and 1110 until either a printable lineup is successfully composed, and found unacceptable, or that this "generate-and-test" method determines that no imposition is possible for the color pages of this press run. Finally, the control block 900 moves to step 942 if the value of the IMPOSITION attribute printability.for.large.sections. based.on.lineup is true as would indicate that this line-up may be printed, or the value of the imposition attribute evolution.technique equals none indicating that the present hypothetical lineup may not be printed and that no evolution technique is available to modify the current lineup to provide an acceptable one. Step 942 effects a return to the next step 716, 646 or 508 of its invoking control block 660, 590 or 460, respectively. For example, as shown in FIG. 4H, after the return, the composed and checked imposition is displayed in step 718 before this consultation is terminated in step 720.

Figure 4P:
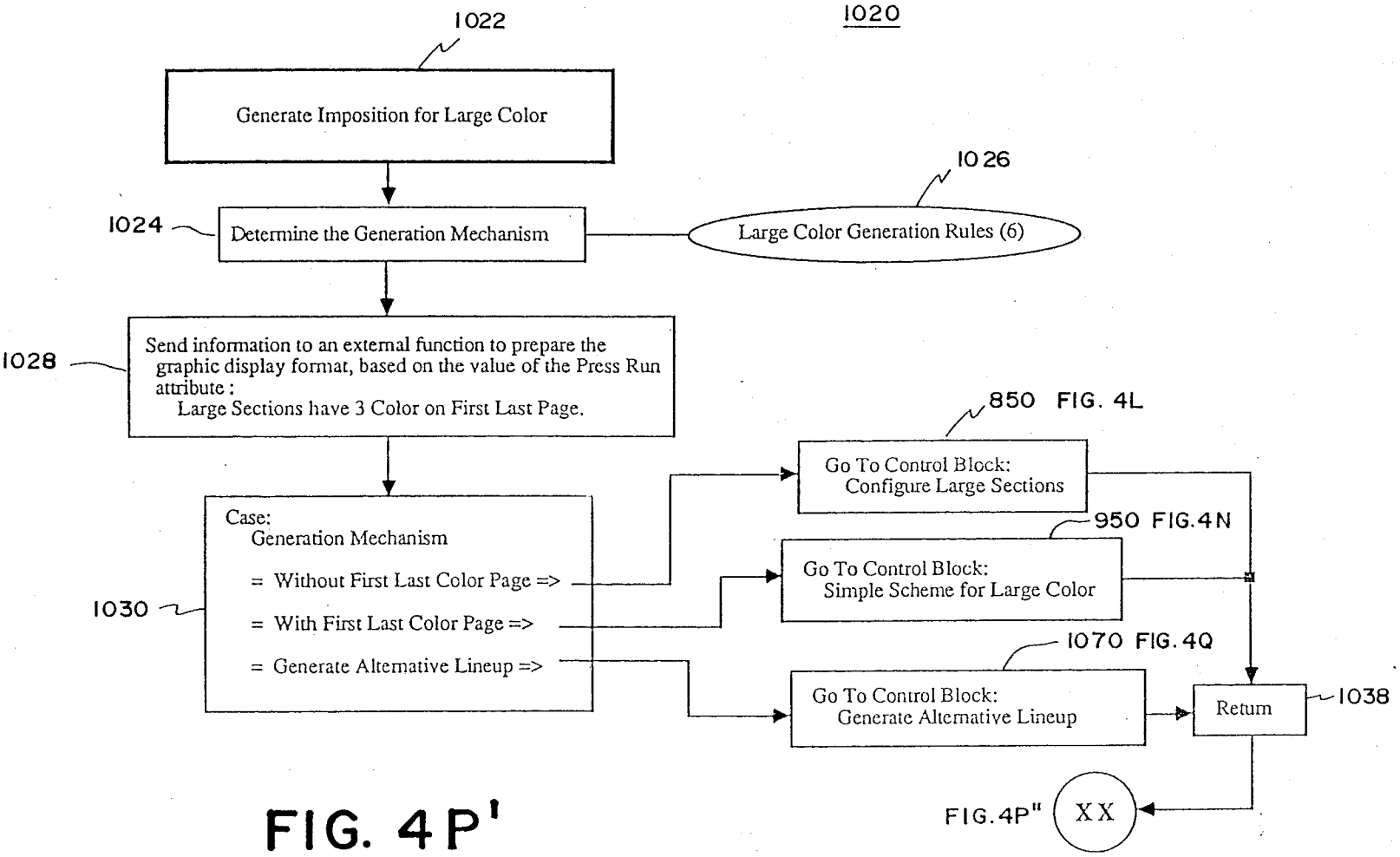
Figure 4Q:
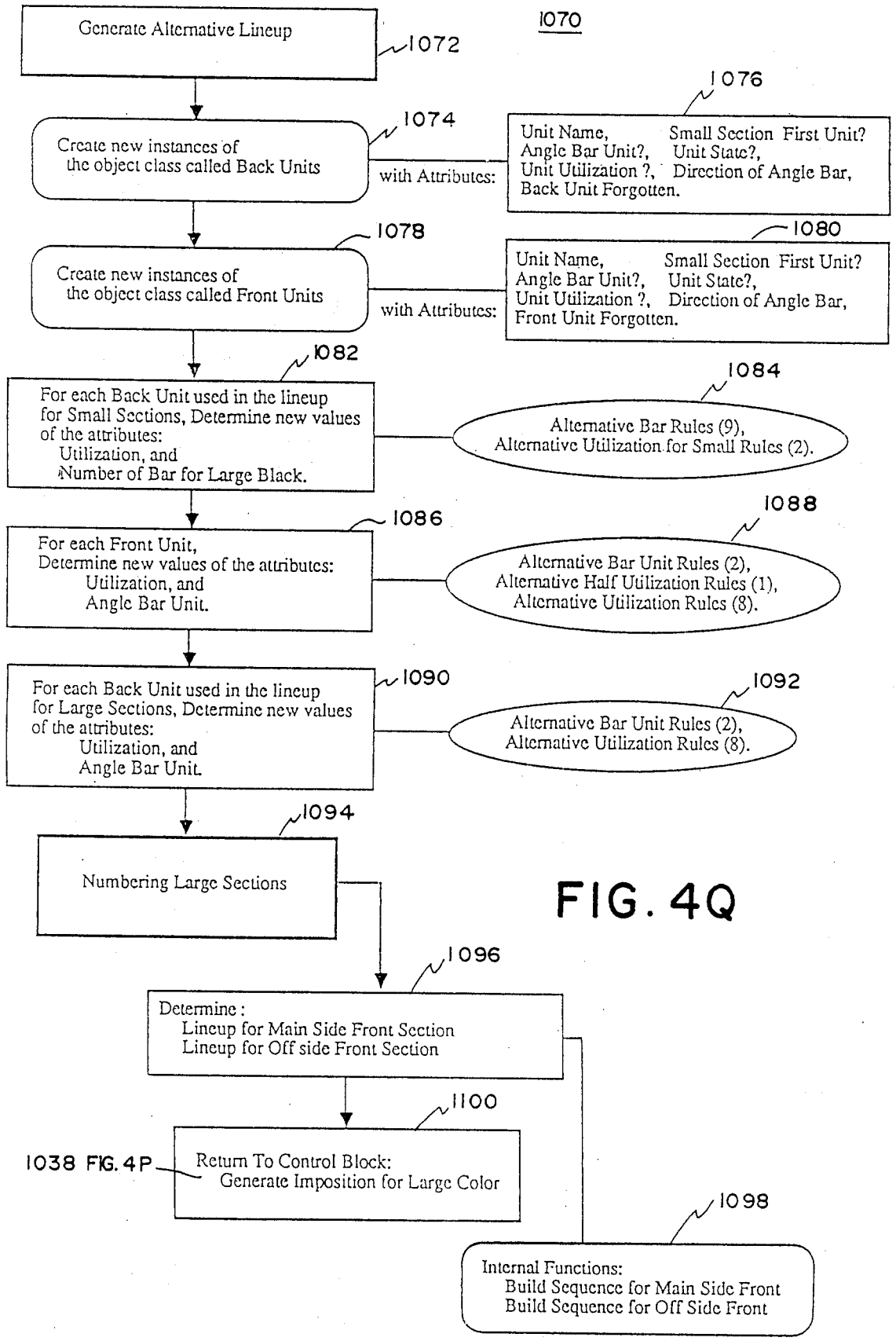

Referring now to FIG. 4P, the specific steps for the high level control block GENERATE.IMPOSITION.FOR. LARGE.COLOR 1020 will be explained. The control block 1020 is invoked by step 916 of the control block 900, as shown in FIG. 4M, if the "generate-and-test method" is to be employed. Generally, the control block 1020 determines which generation mechanism is to be used to generate the lineup for the press run with two large sections. In particular, after entering through step 1022, step 1024 determines which control block will be employed to generate the lineup, i.e. either the control block CONFIGURE.LARGE.SECTIONS 850, as shown in FIG. 4L, the control block SIMPLE.SCHEME.FOR.LARGE.COLOR 950, as shown in FIG. 4N, or the control block GENERATE.ALTERNATIVE. LINE-UP 1070, as shown in FIG. 4Q. In particular, step 1024 uses the rules set [large.color.generation.rules(6)] as shown in step 1026, which examines each of the two large sections to determine whether each has no color pages, color only on the first or last pages or other pages with color processing to assign a corresponding value "with.first.last.color.page", "without.first.last.color.page", or "generate.alternative.lineup" for the IMPOSITION attribute generation.mechanism. Thereafter, step 1028 accesses the value of the PRESS RUN attribute, large.sections.have.3.color.on.first.last.page to display on the user interface a message identifying those large sections employing a three color process on the first and/or last pages of that section. Thereafter, step 1030 examines the value assigned to the IMPOSITION attribute generation.mechanism and, dependent thereon, selects one of the control blocks 850, 950 or 1070 as explained above. After a selected one of these blocks has been invoked and run, a return is made to step 1038, from which the control block 1020 proceeds to step 1040, which forms a lineup for each of the large sections, i.e., a list of the pages and for each page, the assigned position of the printing plate 13 on the cylinder of a particular printing unit 12. Further, the composed lineup is sent to the external Lisp environment, whereby it is displayed upon the user interface.

In the remaining steps of the control block 1020, the pages of each of the large section with color are identified and their printing location on elected of the printing units 12 are also identified. Thereafter, adjacent or neighboring printing plate locations on the units 12 are identified so that alternative printing plate positions may be identified for the next hypothetical lineup. First, step 1042 determines whether any color pages have been assigned to be printed by the printing units 12 of the main side front area of the press 10 and, if so, step 1046 examines the IMPOSITION attributes and determines the pages assigned to be printed by the printing units 12 as numbered 6, 7 or 12, noting that these are the units 12 capable of printing color, by invoking the external function FIND.POSSIBLE.COLOR.PAGES as set out in step 1048. Next, step 1050 employing the external function FIND.NEIGHBOR.PAGES of step 1052, determines and forms a list of the page numbers assigned to the main side of the printing units 12 numbered 10 and 11. In like fashion, step 1054 determines whether any colored pages are to be printed on the off side, front portion of the press 10 and, if so, step 1056 utilizes the external function FIND.POSSIBLE.COLOR.PAGES of step 1058 to identify and form a list of the pages of these large sections that are assigned to be printed in color by these off side units 12 numbered 6, 7 or 12. Then, step 1060 utilizes the external function FIND.NEIGHBOR.PAGES as set out in step 1062, to determine and to provide a list of the page numbers of the pages assigned to be printed by the offside printing units 12 numbered 10 and 11. It is appreciated that the lists of possible color pages resulting from steps 1046 and 1056 are later operated upon by the rules set [incorrect.color.pages rules(2)] as set out in step 1010 of the control block SEEK.ALTERNATIVE 1000, and the lists developed by the steps 1050 and 1060 are operated upon by the rules set evolution.technique(9)] of step 1014 to make changes in the new lineup with respect to the current instance of the object class IMPOSITION to provide a new hypothetical lineup to be tested. After either step 1054 or 1060, return is made by step 1064 to step 924 of the invoking control block CONFIGURE.LARGE.SECTIONS.WITH.COLOR 900, as shown in FIG. 4M. The program returns to the control block 900 with a hypothetical lineup to be tested in step 924, as described above, and lists of those pages of the units assigned to print the large sections that are to be printed with color, and of the neighboring pages within these sections to permit an alternative or new lineup to be generated in case the present lineup is found not to be printable.

Referring now to FIG. 4Q, the steps of the control block GENERATE.ALTERNATIVE.LINEUP 1070 which is carried out to create a new instance of the object class PRESS and in step s 1074 and 1078 respectively create new instances of the object classes BACK-.UNITS and FRONT.UNITS with the attributes as shown in steps 1076 and 1080 as previously discussed with respect to steps 214 and 218 of FIG. 4A. Step 1082 determines for each back unit 12 in the lineup as assigned to print the small sections, the new values of the attributes: utilization and number.of. bar.for.large.black using the rule sets [alternative.bar. rules(9)] and [alternative.utilization.for.small.rules(2)] as set out in step 1084. These rules are used to map the values of attributes already determined for a previous instance of the object class PRESS onto a new instance thereof. This action is necessary because S.1 does not permit the value of an attribute to be changed once it has been determined. Therefore as this composing method loops through the generate-and-test steps to create additional hypothetical press lineups, the new instances are available to receive new values of the PRESS attributes, utilization and angle.bar.unit. These alternative.bar rules act by examining the value of the IMPOSITION attribute step.to.take, which can have any of the values "none", "no.change.on.front.units", "angle.bar.main.-to.off.on.until.6", "angle.bar.off.to.main.on.unit.6", "unit.8.needed", or "remove.one.front.unit". The value of step.to.take will direct the alternative.bar rules to choose which of the new instances of the object class PRESS will need new values for their attributes, utiliza tion and angle.bar.unit, and which will use the same values that were determined by the previous instance. Then the rules act to determine the values for the PRESS attributes utilization and angle.bar.unit, for each new instance of the object class PRESS by either copying the value set for the corresponding old instance, or by determining a new value. In a similar fashion, step 1086 utilizes the rule sets, [alternative.bar.unit.rules(2)], [alternative.half.utilization.rules(1)] and [alternative.utilization.rules(8)], to determine for each front unit 12 new values of the attributes, utilization and angle.bar.unit, for the new instance of the object class FRONT.UNIT. Step 1090 invokes the rules sets, [alternative.bar.unit.rules(2)] and [alternative.utilization.-rules(8)] as set out in step 1092, for each back unit 12 used in the lineup for printing the large sections to determine the new values of the attributes, utilization and angle bar.unit. Thereafter, step 1 094 places a sequential number on each of the large sections. Next, step 1096 generates an alternative imposition for the next hypothetical lineup for the main side front area of the press 10 for the large sections, by calling an internal function BUILD.SEQUENCE.FOR.MAIN.SIDE.FRONT. In similar fashion, setup 1096 builds a lineup for the large sections for the off side front area of the press 10 by calling the internal function BUILD.SEQUENCE.-FOR.OFF.SIDE.FRONT. Generally, these BUILD-.SEQUENCE functions operate to determine a new hypothetical lineup based upon the prior assignment of angle bars and the previously determined values of the attribute utilization of each of the printing units 12. The placement of the printing plates 13 on each of the four possible locations is shown in FIG. 5. The detailed steps and operations of the BUILD.SEQUENCE internal functions will be described below. Thereafter, step 1100 effects a return to step 1038 of the control block GENERATE.IMPOSITION.FOR.-LARGE.COLOR 1020, as shown in FIG. 4P.

Internal functions similar to those functions, BUILD.SEQUENCE.FOR.MAIN.SIDE.FRONT and BUILD.SEQUENCE.FOR.OFF.SIDE.FRONT, as invoked in step 1098 of FIG. 4Q, are also invoked as will be explained below at a number of further points in this program, namely at step 574 of Fig. F, at step 790 of Fig. J, at steps 750 and 752 of FIG. 4I, at step 840 of Fig. K, at step 892 of Fig. L and at step 992 of Fig. N. The internal BUILD.SEQUENCE functions are some of the final steps in the method of composing an imposition and operate to develop a list of the image positions for each of the four areas of the printing press 10, namely the main side front area, the off side front area, the main side back area and the off side back area. Prior to invoking the internal functions BUILD.SEQUENCE. each section of the press run has been assigned to one of these four areas of the press 10, e.g. by section 692 of the control block FOUR.SECTION.LINEUP 660. In addition, a list of the printing units 12 for each section has been developed, and the various utilization rules have developed values of the attribute utilization as would indicate the extent of use and which of the four image positions of a unit 12 have been used, as explained above. At this point, one of the following four internal functions, BUILT.SEQUENCE.FOR.MAIN.FRONT, BUILT.SEQUENCE.FOR.OFF.SIDE.FRONT, BUILD.SEQUENCE.FOR.MAIN.SIDE.BACK, or BUILD.SEQUENCE.FOR.OFF.SIDE.BACK, is invoked in order to construct a list of the image positions in it's area of the press 10.

For example, if the BUILD.SEQUENCE.FOR-.OFF.SIDE.BACK function is invoked, a list of the image positions for the off side back area of the press 10 is being built. Referring to the example of FIG. 5, this list would include in order the image positions of the fourth to first back units 12*i* to 12*l*. In particular, the list would start with the first unit 12*l* and would include in sequence the following image positions: first unit 12*l*, fourth position; third unit 12*j*, fourth position; third unit 12*j*, second position; and fourth unit 12*i*, fourth position Illustratively, a similar list is also being developed of the image positions starting from the first unit 12*l* as follows; first unit 12*l*, third position; second unit 12*k*, third position; third unit 12*j*, third position; third unit 12*j*, first position; and fourth unit 12*i*, third position. These two lists are combined together to form the output of the internal function, BUILD.SEQUENCE.FOR.OFF-.SIDE.BACK. From the above, it is seen that this internal function examines these values of the IMPOSITION attribute utilization to determine whether a page (or more particularly it's printing plate 13) is assigned to a particular image location As shown in FIG. 5, the fourth position of the second unit 12*k* has not been used and, based upon the utilization of the second unit 12*k*, that position is not included in the list.

The use of sets of angle bars 20 is also examined by the BUILD.SEQUENCE function to determine the presence of a set of angle bars 20 and its orientation, either main side to off side or off side to main side. If a set of angle bars 20 is present and it is directing a web 18 to this area of the press unit 10, this function incorporates the inserted image position in the list at a point corresponding to the location of the set of angle bars 20. In the example shown in FIG. 5, a set of angle bars 20 is incorporated in the third unit 12*j* and serves to shift the main side image positions to be included into those of the off side, as indicated by the list formed above.

Thus there is produced an ordered sequence of the image locations for a particular section of the press 10, e.g. the off side back as shown in FIG. 5. Each image position being represented in the list by a numeric code whose first and second digits identify the number of its printing unit 12 and its last digit identifying the one of four positions of the image or printing plate 13 on that unit 12. A set of these lists for each of the four press areas represents a completed lineup of the press 10.

As will be explained, after these BUILD.SEQUENCE internal functions are called the method will proceed through one of the configured sections control blocks until a display impositions step, such as that step 718 as shown in the control block FOUR.SECTION.LINEUP 660, is called. At that time, this list of image positions is transferred externally of the S.1 shell, and section and page numbers are aligned with each of the image positions. In this regard, the section and the page number of its pages are known to be assigned to a particular area of the press, e.g. section 3 is assigned to the off side back area of the press 10. At this point, the section and page numbers are added to the image locations and are displayed as shown in FIG. 5. In this regard, a convention is employed where it is known that the first pair of pages of a section is assigned to the first image position of this list and the second pair of pages to the second image position of this list. The page numbers of a section continue to be assigned in this fashion to form a U-shaped pattern. The image positions, and the section and page numbers are joined in this fashion, and are displayed upon the user terminal in a manner shown in FIG. 5. When the list of image positions for each of the four areas of the press 10 have been completed, a complete lineup has been composed.

Referring now to FIG. 4L, the detailed steps of the control block CONFIGURE.LARGE.SECTIONS 850 is shown. The control block 850 is invoked from a number of points in this program, namely from step 504 of control block 460, from step 640 of control block 590, from step 710 of control block 660 and from step 1030 of control block 1020. After entering through step 852, step 854 seeks a value of the PRESS.RUN attribute number.of.angle.bars.for.large.sections by using the rules set [angle.bar.rules(4)] as set off in step 856. These rules determine the number of the sets of angle bars required by examining the difference between the numbers of half units required for each of the two larger sections and then setting the PRESS.RUN attribute number.of.angle.bars.for.large. sections equal to the nearest integer of half the difference. As may be visualized by examining FIG. 5, a set of angle bars 20 serves to move a web portion from one press area to another area of the press 10 thus adding an extra page to a particular section being printed in the other area. Thus for example, if one of the two large sections requires three more half units than the smaller of the two larger sections, two sets of angle bars 20 will be added to the press 10 to add additional pages to the larger of the two large sections Next, step 858 seeks a value for the imposition attribute list.of.available.back.units.for.large.section by calling an internal function of the program to locate the available back units 12. Before the control block CONFIGURE.LARGE.SECTIONS 850 is invoked, the number of back units 12 assigned to print the small sections has been determined. Thus, step 858 constructs a list of those back units 12, which have not been previously assigned and are thus available to print the large sections. Next, step 862 utilizes the rules set [find.units.needed.rules(7)] as set out in step 864 to assign a value for the IMPOSITION attribute number.of.front.units.needed by dividing the number of pages required for each of the two large sections effectively by 8. Next, step 866 utilizes an internal function CHOOSE.UNITS.FOR.LARGE.SECTIONS as set out in step 868, to sequentially choose the available front units 12 on the main side for the larger of the large sections and, thereafter, to choose sequentially the front sections on the off side for the smaller large section; as a result, step 866 provides lists of the selected units 12 for each of the two sections. The lists of the available front units 12 for the large sections will be examined in the later steps. The internal function UNIT.DETERMINED of step 876 sets a value indicating that the utilization values have been determined for the units 12 assigned to print the large sections Next, step 870 seeks a value of the IMPOSITION attribute no.fly.sheet.for.large.sections using the rules set [fly.sheet.rules(2)] as noted in step 872. Basically, the step 872 determines the attributes assigned to the object class PRESS.RUN to determine the number of fly sheets to be incorporated into each of the two large sections. Then, step 874 determines for each of the front units 12 the IMPOSITION attributes: state, utilization, first.unit.of.large.section? and large.fly.sheet.assigned. The attribute state refers to whether this particular unit 12 is available or not and assumes a corresponding value of true or false. Step 874 utilizes the rules sets [large.chosen.unit.rules(1)], [large.half.unit.utilization.rules(2)] and [large.unit.utilization.rules(6)] as set out in step 878. These utilization rules sets are some of the most important rules in the knowledge base since they act to establish for each printing unit 12 the degree of its utilization. In the illustrative printing press 10 as described above, each of the double width press units 12 may have a maximum total of 8 pairs of printing plates 13 thereon. If a printing unit 12 has no printing plates 13 thereon, its attribute utilization is assigned the value "unused" whereas if it has all of its positions filled, it is assigned the value "full". Similarly, the value "center" is assigned if the two pairs of printing plates 13 are assigned to the center part of a cylinder roll. Similarly, the value "main.half" and "off.half" are assigned if only two pair of printing plates 13 are disposed on the main side or the off side, respectively. In similar fashion, the values "main.three.quarters" and "off.three.quarters" are assigned if three pairs of printing plates 13 are disposed towards the main side or towards the off side, respectively. These utilization rules also determine and assign a value to the IMPOSITION attribute first.unit.of.large.section indicative of the first unit to be used for each large section and to assign a value of true or false to the attribute large.fly.sheet.assigned indicating whether or not a unit 12 receives a fly sheet. In a similar fashion, step 880 uses the rules sets as set out in 882 as are identical to those of step 878 to determine like attribute values for each of the back units. Then, step 884 determines for each front unit, the value of the IMPOSITION attribute angle.bar.unit by employing the rules set [angle.bar.unit rule(1)] to assign a value of true or false to each front unit 12 dependent upon whether it employes a set of angle bars 20 or not.

Thereafter, step 888 calls the step 890, which constructs the lineup for the main side front section and the off side front section employing the internal functions, BUILD.SEQUENCE.FOR.MAIN.SIDE.FRONT and BUILD.SEQUENCE.FOR.OFF.SIDE.FRONT as described above. These internal functions convert the utilization values into a list that contains a sequence of coded press unit locations. Each element in this list is a two or three digit numeric code in which the first one or two digits identifies the particular printing unit 12 and the last digit identifies the location of the plate 13 on the printing unit 12. A set of ordered lists of this type represents a completed lineup. After the lineups have been constructed for the front and back units 12, the control block 850 exits through step 894, which examines the IMPOSITION attribute generation.mechanism and, if "without.first.last. color.page", the program returns to step 1038 of the control block 1020, as shown in FIG. 4P. Otherwise, as indicated in step 896, return is made to step 716 of the control block 660 as shown in FIG. 4H if four sections are involved, to step 646 of the control block 590 as shown in FIG. 4G if three sections are involved and to step 508 of control block 460 as shown in FIG. 4E if one or two sections are involved.

Referring now to FIG. 4N, the steps of the control block SIMPLE.SCHEME.FOR.LARGE.COLOR 950 are shown. The control block 950 is invoked from step 916 of the control block 900 or from step 1030 of the control block 1020 if the color pages to be printed in the large sections of the addition are in interior positions that are relatively simple to print. As will be apparent from a review of FIG. 4N, the steps of the control block 950 resemble those of the control block 850 CONFIGURE.LARGE.SECTIONS 850 as shown in and previously described with respect to FIG. 4L. Initially, step 954 determines the number of the sets of angle bars 20 for the large sections and assigns the values of the IMPOSITION values for the number of the sets of angle bars 20 that are needed for the large color sections and the large black and white sections, as well as the directions of these sets of angle bars 20 using the rule sets [angle.bar.rules(4)] and [large.color.bar.rules(13)] as shown in step 956. Thereafter, step 958 determines the value true or false for whether there is a fly sheet utilizing the [fly.sheet.rules(2)] of step 964. Step 962 forms a list of the available back printing units 12 using the internal function FIND.BACK.UNITS.LEFT. Thereafter, step 966 assigns values to the attributes identifying the number of front, non-process color printing units 12 and the total number of front units 12 needed to print the large sections, utilizing the rule set [find.units.needed.for. color.rules(14)] of step 968. Next, step 970 composes a list of the printing units 12 that will be assigned to print the two large sections using the internal function, CHOOSE.UNITS.FOR.LARGE.-COLOR.SECTIONS as set out in step 972. These rules search in order the units 12 available in the front section to print the large sections of the press run and, thereafter, identify those available back units 12 that will then be added to the list. Next, step 974 determines the values for the IMPOSITION attributes, state, utilization, first.-unit.of. large.section? and large.fly.sheet.assigned, using the internal function UNIT.DETERMINED of step 976 and the rules sets [large.chosen.unit.rules( 1 )], [large.half.unit. utilization.rules(2)] and [large.color.utilization.rules(10)] of step 978. Step 974 assigns these IMPOSITION values for each front unit 12 in the list developed in step 970. Thereafter, step 980 determines for each back printing unit 12, which has not been previously selected for the small sections and thus is available, the values for the IMPOSITION attributes, state, utilization and angle.bar.unit? utilizing the rules sets, [large.chosen.unit rules(1)], [large.half.unit.utilization.-rules(2)], [large.unit. utilization.rules(6)] and [large.-black.angle.bar.unit.rule(1)], of step 982. Step 984 determines for each front unit 12 whether it requires a set of angle bars 20 utilizing the rules set [large.black.angle.-bar.unit.rule(1)] of step 986. Step 988 calls step 990, which operates to compose an ordered list of the printing plates 13 identifying for each plate 13 the printing unit 12 to which it is assigned and its location number, i.e., 1-4 on each unit 12, using the BUILD.SEQUENCE internal functions of step 992 as discussed above. Thereafter, the control block 950 exits in step 994 to the return step 1038 of the control block 1020 if in the generate-and-test method and, if not, to the return step 920 of the control block 900, as shown in FIG. 4M.

Figure 40:
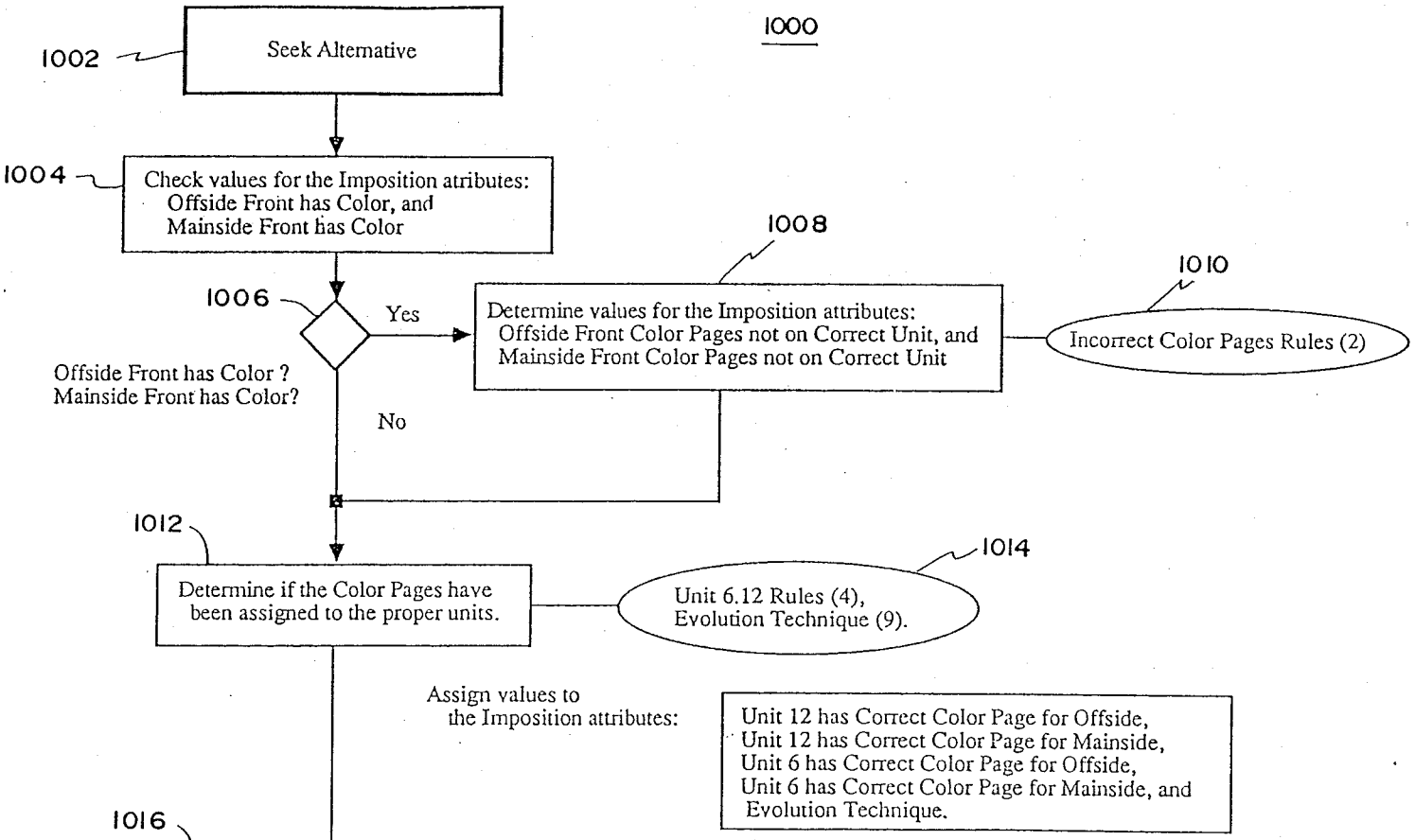

Referring now to FIG. 40, the steps of the control block SEEK.ALTERNATIVE 1000 are described in further detail. This control block 1000 is entered from the control block TEST.IMPOSITION 924 of the control block 900, as shown in FIG. 4M, and is invoked after a hypothetical line-up is generated and the control block 924 has determined that the present hypothetical lineup under consideration is not capable of printing the given press run. When invoked, the control block SEEK.ALTERATIVE 1000 determines whether there is any evolution technique that may be used to modify the current hypothetical lineup to obtain an acceptable one, the current lineup having been found unprintable by control block 924. After entering through step 1002, step 1004 examines the values of the IMPOSITION attributes, offside.front.has.color and mainside.front-.has.color, to determine whether false or true and, if either value is true, step 1006 moves the program to step 1008, which determines the values of the IMPOSITION attributes, offside.front.color.pages.not.on.correct.unit and main.front.color.pages.not.on.correct.unit, using the rules set [incorrect.color. pages.rules] of step 1010. These rules determine whether the color pages of the large sections are assigned to those front units 12 capable of printing color, by comparing a first list of those pages of the large sections assigned to be printed in color with those second lists of pages to be printed by the front color units 12, as previously composed in steps 1046 and 1056. If a match cannot be made between these first and second lists, a third list of these color pages not currently assigned to a color unit 12 is set in the corresponding IMPOSITION attribute off-.side.front.color. pages.not.on.correct.unit or mainside.-front.color.pages. not.on.correct unit.

Thereafter, step 1012 determines if the color pages have been assigned to the proper main side and off side front units 12 invoking the rules set. [evolution.technique.rules(9)] as shown in step 1014. The rules of step 1014 function to determine a value for the IMPOSITION attribute evolution.technique, which may be assigned any of the values, "none", "no.change.on.-front. units", "angle.bar.main.to.off.on.unit.6", "angle.-bar.off.to.main.on.unit.6", "unit.8.needed", "remove.one.front.unit". As the names apply, these values identify the steps or techniques that may be used to change the current lineup to obtain an acceptable one. As will be explained in detail below, these rules examine the values of the current instance of a variety of IMPOSITION attributes and determine whether or not the current instance of the object class IMPOSITION has color pages placed on units 12 that can print color and, if not, whether a generation of a further hypothetical lineup would produce potentially a printable lineup, the particular evolution technique being identified by the value assigned to the IMPOSITION attribute evolution.technique. For example, rule evolution.009 states that IF no correct color page number on the main side of unit number 12 AND either no correct color pages numbers on the off side of unit number 12 OR the section which is placed in the off side front area does not have any color pages AND one color page of the main side front section which page number is in first.neighbor.pages.-for.12.main.side AND there is a back unit which has not been used, THEN the evolution technique assigns the IMPOSITION attribute evolution.technique with the value "remove.one.front.unit". These values of the IMPOSITION attribute evolution.technique will be used later in the control clock SETUP.FOR.NEW.IMPOSITION 1110 to make new changes in the next hypothetical lineup as will be built in the control block 1110.

Further, step 1014 employs the rules set [unit.6.12-.rules(4)] to search the current values of the IMPOSITION attributes to determine whether selected of the front printing units 12 have image or printing positions thereon that are not assigned to color pages but are capable of printing color pages and assigns a true or false value to the IMPOSITION attributes, unit.12.-has.correct.color.page.for.off.side, unit.12.has.correct.-color.page.for.main.side, unit.6.has.correct.color.page.-4.off.side, and unit.6.has.correct.color.page.4.main.side. These IMPOSITION attributes will be acted on in a later stage of the generate-and-test method. Finally, step 1016 effects a return to step 934 of the control block CONFIGURE.LARGE.SECTIONS.WITH.COLOR 900, as shown in FIG. 4M.

Figure 4R:
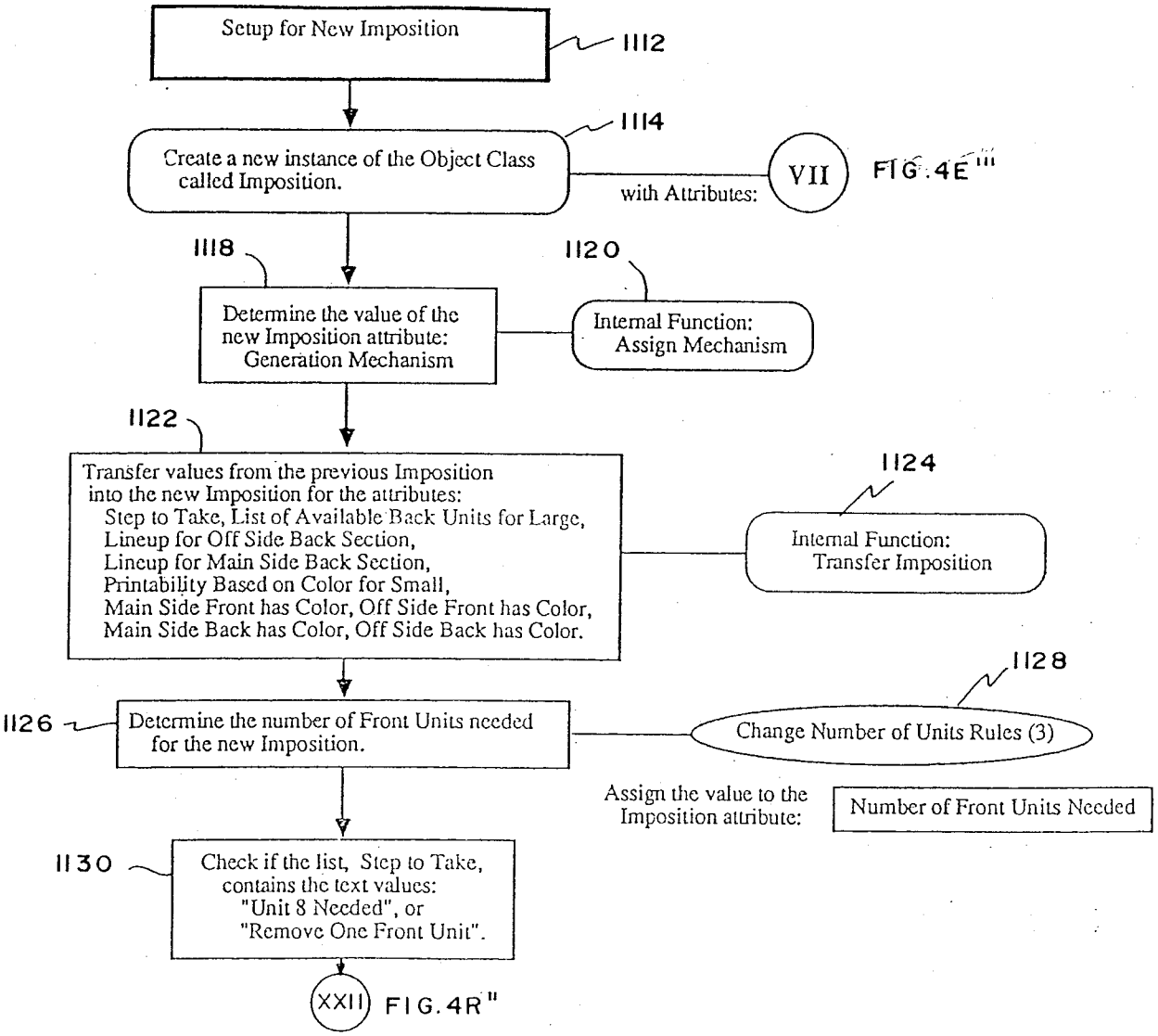
Figure 4R:
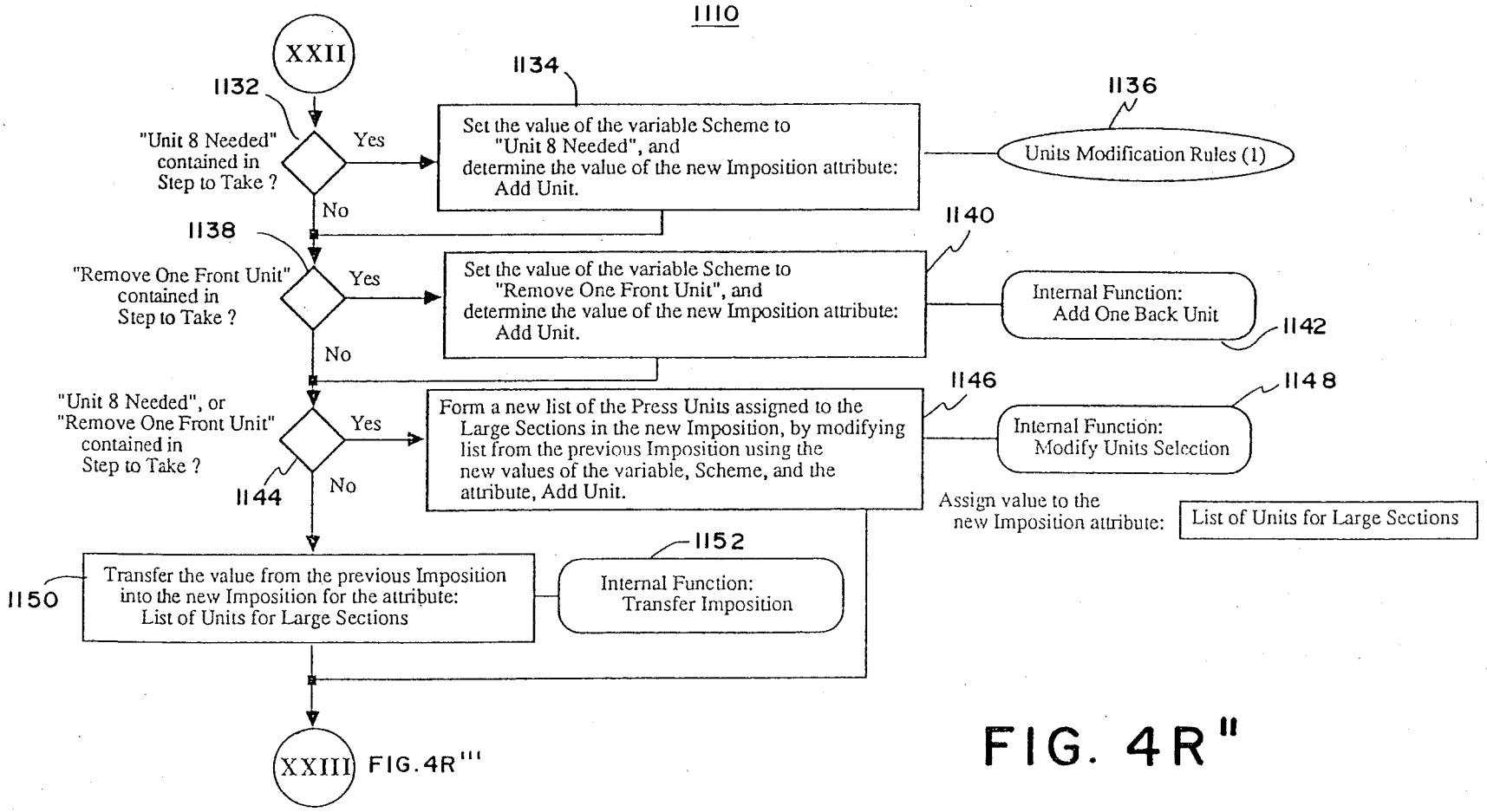
Figure 4R:
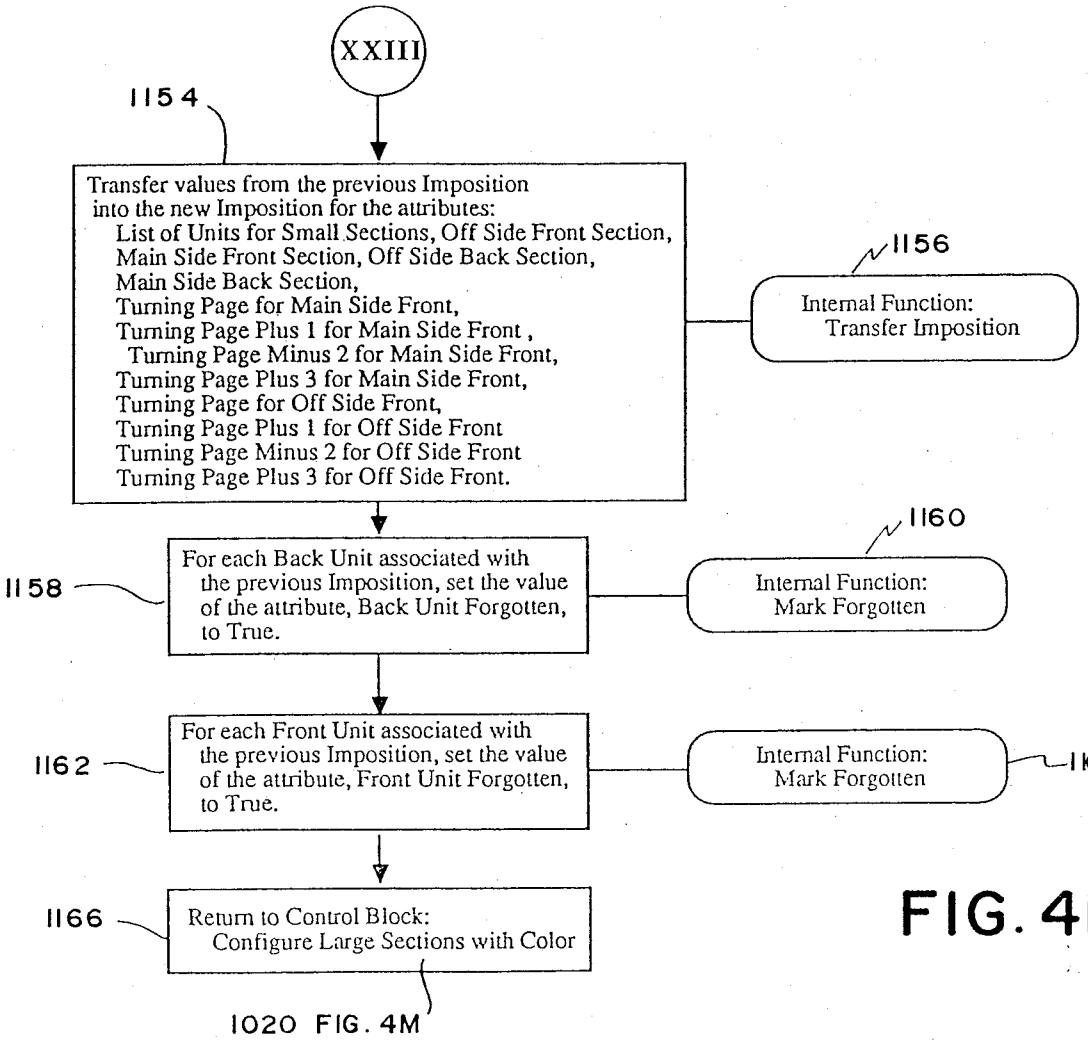

If an evolution technique is found that is capable of correctly changing the current hypothetical lineup as specified by the values of the IMPOSITION attribute evolution.technique, the generate-and-test method continues in its loop within the control block 900, proceeding then to step 934, which determines whether or not there is a possible evolution technique and, if so, the control block SET.UP.FOR.NEW.IMPOSITION 1110 is invoked. The steps of the control block 1110 will now be described in more detail with respect to FIG. 4R. Generally, this control block 1110 sets up new instances of the object class IMPOSITION, and designates the previous instances with the boolean notation, "forgotten". This permits the new instance of the class object IMPOSITION to be constructed so that new values may be assigned to its attributes in the control block GENERATE.IMPOSITION.FOR.LARGE.-COLOR 1020, before the new lineup is again tested in the control block TEST.IMPOSITION 924. If not printable as determined by the control block 924, the control block SEEK.ALTERNATIVE 1000 examines the current lineup to determine whether any evolution technique is available to make an acceptable change thereto. If an evolution technique is available, the control block SETUP.FOR.NEW.IMPOSITION 1110 is invoked, the detailed steps of which are shown in FIG. 4R, as will now be discussed. After entering through step 1112, step 1114 created a new instance of the object class IMPOSITION, whose attributes are listed in step 496 (see FIG. 4e). The list of attributes of the new instance is identical to that of the old instance. Then, step 1118 determines the value of the new imposition attribute generation.mechanism utilizing the internal function ASSIGN.MECHANISM as set out in step 1120. As described above, the values of the attribute generation.mechanism are used in step 1030 of the control block GENERATE.IMPOSITION.FOR.LARGE.-COLOR 1020 to determine which of the lineup control blocks 850, 950 or 1070 is invoked. The internal function ASSIGNED.MECHANISM of step 1120 examines the pages of the large sections to be printed. In particular, if either of the large sections is without any color pages, the value of its attribute generation.mechanism is set to "without.first.last.color.page". If the section under scrutiny only has color on its first or last pages, the value of its attribute generation.mechansim is set to "with.first.last.color.page". On the other hand, if the large section under scrutiny has interior color pages, the value of its attribute generation.mechanism is set to "generate.alternative". Thus, as the generate-and-test method loops again through the control block GENERATE.IMPOSITION.FOR.LARGE.COLOR 1020, these values will be used in step 1030 to determine which of the lineup control blocks to invoke. Next, step 1122 transfers from the previous imposition to the new imposition, values of the listed attributes utilizing the internal function TRANSFER.IMPOSITION as noted in step 1124. In particular, step 1122 sets up a new attribute step.to.take for the new instance of the IMPOSITION, to which it transfers the values established in the previous instance of the IMPOSITION for the attribute evolution.technique; these values were previously generated by the rules set [evolution.technique (9)] of step 1014. Next, step 1126 determines the numerical value of the attribute number.of.front.units.needed for the new imposition utilizing the rules set [change.number.of-.units.rules (3)] of step 1128.

Thereafter, step 1130 examines a location in the working memory for the values of the attribute step.to.-take, to determine the presence of the values, "unit.8-.needed" or "remove.one.front.unit", as were determined in the previous instance and now assigned to the attribute step.to.take in this instance. As will be apparent from the following discussion, these values permit the generate-and-test method to make designated changes in the new instance of the object class IMPOSITION with respect to the old instance. If step 1132 determines the presence of the value "unit.8.needed", step 1134 sets the value of the variable "scheme" and utilizing the rules set [units.modification.rules (I)] of step 1136, determines the value of the new IMPOSITION attribute add.unit. The value, "unit.8.needed", of the attribute evolution.technique is generated above in step 1014 of the control block SEEK.ALTERNATIVE 1000 when the three following conditions are met: (1) the page number of the desired color page to be printed on the main side front area (or the off side front area), which is currently not on any color position, is equal to the page number of the page, which is currently on the near center position (or far position of the off side front area) of the twelfth printing unit 12a, plus 2, or is equal to the page number of the page, which is currently on the near position (or far center position for the off side front section) of the twelfth unit 12a, minus 2; and (2) this desired colored page is not the turning page, i.e., the center page of a folded section, as assigned to be printed on the main side front area (or the off side front area) of the press 10, or its number is not equal to the page number of the turning page plus 1; and (3) the eighth printing unit 12e is available for this press run and is not currently being used. In the above, a determination is made as to whether a color page that is not assigned in the current lineup to a color unit 12, is a neighboring page of one that is assigned to a color unit 12 such as the twelfth unit 12*a*. In other words, is the presently unassigned color page equal to a page number that is assigned to the twelfth unit 12*a* plus 2 or minus 2, for example. As described above, lists of these neighboring pages on the tenth and eleventh units 12*c* and *b* were constructed in steps 1052 and 1062 of the control block GENERATE.IMPOSITION.FOR.LARGE.COLOR 1020 and are now available to be searched in steps 1136 (and 1142). In an illustrative embodiment of the composing method of this invention, it is contemplated that an initial lineup was selected based on a "simple scheme" that would not utilize the eight unit 12*e* based upon a soft constraint of certain policy considerations of the newspaper publisher. However, the evolution.technique rules have discerned that a color page has been presently assigned to a non-color unit 12. In an illustrative embodiment of the press 10, the twelfth printing unit 12*a* is capable of printing color. Thus, if the value of the attribute evolution.technique is set to the value "unit.8.needed", step 1134 using the rules set [units.-modification.rules 91)] assigns the color page to the color positions of the twelfth unit 12*a* and brings the eighth printing unit 12*e* into service for the next lineup to be tested.

If step 1138 determines the presence of the value, "remove.one.front.unit", step 1140 sets the value of the variable "scheme" to "remove.one.front.unit" and utilizing the internal function ADD.ONE.BACK.UNIT of step 1142 determines the value of the new IMPOSITION attribute add.unit. Step 1140 is entered if the value of the attribute step.to.take is "remove.one.front-.unit" as set by the rules of 1014, when the following two conditions are met: (1) the page number of the desired page to be printed on the main side front area or the off side front section, which is currently not on any color position, is equal to the number of the page, which is currently assigned on the near center position (or far position for the off side front section) of the twelfth printing unit 12*a*, minus 2, or is equal to the page number of the page, which is currently on the near position (or far center position for off side front area) of the twelfth unit 12*a*, plus two; and (2) there is at least one back unit 12 which is not currently used. As a result, the values of the variable, "scheme" and of the attribute add.unit will be set to indicate a change, whereby one of the front units 12*b* to *f* (but not the twelfth unit 12*a*) as is now used in the current lineup will not be used in the new hypothetical lineup and one of the back units 12*g* to *l* will be placed into the new imposition, whereby the color page not now currently assigned to a color unit 12, will be assigned to one of the color positions of the twelfth unit 12*a*.

Though not shown in FIG. 4R, the control block SETUP.FOR.NEW.IMPOSITION 1110 has further decision blocks that respond in a similar fashion to the values of the attribute step.to.take as determined by the rules set [evolution.technique (9)] of step 1014. In particular, the value of the attribute step.to.take. is set to "angle.bar.main.to.off.on.unit 6" when the following two conditions are met: (1) the main side front area of the press 10 does not have any color pages assigned to be printed thereon or its color pages are not on the color positions of the sixth front unit 12*g*, and (2) the page number of a desired color page of the off side front area, which is not currently assigned to any color position, is equal to the page number of the turning page of the off side front section minus 2 or plus 3. Under these conditions, the color page as was assigned in the current lineup to a non color unit 12 will be assigned to the main side of the sixth unit 12*g* by the use of a set of angle bars 20 directing a half web from the main to off side on the unit 12*g*. By using a set of the angle bars 20 from the main side to the off side on the sixth unit 12*g*, the color page can be printed on the main side and its web 18 then shifted to the off side. As a result, an appropriate internal function sets the value of the variable "scheme" to "angle.bar.main.to.off.on.unit.6" and sets the value of the new IMPOSITION attribute add.unit accordingly.

Similarly, the control block SETUP.FOR.NEW.IMPOSITION 1110 responds to the value, "angle.bar.-main.to.off.on.unit.12" of the attribute step.2.take? to place a color page assigned in the current lineup to a non-color unit 12, to the main side of the color printing unit 12*a*, when the following four conditions are met: (1) the main side front area does not have color pages or its color pages are not on the color positions of the twelfth unit 12*a*; and (2) the page number of a desired color page of the off side front area, which in the current lineup is not on a color position, is equal to the page number of the page, which is currently on the far position of the twelfth unit 12*a*, plus 2, or is equal to the page number of the page, which is currently on the far center position of the twelfth unit 12*a* minus 2; and (3) the desired color page is not the turning page of that section assigned to be printed on the off side front area of the press 10 or its page number is not equal to the page number of the turning page plus 1: and (4) the eighth unit 12*e* is not available for this press run or has been previously assigned. In that case, the values of the variable "scheme" and the attribute add.unit are set to effect a change in the new lineup so that it will include the use of a set of angle bars 20 from the main side to off side on the twelfth unit 12*a*, whereby that color page assigned in the current lineup to a non-color unit 12, may be assigned in the new lineup on the main side of the twelfth unit 12*a* and its web shifted to the off side.

In a similar fashion, the control block SETUP.FOR.-NEW.IMPOSITION 1110 responds to the value "angle.bar.off.to.main.on.unit.12" to reassign a color page presently assigned to a non-color unit 12 in the current imposition to the off side of the twelfth unit 12*a* in the new hypothetical lineup. The value of the attribute set.to.take is set to "angle.bar.off.to.main.on.unit. 12" when the following four conditions are met: (1) the off side front area does not have color pages, or its color pages are not on the color positions of the twelfth unit 12*a*; and (2) the page number of the desired color page of the main side front area, which is not currently assigned to a color position, is equal to the page number of the page, which is currently on the near center location of the twelfth unit 12*a*, plus 2, or is equal to the page number of the page, which is currently on the near position of the twelfth unit 12*a*, minus 2; and (3) this desired color page is not the turning page of the section to be printed on the main side front of the press 10, or its number is not equal to the page number of the turning page plus 1; and (4) the eighth unit 12*e* is not available for this press run, or has been previously assigned. Under those situations the color page is assigned in the next press run to the off side of the twelfth unit 12*a* by using a set of angle bars 20 to shift the web from the off side to the main side of the twelfth unit 12*a*.

Further, step 1144 determines that either of the values "unit.8.needed" or. "removable.one.front.unit" is set as the value of the attribute step.to.take?, step 1146 forms a new list of the printing units 12 assigned to print the large sections for the new imposition, by modifying that list from the previous imposition using the new values of the variable "scheme" and the value of the attribute add.unit, by calling the internal function MODIFY.UNITS.SELECTION in step 1148 as discussed above. On the other hand, if steps 1144, 1138 and 1132 determine that none of these values are present for the attribute step.to.take, step 1150 transfers the values for the previous instance of the object class IMPOSITION into the new instance for the object class IMPOSITION, utilizing the internal function TRANSFER.AND.POSITION of step 1152. The list for the new IMPOSITION is designated as the value "list.of.units.for.large.-sections." After either step 1150 or step 1146, step 1154 transfers values from the previous imposition into the new imposition for the indicated lists of attributes utilizing the internal function TRANSFER.POSITION of step 1156. Thereafter, steps 1158 and 1162 set the value of the attributes back.unit.forgotten and front.unit.forgotten to true by employing respectively in steps 1160 and 1164 the internal function MARK.FORGOTTEN. Thereafter, the control block 1110 returns by step 1166 to the control block CONFIGURE.LARGE.SECTIONS.WITH.COLOR 900 as shown in FIG. 4M, whereby the generate-and-test method continues to loop back through the control block GENERATE.IMPOSITIONS.FOR.LARGE.COLOR 1020 to assign values to the new instance of the object class IMPOSITION, before control block TEST.IMPOSITION 924 again tests the new lineup as represented by the new instance invoking the rules set [large.color.printable.-base. on.lineup.rules (6)] of step 926. In this fashion, the generate-and-test method will loop through these control blocks until an acceptable lineup is determined or it is determined that no evolution technique is available to modify the new or current lineup.

The control block FOUR.SECTION.LINEUP 660 calls from its step 700, as shown in FIG. 4H, either of the control blocks CONFIGURE.SMALL.SECTIONS.WITH.COLOR 800 or CONFIGURE.SMALL.SECTIONS 760, to define for the small sections the values of the object class IMPOSITION. The steps of the control block 760 and 800 are similar in many ways and the control block 800 will now be described with respect to FIG. 4K as illustrative of both control blocks. After entry through step 802, step 804 determines whether the color requirements of the small sections of this press run presents any problem for this particular printing press 10 to print. By using the rules set [small.color.printable. rules (22)] as set off in step 806 to compare the values of the PRESS.RUN and PRESS attributes. For example, if the particular press run to be printed consists only of color page at selected locations within the small sections, e.g., on the first, third, third from last and last pages of a section, the imposition for that press run may be composed by the control block FIGURE.SMALL.SECTIONS 760, as shown in FIG. 4J, and the imposition attribute small-.color.imposition.technique is assigned the value "as.-black.and.white? ". The [small color printable rules] of step 806 will also determine if an imposition cannot be composed for this press run for the given press run and, if so, calculates a message number indicative of 20 possible messages as would explain the nature of the composition problem. Next, step 808 determines whether it is possible to compose a lineup by examining the value assigned to the IMPOSITION attribute message.number and causes the appropriate message in accordance with the assigned message number to be displayed upon the user interface, before aborting this consultation. Next, step 812 accesses the value of the IMPOSITION attribute small.color.imposition.technique and, if its value is "as.black.and.white?", step 816 invokes the control block CONFIGURE.SMALL.SECTIONS 760, as shown in FIG. 4J. Otherwise, step 818 employs an internal function CHOOSE.UNITS.FOR.SMALL.-SECTIONS to develop a list of the available small units 12. Next, step 822 employs the rules set [small.sections. after.color rules (15)] of step 824 to provide values for the imposition attributes, small.fly.sheet.case and small-.half.unit, as would indicate whether or not a fly sheet was to be used for each of the small sections and whether a small half unit is required for either of the small sections, respectively. Next, step 826 employs the rules sets, [small.chosen.unit.rolls (1)], [small.color.fly. sheets.rules (9)], and [small.color.utilization.rules (16)] as set off in step 830 and the internal function UNIT.DETERMINED of step 828 to determine values for each of the back units for the attributes, state, utilization and small.half.unit.assigned. Next, step 832 determines for each back unit 12 assigned to the small sections, the values for the BACK.UNIT attribute angle.-bar.unit and for the IMPOSITION attributes, number.-of.bar.quarter.unit, number.of.bar.half.unit and direction.of.angle.bar.for.small.black, by employing the rules sets, [small.black.angle.bar.rules (11)] and [small.-black.bar.rules (1 )] as set off in step 834. Thus, the number of the sets of angle bars 20 and their orientation are determined for the small sections. Thereafter, step 836 functions to number or to form a sequence of the pages in ordered position for the small sections, in terms of unit number and plate location, i.e., 1–4, by employing the internal functions, BUILD.SEQUENCE FOR.-MAIN.SIDE.BACK and BUILD.SEQUENCE.FOR-.OFF.SIDE.BACK, of step 840. Thus a lineup or imposition is formed in step 838 and, thereafter, return is made through step 842 to step 706 of the control block FOUR.SECTION.LINEUP 660. As shown in FIG. 4H, the control block 660 continues with determining the lineups of the large sections, as explained above.

If after the control block SETUP.FOR.NEW.IMPOSITION 1110 has been run and the generate-and-test method has returned to the control block SEEK.ALTERNATIVE 1000, as shown in FIG. 40, the rules set [evolution.technique(9)] as set out in step 1014 examines the placement of the interior color pages of the large sections and, if they determine that there is no technique by which the current imposition may be modified to provide a printable one, these rules set the value of the attribute evolution.technique to "none". As a result, when the generate-and-test method returns to step 934 of the control block CONFIGURE.LARGE.SECTIONS.WITH.COLOR 900, as shown in FIG. 4M, this value will be examined and if "none", the program will return through step 942 to one of the control blocks for 460, 590 or 660 depending upon the number of the sections in this press run. For example, if there are four sections in this press run, a return is made to step 716 of the control block FOUR.SECTION.LINEUP 660 and, thereafter, a message is displayed in step 718 similar to that of FIG. 5 displaying upon the user interface a representation of the current imposition but further providing a visual message that this lineup is not printable and providing a selected message indicating why this lineup is not printable, e.g., that certain interior color pages can not be printed. At the same time, a variety of lists of possible color pages are also displayed so that the pressman may make changes in the given press run by rearranging the pages and reassigning color pages to those positions within a section that may be printed in color. In particular, the control block SETUP.FOR.NEW.-IMPOSITION 1110 has created a new instance of the object class IMPOSITION with the following attributes: possible.color.pages.for.main.side.front.on.12, possible.color.pages.for.main.side.front.on.7, possible.-color.pages.for.off.side.front.on.12, and possible.color.-pages.for.off.side.front.on.7. These attributes as their names imply provide lists of those color pages that are available on the off and main sides of the seventh and twelfth printing units 12*a* and 12*f*. Thus, the pressman can determine the possibility of a new press run with different pages and of rearranging the interior color pages so that a printable imposition may be composed.

In considering this invention, it should be remembered that the present disclosure is illustrative only and the scope of the invention should be determined by the appended claims. For example, in the above described illustrative method of composing an imposition, the generate-and-test method for devising an imposition for a press run including some color pages, is only carried out for the large sections of the press run as would be assigned to be printed by the front units 12. It is contemplated that the generate-and-test method described above would also be applicable to composing an imposition for the small sections. Further, the above method of composing an imposition has been described with regard to a particular printing press 10 and to a particular computing scheme; it is contemplated that the method and apparatus of this invention could be carried out upon a variety of different printing presses and could be embodied in a variety of computing techniques other than those described.

We claim:

1. A sequential refinement method of composing an imposition of a printing press for printing a given edition comprised of a given number of sections, said printing press comprised of a folder assembly and an array of printing units, some disposed in front of and some in back of said folder assembly, each of said printing units having a plurality of image positions adapted to receive printing plates to print a like plurality of images onto a web and feeding it to said folder assembly, said folder assembly receiving, combining and folding a plurality of said webs into said given number of sections, said printing press having a plurality of areas, each of said areas having corresponding printing units therein, said imposition comprising an arrangement of said printing plates on selected of said image positions of selected printing units to print said given edition, said method comprising the steps of:

(a) assigning each section of said edition to one of said press areas;

(b) determining which of said printing units is available during the printing of said given edition to be utilized;

(c) examining each printing unit to determine its utilization value in terms of the relative number of said image positions which are available to receive said printing plates during the printing of said given edition with regard to the total number of said image positions for said printing unit; and (d) constructing a list of image positions for each of said press areas and for said section assigned thereto by examining one at a time each of said printing units within said one press area in an order according to the placement of said one printing unit in said array and examining said utilization value of said one printing unit to determine whether or not to include a particular image position of said one printing unit in said list, whereby a list of said image locations is constructed in a sequence corresponding to the numerical order of said pages in said section.

2. The method of composing an imposition as claimed in claim 1, wherein there is further included the step of acquiring information as to said given number of sections in said given edition and as to a given number of pages in each of said sections.

3. The method of composing an imposition as claimed in claim 2, wherein there is further included the step of acquiring information as to which of said plurality of printing units is available or not.

4. The method of composing an imposition as claimed in claim 3, wherein there is included the steps of determining based upon the total number of pages in all of said sections and comparing said total number of pages with the capacity of said available printing units to determine whether this edition is printable or not.

5. The method of composing an imposition as claimed in claim 4, wherein if said total number of pages exceeds said capacity of said available printing units, a message is displayed indicating that this edition is not printable.

6. The method of composing an imposition as claimed in claim 2, wherein information as to said sections is inputed in a given order and there is further included the steps of examining said given number of pages in each of said sections, and assigning each section of said edition to a particular area of said press based on the order of inputting information and the relative number of pages in said section.

7. The method of composing an imposition as claimed in claim 1, wherein there is further included the step of examining each section as to its number of pages and constructing a list of said sections ordered as to the number of pages in each of said sections.

8. The method of composing an imposition as claimed in claim 1, wherein there is further included the step of examining each section to be printed as to its number of pages and determining based upon the number of pages in a particular section the number of printing units required to print that section as assigned to said one press area.

9. The method of composing an imposition as claimed in claim 8, wherein there is further included the step of determining whether any of said plurality of printing units in said one press area is not available and determining the number of presently available printing units to print that section in said one press area.

10. The method of composing an imposition as claimed in claim 9, wherein there is included the step of comparing said number of available printing units in said one area to said number of required printing units in said one area and, if there is not sufficient available printing units in said one area to print that section, determing whether there is a printing unit in another press area as could provide additional capacity to print that section.

11. The method of composing an imposition as claimed in claim 1, wherein there is further included the step of examining each of said sections to determine whether any section has a color page and to provide a manifestation indicative thereof.

12. The method of composing an imposition as claimed in claim 11, wherein said method of composing an imposition is responsive to said color page manifestation to invoke a generate-and-test method comprising the steps of:

(1) composing a current imposition for said given edition with said color page comprising an arrangement of said printing plates disposed at selected image positions of selected printing units based;

(2) comparing said current imposition with said array of printing units to determine if said color page is assigned to be printed by a printing unit capable of printing color to indicate whether said current imposition is printable or not printable; and (3) if not printable, devising a proposed change to said current imposition before returning to step (1) whereby a new imposition incorporating said proposed change is composed.

13. The method of composing an imposition as claimed in claim 12, wherein step (1) of said generate-and-test method composes said current imposition using steps (a) (b) and (c).

14. The method of composing an imposition as claimed in claim 7, wherein steps (b) and (c) are first performed with respect to said smaller sections and thereafter performed with respect to said larger sections.

15. The method of composing an imposition as claimed in claim 1, wherein there is further included the steps of detecting the presence and location of a set of angle bars with respect to said array of printing units and, if present, constructing said list of image positions to include another image position in said list of image positions as originally assigned to a different area other than said one area.

16. The method of composing an imposition as claimed in claim 1, wherein a portion of each of said printing units is assigned to said first and second press areas, said method further comprising the steps of determining the number of printing unit portions assigned to said first press area and determining the number of press unit portions assigned to said second press area, determining the difference between said number of printing unit portions in said first and second areas, and based upon said difference assigning a number of said sets of angle bars to transfer a web output from a printing unit portion within said second area to said first area.

17. The method of composing an imposition as claimed in claim 16, wherein there is further included the step of detecting the presence and location of a set of angle bars within said array of printing units and, if so included, constructing said list of image locations as in step (c) by including said image position from said second press area into said list of image positions of said first press area.

18. The method of composing an imposition as claimed in claim 1, wherein there is further included the step of examining each of said sections to determine whether any section of said edition has a color page and, if not, providing a first manifestation indicative thereof; if there is a color page in said section, determining whether said color page is disposed at a certain page number within said section and, if so, providing a second manifestation thereof; and further determining whether said color page is at another page number within said section and, if so, providing a third manifestation indicative thereof.

19. The method of composing an imposition as claimed in claim 18, wherein said method is responsive to either of said first or second manifestations for composing said imposition in accordance with steps (a), (b) and (c).

20. The method of composing an imposition claimed in claim 19, wherein said method of composing an imposition is responsive to said third manifestation to invoke a generate-and-test method comprising the steps of:

(1) composing a current imposition for said given edition with said color page comprising an arrangment of said printing plates disposed at selected image positions of selected printing units;

(2) comparing said current imposition with said array of printing units to determine if said color page is assigned in said current imposition to be printed at an image position capable of printing color to indicate whether said current imposition is printable or not printable; and (3) if not printable, devising a proposed change to said current imposition before returning to step (1) whereby a new imposition incorporating said proposed change is composed 21. A method of composing an imposition of a printing press for printing a given edition comprised of a given number of sections, at least one of said sections having at least one color page therein, said printing press comprised of a folder assembly and an array of printing units, at least one of said printing units disposed in front of and at least one of said printing units disposed in back of said folder assembly, at least one of said printing units being capable of printing in plural colors, each of said printing units having a plurality of image positions adapted to receive printing plates to print a like plurality of images onto a web and to feeding said web to said folder assembly, said folder assembly receiving, combining and folding a plurality of said webs into said given number of sections, said method comprising the steps of:

(a) composing a current imposition for said given edition comprising an arrangement of said printing plates disposed at selected image positions of selected printing units;

(b) comparing said current imposition with said array of printing units to determine if said one color page is assigned or not assigned to be printed by said color printing unit and thus is or is not printable; and (c) if not printable, devising a change to said current imposition before returning to step a), whereby a new imposition with said change therein is composed.

22. The method of composing an imposition as claimed in claim 21, wherein said step of devising a change, examines said current imposition to ascertain those pages therein that are assigned in said current imposition to be printed by said color printing unit and, based upon those assigned color pages, devises said change to said current imposition.

23. The method of composing an imposition as claimed in claim 21, wherein said step of devising a change further examines the pages assigned in said current imposition to be printed by said color unit and constructs a first list of those pages capable of being printed in color.

24. The method of composing an imposition as claimed in claim 23, wherein said step of devising a change further examines the pages assigned in said current imposition to be printed in color and constructs a second list of those color pages.

25. The method of composing an imposition as claimed in claim 24, wherein the step of devising a change further compares said first and second lists and constructs a third list of those color pages not assigned in said current imposition to be printed by a color unit.

26. The method of composing an imposition as claimed in claim 21, wherein said step of devising a change further determines which of said printing units is available and determines whether pages originally assigned in said current imposition to be printed in one color on said color unit could be printed on one of said available units and, if so, for devising a change to assign said one page from said color unit to said one available unit.

27. The method of composing an imposition as claimed in claim 23, wherein said steps (a), (b) and (c) are repeated a given number of times and if said new imposition remains unprintable, displaying a message indicating that said edition is unprintable and including said list of pages capable of being printed in color.

28. The method of composing an imposition as claimed in claim 21, wherein said step of devising a change further examines said printing units adjacent to said color unit of said printing press and constructs a first list of those neighboring pages assigned to be printed by said adjacent printing units.

29. The method of composing an imposition as claimed in claim 28, wherein said step of devising a change further constructs a second list of those pages assigned to be printed in color but not assigned in said current imposition to be printed by said color unit, and compares said first and second lists and, if there is a match, devising a change so that said neighboring color page is assigned to said color unit in the said new imposition.

30. The method of composing an imposition as claimed in claim 21, wherein said current imposition does not assign pages to a particular unavailable printing unit, and said step of devising a change further renders available said unavailable unit, whereby said new imposition includes said previously unavailable unit in said new imposition.

31. The method of composing an imposition as claimed in claim 21, wherein said step of devising a change further examines said color unit to determine said non color pages assigned in said current imposition to said color unit and devises a change whereby said non color pages are assigned to another, non color unit.

32. The method of composing an imposition as claimed in claim 21, wherein said step of devising a change further examines said color printing unit to determine any image position thereon to which a non color page is assigned in the current imposition.

33. The method of composing an imposition as claimed in claim 21, wherein said step of devising a change further examines said color unit to identify at least one image position thereof as would be available to print a color page, determines a page assigned in said current imposition to be printed in color but unassigned to a color unit and its relationship to said unassigned position of said color unit and, if acceptable, devising said change as the incorporation of a set of angle bars to shift said unassigned color page to be printed upon said available position of said color unit.

34. The method of composing an imposition as claimed in claim 21, further including the steps of repeating steps (a), (b) and (c) until said comparing step determines that said new imposition is printable and, if printable, displaying a message indicative of said printable imposition.

35. The method of composing an imposition as claimed in claim 21, wherein steps (a), (b) and (c) are repeated until said comparing step (b) determines that said edition is not printable and, if not printable, displaying a message indicative thereof.

36. The method of composing an imposition as claimed in claim 21, wherein said steps (a), (b) and (c) are repeated a given number of times and, if said new imposition remains unprintable, displaying a message thereof and thereafter terminating said composing method.

37. The method of composing an imposition as claimed in claim 21, wherein said step (a) of composing further examines the position of said one color page within its section and, if said one color page is disposed at a first predetermined number of it's section, said current imposition is composed based upon a premise that said section has special color pages.

38. The method of composing an imposition as claimed in claims 37, wherein said step (a) of composing further examines the position of said one color page within its section and if said one color page is disposed at a second predetermined number different from said first predetermined number, said current imposition is composed based upon a premise that said edition is without multiple color pages.

39. The method of composing an imposition as claimed in claim 21, wherein said step of devising a change to said current imposition uses backward reasoning and sets of heuristic rules, said rules based upon the configuration of said press, the characteristics of said given edition, and operational rules and conditions for said press.

40. A sequential refinement method of composing an imposition of a printing press for printing a given edition comprised of a given number of sections, each section including a given number of pages, said printing press comprised of a folder assembly and a plurality of press areas, each area including an array of printing units, with some of said printing units disposed in front of and some in back of said folder assembly, each of said printing units having a plurality of image positions adapted to receive printing plates to print a like plurality of images onto a web and to feed the web to said folder assembly, said folder assembly adapted to receive, cut, combine, and fold a plurality of said webs into said given number of sections, said imposition comprising an arrangement of said printing plates on selected image positions of selected printing units to print said given edition, said method comprising the steps of:

(a) assigning each section of said edition to one of said press areas using backward reasoning and sets of heuristic rules based upon the configuration of said press, the nature of said edition, and operational rules and conditions for said press;

(b) selecting the printing units to be utilized within each press area using backward reasoning and said rule sets;

(c) selecting the image positions to be utilized on each selected printing unit using backward reasoning and said rule sets; and (d) composing said imposition by constructing a list of said selected image positions for each of said sections in a sequence corresponding to the numerical order of said pages in each section.

41. The method of composing an imposition as claimed in claim 40, wherein there is further included the step of acquiring information as to said given number of sections in said given edition and as to a given number of pages in each of said sections.

42. The method of composing an imposition as claimed in claim 41, wherein there is further included the step of acquiring information as to which of said plurality of printing units is available or not.

43. The method of composing an imposition as claimed in claim 42, wherein there is included the steps of determining based upon the total number of pages in all of said sections and comparing said total number of pages with the capacity of said available printing units to determine whether this edition is printable or not.

44. The method of composing an imposition as claimed in claim 41, wherein information as to said sections is inputted in a given order and there is further included the steps of examining said given number of pages in each of said sections, and assigning each section of said edition to a particular area of said press based on the order of inputting information and the relative number of pages in said section.

* * * * *